US005398098A

United States Patent [19]

Fukunaga et al.

[11] Patent Number: 5,398,098

[45] Date of Patent: Mar. 14, 1995

[54] IMAGE FORMING APPARATUS

[75] Inventors: Takahiro Fukunaga, Sakurai; Osamu Nakayama; Hideaki Hagihara, both of Nara; Masakiyo Okuda, Ikoma; Kazuo Nakamura, Yamatotakada, all of Japan

[73] Assignee: Sharp Kabushiki Kaisha, Osaka, Japan

[21] Appl. No.: 186,681

[22] Filed: Jan. 25, 1994

[30] Foreign Application Priority Data

| | | | |
|---|---|---|---|
| Jan. 26, 1993 | [JP] | Japan | 5-010814 |
| Apr. 28, 1993 | [JP] | Japan | 5-102899 |
| Sep. 30, 1993 | [JP] | Japan | 5-245099 |

[51] Int. Cl.[6] ..... G03G 15/08; G03G 21/00

[52] U.S. Cl. ..... 355/200; 355/260; 355/298; 118/653

[58] Field of Search ..... 355/210, 298, 200, 260; 118/653

[56] References Cited

U.S. PATENT DOCUMENTS

| | | | |
|---|---|---|---|
| 4,614,165 | 9/1986 | Folkins et al. | 118/657 |
| 4,849,791 | 7/1989 | Hagihara et al. | 355/298 |
| 4,850,303 | 7/1989 | Cipolla et al. | 118/653 |
| 5,017,962 | 5/1991 | Tsuji et al. | 355/210 |
| 5,030,988 | 7/1991 | Haneda et al. | 355/200 |
| 5,047,801 | 9/1991 | Haneda et al. | 355/200 |
| 5,121,168 | 6/1992 | Aoki et al. | 355/298 |
| 5,126,799 | 6/1992 | Matsuura et al. | 355/298 |
| 5,206,692 | 4/1993 | Ishida et al. | 355/260 |
| 5,260,750 | 11/1993 | Ishida et al. | 355/260 |
| 5,266,998 | 11/1993 | Lee | 355/210 |

FOREIGN PATENT DOCUMENTS

| | | | |
|---|---|---|---|
| 276910 | 8/1988 | European Pat. Off. | 355/210 |
| 62-32483 | 2/1987 | Japan . | |
| 62-287279 | 12/1987 | Japan . | |
| 63-8755 | 1/1988 | Japan . | |
| 1-237672 | 9/1989 | Japan | 355/210 |

*Primary Examiner*—R. L. Moses

*Attorney, Agent, or Firm*—George W. Neuner; David G. Conlin; Kevin J. Fournier

[57] ABSTRACT

An forming apparatus of the present invention is provided with a waste-toner transport unit that is installed separately from a photoreceptor drum cartridge. The waste-toner transport unit is pivoted so that the photoreceptor drum cartridge is easily removed from a machine main body. This arrangement makes it possible to miniaturize the photoreceptor drum cartridge and to use the waste-toner transport unit repeatedly. In another image forming apparatus of the present invention, a developer-supplying container, a waste-toner container, and a waste-developer container for receiving excessive developer that has been overflown from the developer tank are integrally formed into a container unit. This arrangement makes it possible to reduce the volumes of the containers in accordance with the respective supplying quantities of developer. Further, a pressing mechanism is provided so that upon replacing the container unit, the developer tank is brought apart from and close to the photoreceptor drum simultaneously with the pivotal movement of the container unit. This arrangement makes it possible to reduce the number of steps that are taken in the replacing operation as well as to prevent misoperations such as caused by negligence of duty in pressing the developer tank toward the photoreceptor.

52 Claims, 39 Drawing Sheets

IMAGE FORMING APPARATUS

FIELD OF THE INVENTION

The present invention relates to an image forming apparatus, such as copying machines, printers, and facsimiles, and more particularly to an image forming apparatus that is provided with: a photoreceptor whereon an electrostatic latent image is formed, a developing device for visualizing the electrostatic latent image, a developer supplying container for supplying toner to the developing device, and a waste toner collecting device for collecting waste toner.

BACKGROUND OF THE INVENTION

Image forming apparatuses include printers, facsimiles, and copying machines, and more particularly include electrophotographic apparatuses. Recently, an image forming apparatus, wherein process cartridges are used, has been proposed. The process cartridge refers to a unit wherein peripheral members for use with a device such as a photoreceptor, a charger, a developing device, and cleaning device, are integrally installed for each process.

A drum cartridge 52, shown in FIG. 41, and a developing cartridge 53, shown in FIG. 42, are exemplified as those process cartridges. In the drum cartridge 52, a photoreceptor drum 54, a waste-toner transport section 55, and other members are integrally installed into one unit. In the developing cartridge 53, a magnet roller, not shown, a toner cartridge 56, a waste-toner collecting box 57 and other members are integrally installed into one unit. As illustrated in FIG. 40, the drum cartridge 52 and the developing cartridge 53 are removably attached to a copying machine 51. In such a copying machine 51, replacement of certain parts is performed by replacing the corresponding cartridge at one time.

Further, in some of the conventional apparatuses, a main cartridge, wherein a photoreceptor, a charger and a cleaning device are integrally installed, is removable attached to the apparatus, instead of the process cartridges.

By concentrating some parts integrally into each cartridge, it becomes possible to attach and remove parts easily; this simplifies maintenance such as replacement of parts, etc. As a result, the maintenance, which was conventionally performed by specialized engineers, may be also performed by the user.

Here, the service lives of respective parts are different from one another; therefore, in the case of replacing each cartridge at one time as described above, the time of replacement is restricted by the member that has the shortest service life in the cartridge. For example, the photoreceptor drum 54 is most likely to have a shorter service life than the waste-toner transport section 55 in the drum cartridge 52. Therefore, the service life of the photoreceptor drum 54 restricts the time of replacement of the entire drum cartridge 52. Consequently, the waste-toner transport section 55, which would otherwise be continuously used, is also disposed as waste; this results in wasteful use of resources as well as an increase in maintenance cost.

The problem described above is the first problem to be solved by the present invention in connection with the cartridges of the image forming apparatus.

Meanwhile, for example, in dry copying machines, a developing device wherein an electrostatic latent image formed on the surface of the photoreceptor drum is visualized, that is, developed by using developer that consists of two ingredients of carrier and toner, is used in most cases. The image on the surface of the photoreceptor that is visualized by the developer is transferred onto a sheet of copy paper, thereby forming a copied image. In such a developing device, toner is consumed during the developing processes, while carrier remains in the developing device without being consumed. Therefore, the carrier in the developing device gradually deteriorates through stirring processes that are repeatedly carried out. This is because the resin coat layer of the carrier surface tends to come off, and toner tends to adhere to the carrier surface. As the carrier deteriorates, the charging performance of the developer gradually decreases.

In this connection, an apparatus wherein the decrease in charging performance is prevented by supplying developer consisting of a mixture of carrier and toner to the developing device from a developer-supplying container, has been proposed. For example, Japanese Laid-Open Patent Application No. 267683/1987 (Tokukaihei 1-267683) discloses such an apparatus. In the developing device of this type, developer inside the developer tank becomes excessive due to supply of carrier, and overflows from a developer overflow outlet formed in the wall surface of the developer tank. The resulting excessive toner is discharged into a waste-developer container and stored therein. Through these continuous supplying and discharging processes, deteriorated developer contained inside the developer tank is gradually exchanged for newly supplied toner and carrier; this makes it possible to maintain the charging performance and to reduce adverse effects on copied-image quality.

The developer-supplying container and the waste-developer container, which are commonly integrated into one unit, are removably attached to the main body of the apparatus. This arrangement makes it possible to replace both of the containers more easily compared to the case wherein these parts are independently attached to the main body of the apparatus.

The residual toner on the surface of the photoreceptor, on the other hand, is collected by the cleaning device after the developing process, and is housed in a waste-toner container, which is installed inside the cartridge, or which is installed separately from the cartridge.

However, the waste-toner container is installed separately from the developer-supplying container and the waste-developer container that are integrated into one unit; this gives rise to a need to further improve the replaceability of those three containers.

Moreover, in the case where the waste-toner container is installed together with the photoreceptor in the same cartridge, the cartridge needs to be replaced by the new one when the service life of the photoreceptor has terminated. Therefore, the volume of the waste-toner container needs to be set in relation to the service life of the photoreceptor. In this case, the longer the service life of the photoreceptor is, the larger the volume of the waste-toner container should be made. As a result, the size of the waste-toner container tends to make the entire apparatus become bulky.

Furthermore, in the case of the apparatus without such a cartridge, the waste-toner container is independently installed. Here, when the waste-toner container has been filled with toner, the waste-toner container is replaced, or the toner inside the waste-toner container is disposed as waste. Therefore, this arrangement requires a detection means for detecting the situation where the waste-toner container is filled with toner and an informing means for dealing with the situation, thus causing an increase in production cost.

The problem described above is the second problem to be solved by the present invention in connection with the waste-toner container of the image forming apparatus.

Meanwhile, for example, in the case of a copying machine which is capable of full-color copying by installing a mono-color-toner developer tank and a plurality of developer-supplying containers, it is necessary to replace the developer tank and the developer-supplying containers at least in terms of respective colors. Here, each developer tank is forced to contact the photoreceptor drum in order to maintain a predetermined positional relationship between the photoreceptor drum and the developing rollers installed therein. Therefore, upon replacing the photoreceptor drum, it is necessary to remove the developer tanks beforehand. In this case, if each developer tank and each developer-supplying container together with the waste-developer container or the waste-toner container are integrated into one unit, the developer-supplying container and the waste-developer container or the waste-toner container need to be replaced together with the developer tank.

Thus, it has been desired to develop an arrangement which will enable a plurality of containers to be removably attached more easily.

Moreover, Japanese Laid-Open Utility Model Publication No. 8755/1988 (Jitsukaishou 63-8755) discloses a copying machine which is provided with the following means:

(1) a developer tank which is removably attached to a photoreceptor drum in its axis direction;
(2) a clamping means for preventing the developer tank from moving in the axis direction;
(3) a positioning means for positioning the developer tank at a predetermined station in a direction orthogonal to the axis direction; and
(4) a coupling means for releasing the positioning operation of the positioning means in response to the developing-tank releasing movement made by the clamping means, and for allowing the positioning means to perform the positioning operation in response to the developing-tank fixing movement made by the clamping means.

In the above arrangement, however, although consideration is given to an arrangement for removably attaching the developer tank, no consideration is given to an arrangement for removably attaching other containers and like members easily following the removably attaching operation of the developer tank. Further, it is necessary to operate the clamping means only for the purpose of positioning and clamping the developer tank; this increases operations in number that are required upon making tasks such as replacement of the photoreceptor drum, etc., and makes the tasks more troublesome and time-consuming.

The problem described above is the third problem to be solved by the present invention.

SUMMARY OF THE INVENTION

It is an objective of the present invention to provide an image forming apparatus wherein replacing operations are easily conducted as to cartridges, each integrally containing members that are associated with a certain process of the image forming apparatus, and containers and like parts that are associated with supply or disposal of developer.

It is another objective of the present invention to provide an image forming apparatus which, upon disposal of the cartridges and the containers and like parts, makes it possible to reuse still usable parts and thus to reduce the cost of maintenance.

It is still another objective of the present invention to provide an image forming apparatus wherein replacing jobs of the cartridges can be performed without incurring any damage to the other parts as well as without making any errors in the jobs.

It is still another objective of the present invention to provide an image forming apparatus which eliminates the possibility of accidental spill of toner inside the image forming apparatus that might occur upon replacing those cartridges and containers.

It is still another objective of the present invention to provide a compact image forming apparatus wherein the volumes of the containers and like parts are minimized.

It is still another objective of the present invention to provide an image forming apparatus wherein it is possible to reduce the number of detection means for informing the necessity of parts replacement and the state of parts attachment, and thus to reduce the cost of production.

In order to achieve the above objectives, the image forming apparatus in accordance with the present invention is provided with:

a drum cartridge for housing a photoreceptor drum;
a waste-toner transport unit for transporting toner that has been scraped off the photoreceptor drum;
a developing cartridge for developing an electrostatic latent image that is formed on the photoreceptor drum; and
a toner cartridge which is constituted of a waste-toner container for storing the toner that is transported by the waste-toner transport unit and a developer-supply container for supplying developer to the developing cartridge, both integrally formed into one part,
wherein the drum cartridge, the developing cartridge and the toner cartridge are attached so as to be respectively removable in a first direction, and the waste-toner transport unit is pivotally attached independently from the drum cartridge in such a manner that it allows the drum cartridge to be shifted in the first direction and removed from the apparatus.

With the above arrangement, the waste-toner transport unit and the drum cartridge are installed as respectively separated parts. Further, since the waste-toner transport unit is allowed to pivot independently, it is possible to prevent the waste-toner transport unit from interfering with the shift in the first direction and the removal of the drum cartridge.

Therefore, the drum cartridge, which is a consumable part, can be replaced simply by making the waste-toner transport unit pivot without removing it. Consequently, it is not necessary to dispose as waste the waste-toner transport unit that is still usable; this makes it possible to reduce the cost of maintenance. Moreover, since the waste-toner transport unit and the drum cartridge are installed as respectively separated parts, it is possible to miniaturize the drum cartridge, to reduce the production cost of the drum cartridge, and to reduce the packing cost as well as the transportation cost of the drum cartridge.

In addition to the above arrangement, a shifting means may be installed so that the developing cartridge and the drum cartridge may be shifted in a departing direction or in an approaching direction with each other by the pivotal movement of the waste-toner transport unit.

With this arrangement, for example, in the case of replacing the developing cartridge, the developing cartridge and the drum cartridge are set apart from each other by merely pivoting the waste-toner transport unit; this prevents accidental contacts between those parts that might occur upon pulling out the developing cartridge or the drum cartridge in the first direction. Therefore, the replacement of the developing cartridge or the drum cartridge is easily performed.

Further, in addition to the above arrangement, an inlet of waste toner and a closing means for openably closing the inlet may be respectively attached to the waste-toner container and the waste-toner transport unit. In this case, the closing means are designed so that the inlet become open when the waste-toner transport unit is set at a predetermined station in the proximity of the drum cartridge, and that the inlet is closed when the waste-toner transport unit is pivoted so as to be set apart from the drum cartridge.

This arrangement makes it possible to prevent accidental spill of toner inside the image forming apparatus that might occur upon replacing those cartridges.

In order to achieve the aforementioned objectives, another image forming apparatus in accordance with the present invention is provided with:

- a developer tank for storing developer that is used to develop an electrostatic latent image formed on the photoreceptor, the developer tank being arranged so that upon supply of the developer, excessive developer is allowed to overflow therefrom;
- a developer-supplying container for storing at least one ingredient that is contained in the developer, and for supplying the ingredient to the developer tank;
- a waste-toner container for storing waste toner that has been collected from the surface of the photoreceptor; and
- a waste-developer container for storing developer that has overflown from the developer tank, wherein the three parts, that is, the developer-supplying container, the waste-toner container and the waste-developer container, are integrated into one unit.

With the above arrangement, when the developer inside the developer-supplying container has been used up to cause the necessity of replacing the developer-supplying container, it is possible to replace the developer-supplying container, the waste-toner container and the waste-developer container as one unit at one time. Therefore, if these three containers need to be replaced at one time, the replacing job may be simplified to a great degree. Further, it is possible to eliminate members that would be needed for supporting or guiding the respective containers in the case of separately removing the three containers, thereby reducing the production cost of the image forming apparatus.

Furthermore, it is possible to miniaturize the waste-toner container and the waste-developer container. This is because in the arrangement where the waste-toner container and the waste-developer container are replaced simultaneously as the developer-supplying container is replaced, the total quantity of developer collected in the waste-toner container and the waste-developer container will never exceed the quantity of developer that is filled in the developer-supplying container. Therefore, for example, it is not necessary to provide a large waste-toner container which may be suitable for the life of the photoreceptor. This makes it possible to provide a compact image forming apparatus. Further, it is not necessary to attach a means for detecting the filled-state of waste toner to the waste-toner container, thereby reducing the cost of construction.

In addition to the above arrangement, a coupling mechanism, which removably couples the developer-supplying container to the waste-toner container and the waste-developer container that are formed into one unit, may be installed.

With this arrangement, although the waste-toner container and the waste-developer container are disposed as waste, the developer-supplying container may be reused by filling it with predetermined developer.

Further, instead of the above arrangement, a coupling mechanism, which allows the developer-supplying container, the waste-toner container and the waste-developer container to removably couple to each other, may be installed.

This arrangement makes it possible to reuse the developer-supplying container as well as to separately dispose the waste-developer container and the waste-toner container as waste. Thus, it is possible to easily solve the problem that waste developer and waste toner should be separately treated as different industrial wastes.

Moreover, as to the respective volumes of the developer-supplying container, the waste-toner container and the waste-developer container, setting may be made so that the term, by which all the developer inside the developer-supplying container is used up, virtually coincides with the terms by which the waste-toner container and the waste-developer container are filled up with the respective contents.

Thus, the volumes of the waste-developer container and the waste-toner container may be set to minimum values by using the volume of the developer-supplying container as a reference. Therefore, it is possible to make the space occupied by the three containers in the image forming apparatus as small as possible, thereby further miniaturizing the image forming apparatus.

Furthermore, the volumes of these three containers may be set so as to be successively decreased in this order: the developer-supplying container, the waste-toner container, and the waste-developer container.

The reason of this is explained as follows:

When a toner image formed on the surface of the photoreceptor through the developing process is transferred onto a sheet of paper, all the toner is not transferred thereon, and some toner remains on the surface of the photoreceptor, thereby forming waste toner. Therefore, the quantity of waste toner is smaller than that of the supplied toner. Further, the quantity of at least one of the ingredients, which is to be supplied to the developer tank so as to prevent deterioration of developer stored inside the developer tank, for example, the quantity of carrier, is set to be less than the quantity of the waste toner for cost-related reason. Through the above setting, it is possible to set an optimum volume-wise relationship among the three containers. Therefore, it is possible to make the space occupied by the three containers in the image forming apparatus as small as possible, thereby further miniaturizing the image forming apparatus.

In order to achieve the aforementioned objectives, still another image forming apparatus of the present invention is provided with:

a developer tank for storing developer that is used to develop an electrostatic latent image formed on the photoreceptor, the developer tank being arranged so that upon supply of the developer, excessive developer is allowed to overflow therefrom;

a developer-supplying container for storing at least one ingredient that is contained in the developer, and for supplying the ingredient to the developer tank;

a waste-toner container for storing waste toner that has been collected from the surface of the photoreceptor;

a waste-developer container for storing developer that has overflown from the developer tank; and pressing means for pressing the developer tank toward the photoreceptor drum, wherein the three parts, that is, the developer-supplying container, the waste-toner container and the waste-developer container, are integrated into one container unit, which is removable in a first direction with respect to the developer tank; the container unit is attached so as to freely move between a first station from which the container unit and the developer tank are removed and a second station providing a predetermined position at which the container unit and the developer tank are attached to the image forming apparatus; and the pressing means presses the developer tank toward the photoreceptor following the movement of the container unit toward the second station, as well as allows the developer tank to separate from the photoreceptor following the movement of the container unit toward the first station.

Since the pressing means that moves with the movement of the container unit is installed, this arrangement eliminates the necessity of operations that are independently carried out for positioning and clamping the developer tank with respect to the photoreceptor. Therefore, it is possible to reduce the number of operations that are required upon replacing the containers and like parts. With this arrangement, replacing jobs of the developer tank and the photoreceptor can be easily performed. Further, it is possible to prevent misoperations such as caused by negligence of duty in pressing the developer tank toward the photoreceptor drum. Thus, the construction of the image forming apparatus may be further simplified.

The pressing means also includes:

a shifting member that shifts with the movement of the container unit in a second direction as well as in a third direction that is opposite to the second direction;

a pressing member that moves in a fourth direction so as to press the developer tank toward the photoreceptor as well as moving in a fifth direction so as to separate the developer tank from the photoreceptor in response to the shift of the shifting means; and an elastic member, installed between the shifting member and the pressing member, for driving the pressing member so that the pressing member is moved in the third direction when the shifting member shifts in the second direction in response to the movement of the container unit in the second station, as well as for releasing the driving of the pressing member so that the pressing member is moved in the fourth direction when the shifting member shifts in the third direction in response to the movement of the container unit in the first direction.

This arrangement makes the production of image forming apparatuses easier even if they have such a construction as to provide different volumes of developer-supplying containers depending on colors of developer to be stored therein.

In other words, for example, when the volume of a developer-supplying container is changed, the consequent change in the container weight results in change in the center of gravity in the container unit and the developer-supplying container as a whole. If the center of gravity changes, it is difficult to press the developer tank toward the photoreceptor appropriately even in the case where, for example, the same pressing force is applied to the developer tank at the same position. For this reason, it is necessary to change the setting of pressing conditions on the developer tank depending on colors of developer.

The arrangement of the present invention is able to satisfy this requirement easily by changing: the position of the pressing member, the load of the elastic member, or the attaching position of the elastic member with respect to the pressing member or the shifting member. Therefore, even in the case where a plurality of container units and developer tanks are attached in accordance with a plurality of colors, it is possible to press the respective developer tanks toward the photoreceptor appropriately with well-balanced pressing forces being applied to the developer tanks.

In addition to the above arrangement, the following devices and members may be provided:

an interlock switch for detecting the operable state of the image forming apparatus;

a covering member for covering the interlock switch when the container unit is not positioned at the second station, and for exposing the interlock switch by retreating when the container unit is positioned at the second station;

a lid for allowing access to the inside of the image forming apparatus; and a switch operation section, attached to the inner face of the lid, by which the interlock switch is operated upon closing the lid with the container unit being positioned at the second station.

With this arrangement, the operative face of the interlock switch is covered by the covering member when the container unit is not positioned at the second station. Therefore, upon closing the lid, the switch operation section comes into contact with the covering member; this prevents the lid from being closed. When the lid is closed, this arrangement makes it possible to determine whether the container unit is appropriately attached to the image forming apparatus; therefore, misoperation can be prevented. Moreover, since this arrangement also makes it possible to recognize earlier the situation that the container unit is not attached to the image forming apparatus, it is possible to take prompt countermeasures against the inappropriate situation.

Furthermore, the interlock switch, which detects the operable state of the image forming apparatus, also functions to detect the attached state of the container unit; this makes it possible to reduce the number of switches and to cut the cost of production.

Instead of the above arrangement, a clamping means may be provided. The clamping means is designed to position a raised portion on the container unit in the height direction of the image forming apparatus, as well as to prevent the raised portion from moving either in the direction orthogonal to the pressing direction of the developer tank toward the photoreceptor, or in the direction orthogonal to the height direction of the image forming apparatus.

In this arrangement, since the container unit is not clamped in the pressing direction of the developer tank, it does not cause any adverse effects on the pressing behavior of the developer tank toward the photoreceptor drum.

Instead of the above arrangement, the following devices and means may be provided:

- an upper body to which the developer tank and the container unit are attached and which is opened upward so that the inside of the image forming apparatus is exposed;
- a locking means for locking the upper body in its closed state; and
- a release-restricting means for restricting the locking behavior of the locking means from being released when the container unit is positioned at the first station.

In this arrangement, the release-restricting means prevents the upper body from being opened when the container unit is positioned at the first station at which the container unit and the developer tank are removed. Therefore, it becomes possible to prevent accidental spill of developer from the developer tank which might be caused by misoperation of the locking means when the container unit is positioned at the first station.

For a fuller understanding of the nature and advantages of the invention, reference should be made to the ensuing detailed description taken in conjunction with the accompanying drawings.

BRIEF DESCRIPTION OF THE DRAWINGS

FIG. 32(*b*) is a front view showing the clamping lever and the interlock switch; and FIG. 32(*c*) is a side view showing the clamping lever.

FIG. 33(*b*) is a cross-sectional view that is taken along the line I—I of FIG. 32(*b*).

FIG. 36(*b*) is a front view showing a state where the locking operation is released in the locking device.

FIG. 37(*b*) is a plan view showing a state where the lock-release restricting plate is located at a position for allowing the lock releasing.

FIG. 39(*b*) is a perspective view showing an essential part of the clamping device during the clamping operation.

DESCRIPTION OF THE EMBODIMENTS

[EMBODIMENT 1]

Figure 12:
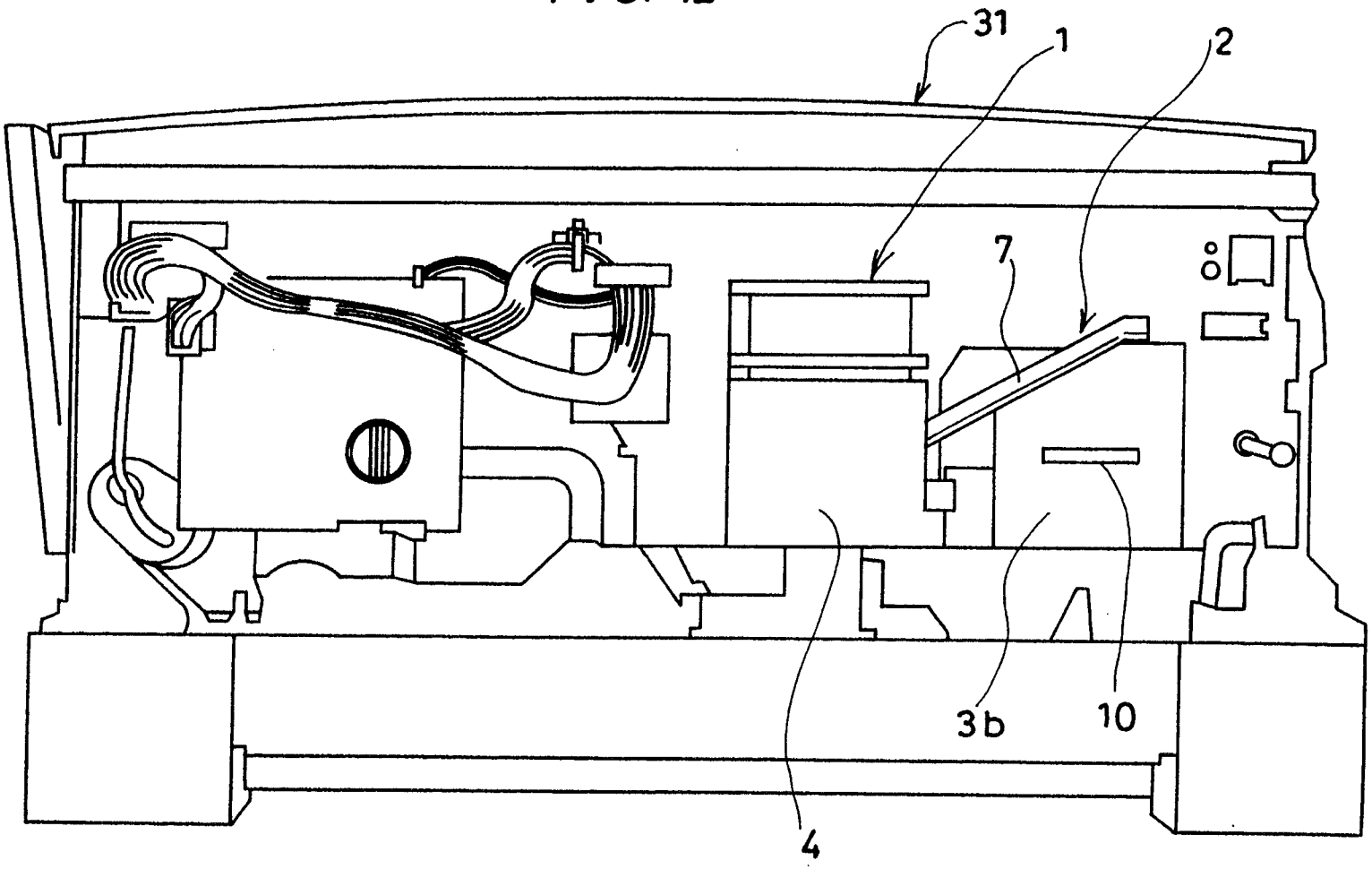
FIG. 12 is an explanatory drawing that schematically shows the structure of a copying machine in accordance with the embodiments of the present invention.

Referring to FIGS. 1 through 7 as well as FIG. 12, the following description will discuss one embodiment of the present invention.

Figure 1:
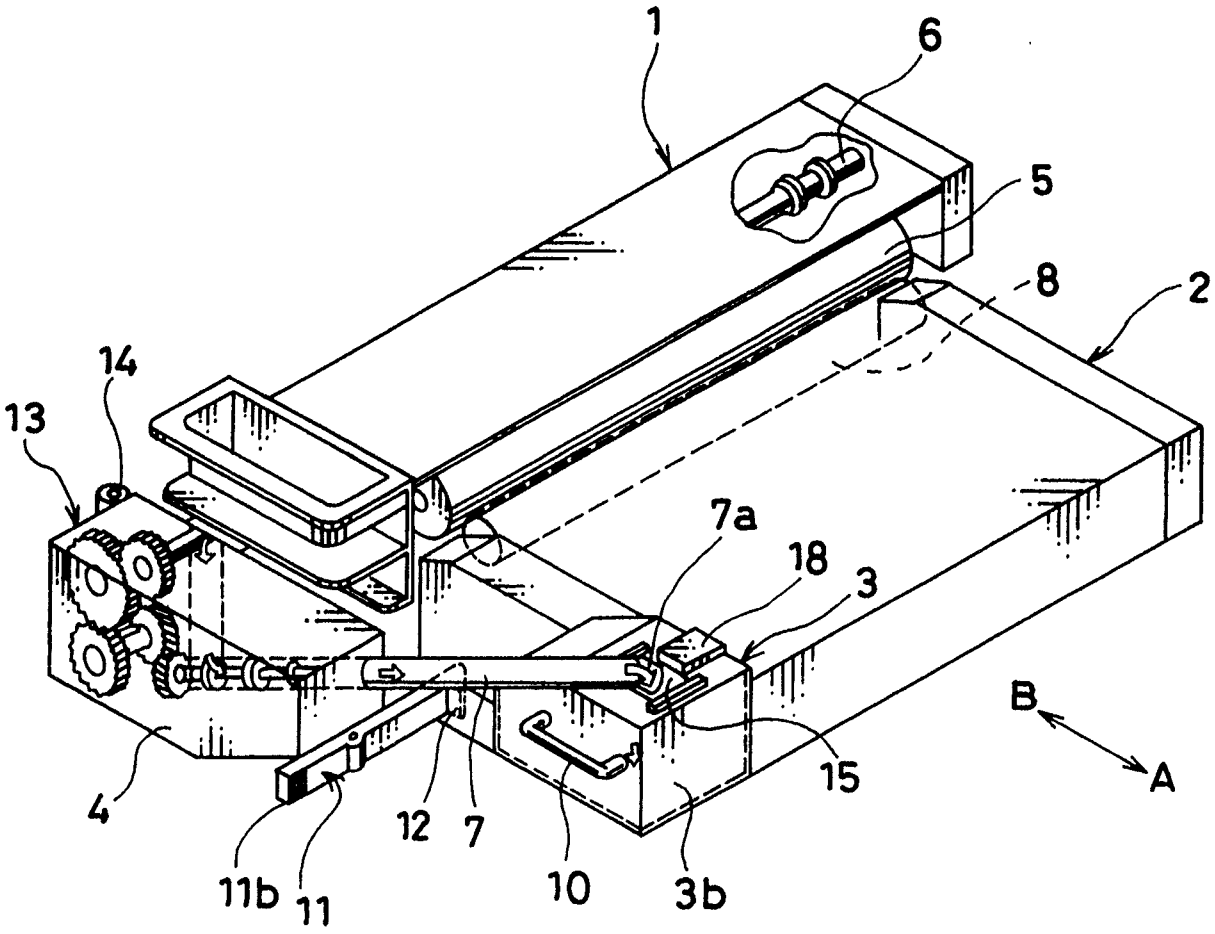
FIG. 1 is a perspective view showing a state where an image forming apparatus of the present invention, which consists of a developing cartridge, a toner cartridge and a waste-toner transport unit, is attached to the main body of a copying machine.

As illustrated in FIG. 1, an image forming apparatus in accordance with the present embodiment is provided with: a drum cartridge 1, a developing cartridge 2, a toner cartridge 3, and a waste-toner transport unit 4, and those cartridges are removably attached to a copying machine 31 respectively, as illustrated in FIG. 12.

As illustrated in FIG. 1, the drum cartridge 1 has a photoreceptor drum 5, and a toner image is formed on the surface of the photoreceptor drum 5. A cleaning blade (not shown), which functions as a cleaning member, is installed so as to contact the surface of the photoreceptor drum 5, thereby removing residual toner from the surface of the photoreceptor drum 5.

Further, a first toner-transporting screw 6 (hereinafter, referred to as first screw), which is used for transporting toner that has been removed by the cleaning blade (hereinafter, referred to as waste toner), is installed in the drum cartridge 1 in parallel with the photoreceptor drum 5. The waste toner is transported to the waste-toner transport unit 4 by the rotation of the first screw 6.

Figure 2:
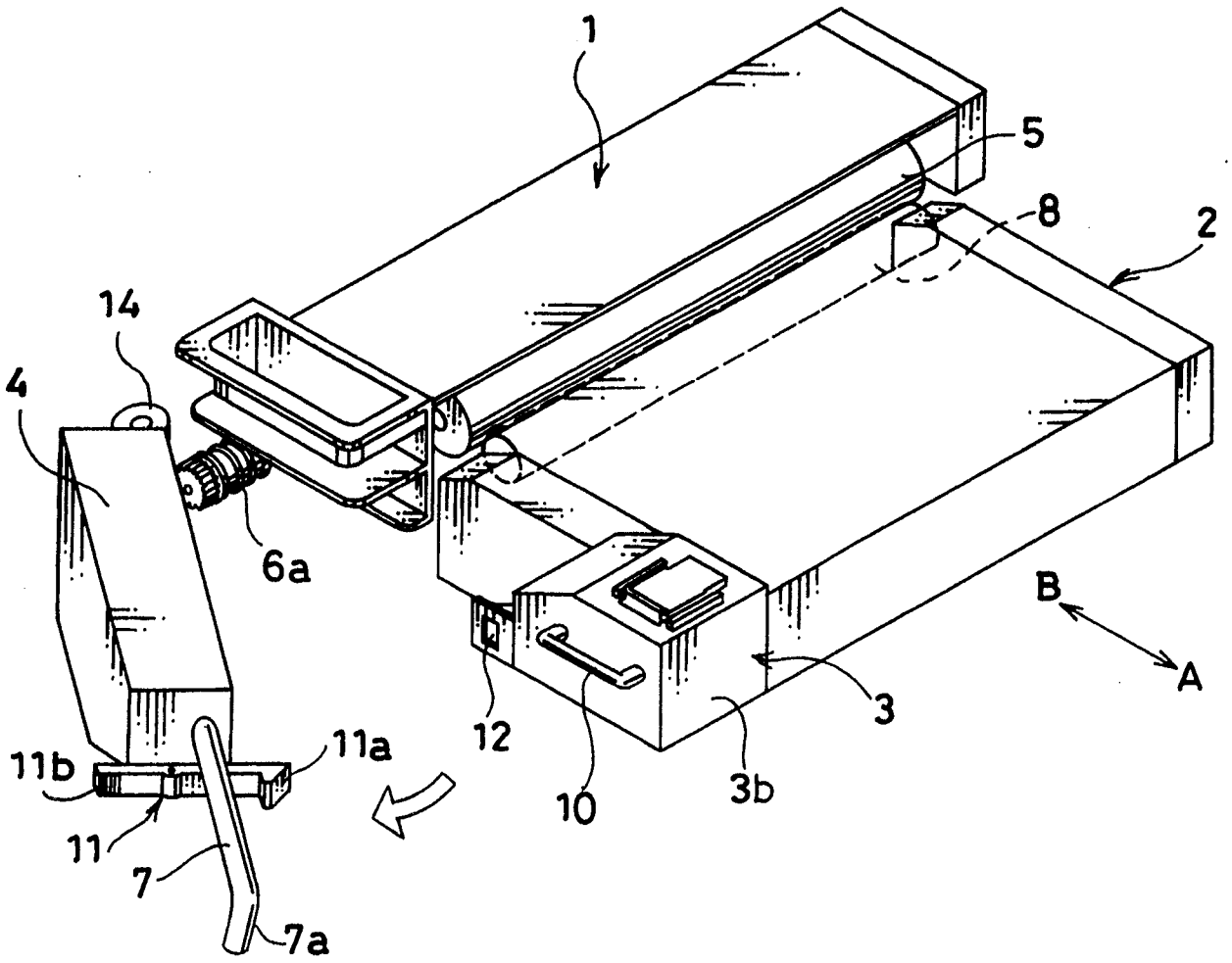
FIG. 2 is a perspective view showing a state where the waste-toner transport unit of FIG. 1 has been pivoted.

As illustrated in FIG. 2, the tip portion 6*a* of the first screw 6 protrudes in the transporting direction of waste toner with respect to the drum cartridge 1, that is, toward the waste-toner transport unit 4 side. Thus, when the waste-toner transport unit 4 is set at the predetermined station of the drum cartridge 1, the tip portion 6*a* is inserted into an opening 4*a*, which will be described later, of the waste-toner transport unit 4. This arrangement prevents toner from being spilt outside.

As illustrated in FIG. 1, a magnet roller 8 is installed in the developing cartridge 2 in parallel with the photoreceptor drum 5 in the proximity thereof. Moreover, a toner vessel (not shown) for storing toner that functions as developer is installed in the developing cartridge 2. The toner is supplied to the magnet roller 8 from the toner vessel, adheres to the surface of the magnet roller 8, and then adheres to an electrostatic latent image formed on the exposed surface of the photoreceptor drum 5.

Figure 3:
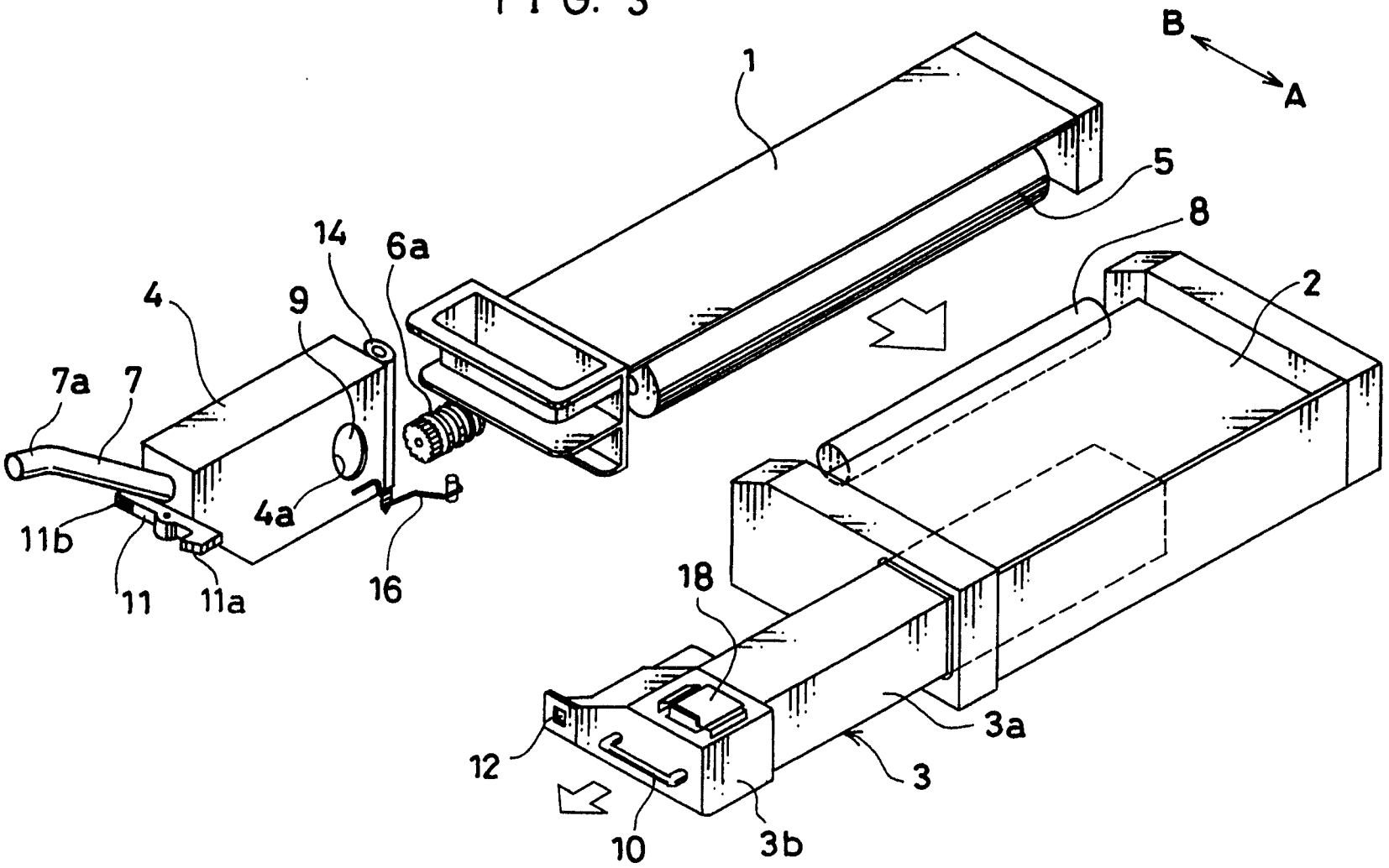
FIG. 3 is a perspective view showing a state where the waste-toner transport unit of FIG. 2 has been further pivoted.

As illustrated in FIG. 3, the toner cartridge 3 is removably attached to the developing cartridge 2. The toner cartridge 3 is constituted of a toner-supplying cartridge 3*a* for supplying toner to the toner vessel and a waste-toner collecting box 3*b* for collecting waste toner that has been removed from the photoreceptor drum 5. Here, the toner-supplying cartridge 3*a* and the waste-toner collecting box 3*b* are integrally molded into one unit.

Additionally, when the drum cartridge 1 and the developing cartridge 2 are placed inside the copying-machine main body, the photoreceptor drum 5 and the magnet roller 8 are pressed against each other. Thus, the distance between the photoreceptor drum 5 and the magnet roller 8 is virtually set to not more than 1 mm.

Figure 4:
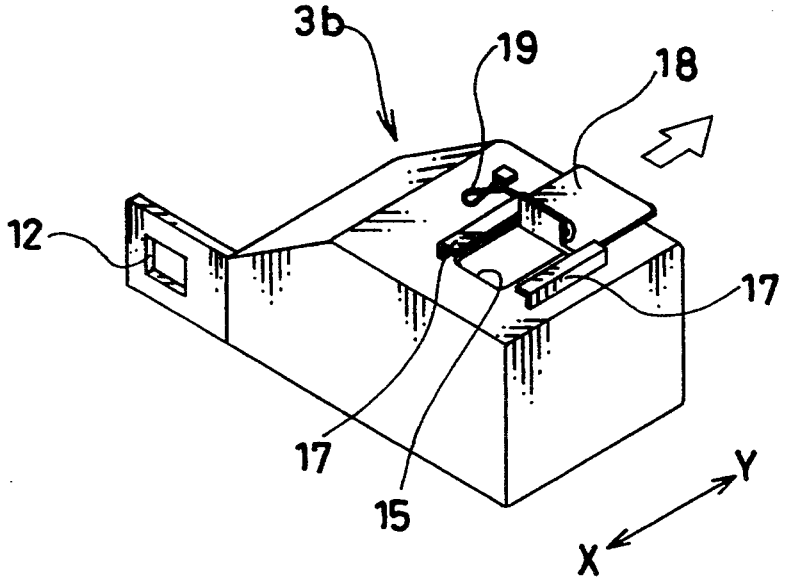
FIG. 4 is a perspective view showing a state where the opening of a waste-toner collecting box, which is provided in the toner cartridge of FIG. 1, is open.
Figure 5:
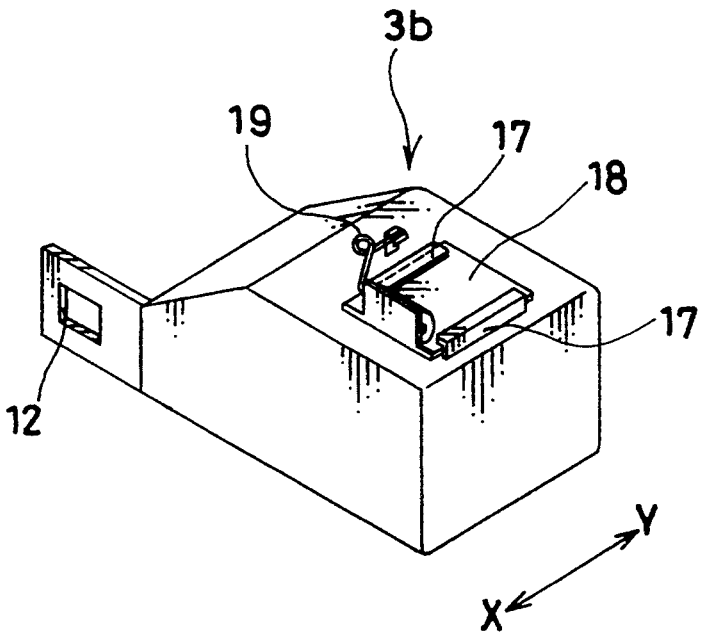
FIG. 5 is a perspective view showing a state where the opening of the waste-toner collecting box of FIG. 4, is closed.

Further, as illustrated in FIGS. 4 and 5, the waste-toner collecting box 3*b* has an opening 15 at the top portion thereof, and waste toner, which has been transported from the waste-toner transport unit 4, is collected through the opening 15. Sliding guides 17 are fixed to both sides of the opening 15, and the first shutter 18, which is a virtually L-shaped flat plate and functions as a closing means, is attached to the sliding guides 17 so as to slide in a direction indicated by an arrow X to Y, thereby opening and closing the opening 15. The X-direction is the same as the removing direction of the toner cartridge 3, and the Y-direction is the same as the inserting direction of the toner cartridge 3.

The first shutter 18 is urged in the arrow X-direction by a tension spring 19 in such a manner that it normally closes the opening 15, as illustrated in FIG. 5. Further, the waste-toner collecting box 3*b* has a stop-hole portion 12 that protrudes toward the drum cartridge 1 therefrom. The stop-hole portion 12 functions as a stopping means for stopping a locking claw 11 installed in the waste-toner transport unit 4, which will be described later.

Moreover, as illustrated in FIG. 1, a second toner-transporting screw 7 (hereinafter, referred to as second screw) is installed in the waste-toner transport unit 4. The second screw 7 is used for transporting waste toner that has been transported from the drum cartridge 1 to the waste-toner collecting box 3*b*. The second screw 7 is connected to the aforementioned first screw 6 through a plurality of gears 13, and thus moves with the first screw 6. The tip portion 7*a* of the second screw 7 is located in the proximity of the opening 15 when the waste-toner transport unit 4 is set at a predetermined station, and waste toner is discharged into the waste-toner collecting box 3*b* through the opening 15.

As illustrated in FIG. 3, a support shaft 14 is fixed to the main body on the B side of the drum cartridge 1, and the waste-toner transport unit 4 is supported by the support shaft 14 so as to freely pivot thereon. Therefore, the waste-toner transport unit 4 is allowed to pivot independently from the drum cartridge 1. Here, the direction in which the waste-toner transport unit 4 starts pivoting from the position close to the drum cartridge 1 is the same as the direction in which the drum cartridge 1, the developing cartridge 2 and the toner cartridge 3 are removed from the main body. Further, the direction indicated by an arrow B is the same as a direction in which copy sheets are transported from the photoreceptor drum 5.

Moreover, a tension spring 16 having one end fixed to the main body is provided so that the waste-toner transport unit 4 is urged in its releasing direction around the support shaft 14. A plate-shaped locking lever 11 is attached to the side face of the waste-toner transport unit 4 on the opposite side to the support shaft 14. The claw 11*a* of the locking lever 11 hooks on the stop-hole portion 12 that is formed on the waste-toner collecting box 3*b*. Thus, the waste-toner transport unit 4 is held on the side of the drum cartridge 1. As illustrated in FIG. 1, the locking lever 11 is released from its hooked-state between the claw 11*a* and the stop-hole portion 12 by pivoting the rear portion 11*b* thereof in the A-direction that is opposite to the B-direction.

As illustrated in FIG. 3, the aforementioned opening 4*a* is provided on the side face of the waste-toner transport unit 4, which faces the drum cartridge 1. As illustrated in FIG. 1, when the waste-toner transport unit 4 is set at the predetermined station in relation to the drum cartridge 1, the tip portion 6*a* of the first screw 6 is inserted through the opening 4*a*. Further, the third shutter 9, functioning as a closing means, is attached to the opening 4*a*, and the third shutter 9 is allowed to close as the waste-toner transport unit 4 is moved apart from the drum cartridge 1.

Figure 6:
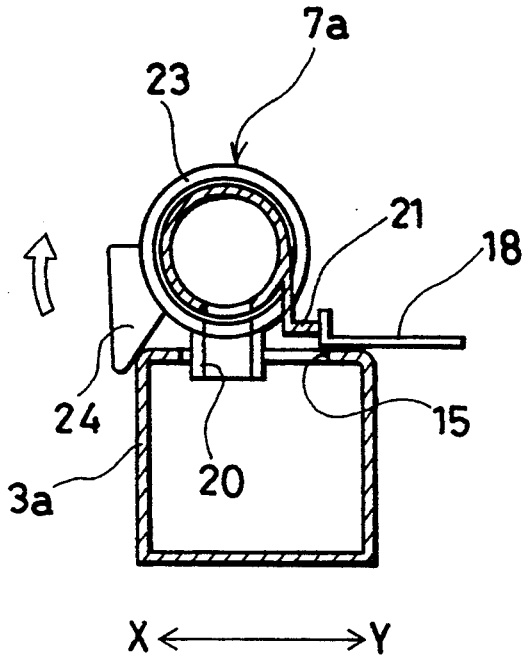
FIG. 6 is a schematic cross-sectional view showing a state where one portion of the waste-toner transport unit of FIG. 1 and the waste-toner collecting box are in contact with each other.

Moreover, as illustrated in FIG. 6, a hole 20 through which waste toner is discharged into the waste-toner collecting box 3*b* as well as a first protruding member 21 is provided to the tip portion 7*a* of the second screw 7. Here, a second shutter 23, functioning as a closing means, is installed along the circumference of the tip portion 7*a* so as to freely pivot. The second shutter 23 is urged by a tension spring (not shown) or other members in such a manner that it normally closes the hole 20. Further, a second protruding member 24 is provided to the second shutter 23 so as to contact the edge of the waste-toner collecting box 3*a* on the X-side thereof. The second shutter 23 and the second protruding member 24 constitute a closing means in accordance with the present invention. Here, the first protruding member 21 comes into contact with the first shutter 18 provided on the waste-toner collecting box 3*a*, and allows the opening 15 of the waste-toner collecting box 3*a* to open.

Figure 7:
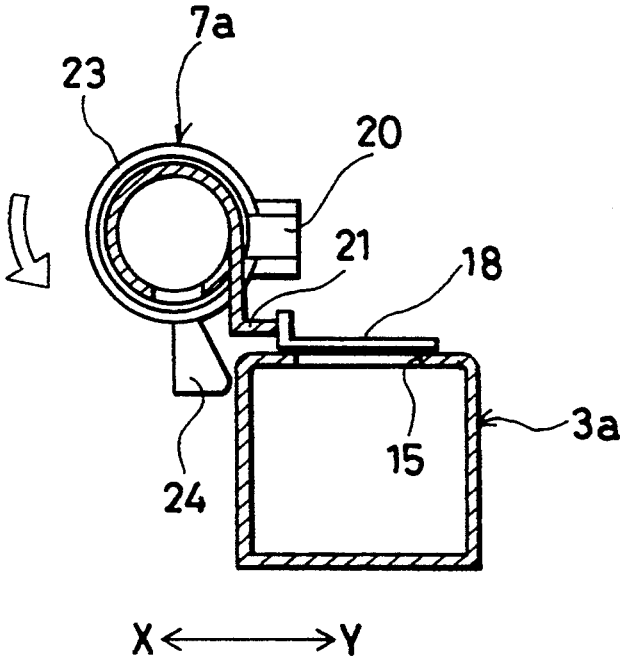
FIG. 7 is another schematic cross-sectional view showing a state where one portion of the waste-toner transport unit of FIG. 1 and the waste-toner collecting box are in contact with each other.

Referring to FIGS. 6 and 7, the following description will discuss a mechanism wherein waste toner is transported from the waste-toner transport unit 4, and discharged into the waste-toner collecting box 3*b* by the second screw 7.

As illustrated in FIG. 2, as the waste-toner transport unit 4, which is released from the lock lever 11, pivots toward the waste-toner collecting box 3*b*, the first protruding member 21 comes into contact with the first shutter 18, and the second protruding member 24 comes into contact with the end portion of the waste-toner collecting box 3*b* on the X-side thereof, as is illustrated in FIG. 7.

Successively, when the tip portion 7*a* is further moved in the Y-direction to reach a predetermined position, the first protruding member 21 allows the first shutter 18 to move in the Y-direction, thereby opening the opening 15, as is illustrated in FIG. 6. In response to the opening of the opening 15, the second protruding member 24, which is in contact with the end portion on the X-side of the waste-toner collecting box 3*b*, allows the second shutter 23 to pivot, thereby opening the hole 20 located at the tip portion 7*a*. Thus, waste toner is discharged into the waste-toner collecting box 3*b* from the opening 15 through the hole 20.

Referring to FIG. 1, the following description will discuss the collecting process of waste toner in the image forming apparatus in accordance with the present invention.

First, a toner image, formed on the surface of the photoreceptor drum 5, is transferred onto a copying material such as a copy sheet by a transferring means such as a transferring roller, not shown, and residual toner is then removed from the surface of the photoreceptor drum 5 by a cleaning member such as a cleaning blade.

Thereafter, the waste toner thus removed is transported to the waste-toner transport unit 4 by the revolving first screw 6, as illustrated in FIG. 1. Then, the waste toner thus transported is again transported to the waste-toner collecting box 3*b* by the second screw 7, which cooperatively revolves with the first screw 6, and is stored in the waste-toner collecting box 3*b*.

The waste-toner collecting box 3*b* is disposed together with the toner cartridge 3 as waste when the exchange of the toner-supplying cartridge 3*a* is demanded in order to supply toner.

Referring to FIGS. 1 through 7 as well as FIG. 12, the following description will discuss the attaching and removing operations of the drum cartridge 1, the developing cartridge 2, the toner cartridge 3, and waste-toner transport unit 4, all of which are attached to the image forming apparatus.

First, an explanation will be given on the removing operation in the respective cartridges. As illustrated in FIG. 1 and FIG. 12, in a state where the respective cartridges are attached to the main body of a copying machine 31, when the rear portion 11*b* of the locking lever 11, provided to the waste-toner transport unit 4, is moved in the A-direction, the claw 11*a* of the locking lever 11, which is hooked on the stop-hole portion 12 of the waste-toner collecting box 3*b*, is allowed to move in the B-direction, thereby releasing the locked state. Then, the waste-toner transport unit 4 is pivoted by the urging force of the tension spring 16 (see FIG. 3) in such a manner as to separate from the drum cartridge 1, as illustrated in FIG. 2.

In this case, as illustrated in FIG. 2, following the pivotal movement of the waste-toner transport unit 4, the tip portion *7a* of the second screw 7 is separated from the first shutter 18 of the waste-toner collecting box *3b*, and the opening 15 of the waste-toner collecting box *3b* is closed by the first shutter 18, while the hole 20 of the tip portion *7a* is also closed by the second shutter 23. Further, the third shutter 9 (see FIG. 3) of the opening *4a*, which forms the contact portion between the waste-toner transport unit 4 and the drum cartridge 1, is closed.

When the waste-toner transport unit 4 is further pivoted, and separated from the drum cartridge 1, the pressing force, which is exerted so as to bring the drum cartridge 1 and the developing cartridge 2 close to each other, is released, thereby allowing the developing cartridge 2 to be separated from the drum cartridge 1, as illustrated in FIG. 3.

Next, the toner cartridge 3 is drawn out of the developing cartridge 2, which has been separated from the drum cartridge 1, by grabbing and pulling a handle 10 that is fixed to the front end of the waste-toner collecting box *3b*. If it is necessary to exchange any of the toner-supplying cartridge *3a*, the waste-toner collecting box *3b* and the developing cartridge 2, those cartridges are disposed as waste, and exchanged for new ones.

Here, the following description will discuss the attaching operation of the cartridges to the apparatus main body.

A new toner cartridge 3 is inserted into a developing cartridge 2. As to the developing cartridge 2, if the service life of the magnet roller has not expired, the developing cartridge 2 before the exchanging operation is used as it is; and if the service life of the magnet roller has expired, the developing cartridge 2 is also exchanged for a new one.

Next, as illustrated in FIG. 12, after attaching a new drum cartridge 1 to the main body of the copying machine 31 on demand, the developing cartridge 2 is inserted therein. In this case, the waste-toner transport unit 4 remains in the opened state so that the drum cartridge 1 is easily attached thereto.

Successively, as illustrated in FIG. 1, the waste-toner transport unit 4 is pivoted so as to come close to the drum cartridge 1, and those cartridges are set at the predetermined stations by making the lock lever 11 hooked on the stop-hole portion 12. Here, the claw 11*a* of the locking lever 11 is not allowed to hook on the stop-hole portion 12 unless the toner cartridge 3 and other cartridges are set at the predetermined stations. Lastly, the front panel, not shown, is returned to the predetermined position, thereby completing the exchanging operation.

As described above, the features of the present embodiment lie in the following: (1) The waste-toner transport unit 4 is provided as an independent part separately from the drum cartridge 1. (2) The waste-toner transport unit 4 is attached to the machine main body so as to freely pivot, in order not to interfere with the replacing operation of the drum cartridge 1, etc. These features make the structure of the drum cartridge simpler in comparison with the conventional structure wherein the waste-toner transport unit and the drum cartridge are integrally formed into one part. This makes it possible to reduce the production cost of drum cartridges. Further, since this arrangement makes it possible to prevent the waste-toner transport unit from being disposed as waste together with the photoreceptor drum which is replaced as a consumable part, the cost of maintenance is reduced on the apparatus.

Moreover, since the waste-toner transport unit 4 and the drum cartridge 1 are installed as respectively separated parts, it is possible to further miniaturize the drum cartridge, thereby reducing the packing cast as well as the transportation cost.

Furthermore, the shutters are designed to open the inlet sections that are respectively provided in the waste-toner transport unit 4 and the waste-toner collecting box *3b* upon attaching the cartridges to the machine main body, as well as to shut the inlet sections upon removing the waste-toner transport unit 4 from the drum cartridge 1. This arrangement reduces the possibility of accidental spill of toner inside the apparatus that might occur upon setting the waste-toner transport unit 4, upon making it pivot, or on other occasions. Since the accidental spill of toner is prevented merely by providing this simple structure, it becomes possible to miniaturize the entire machine and to reduce the cost of production.

Moreover, the locking lever 11 that is fixed to the waste-toner transport unit 4 does not engage the stop-hole portion 12 that is provided in the waste-toner collecting box *3b* unless the drum cartridge 1 and the developing cartridge 2 are placed at the predetermined stations. This arrangement makes it possible to prevent misoperations such as caused by starting the image forming apparatus without attaching the cartridges properly, thereby improving the operability of the apparatus.

[EMBODIMENT 2]

Referring to FIGS. 1 through 12, the following description will discuss another embodiment of the present invention. Here, for convenience of explanation, those means that have the same functions and that are described in the aforementioned embodiment are indicated by the same reference numerals and the description thereof is omitted.

In this embodiment, in addition to the removably attaching mechanism of the cartridges in the first embodiment, a shifting mechanism is further installed as a shifting means for shifting the developing cartridge 2 in a departing direction or in an approaching direction with respect to the drum cartridge 1.

Figure 8:
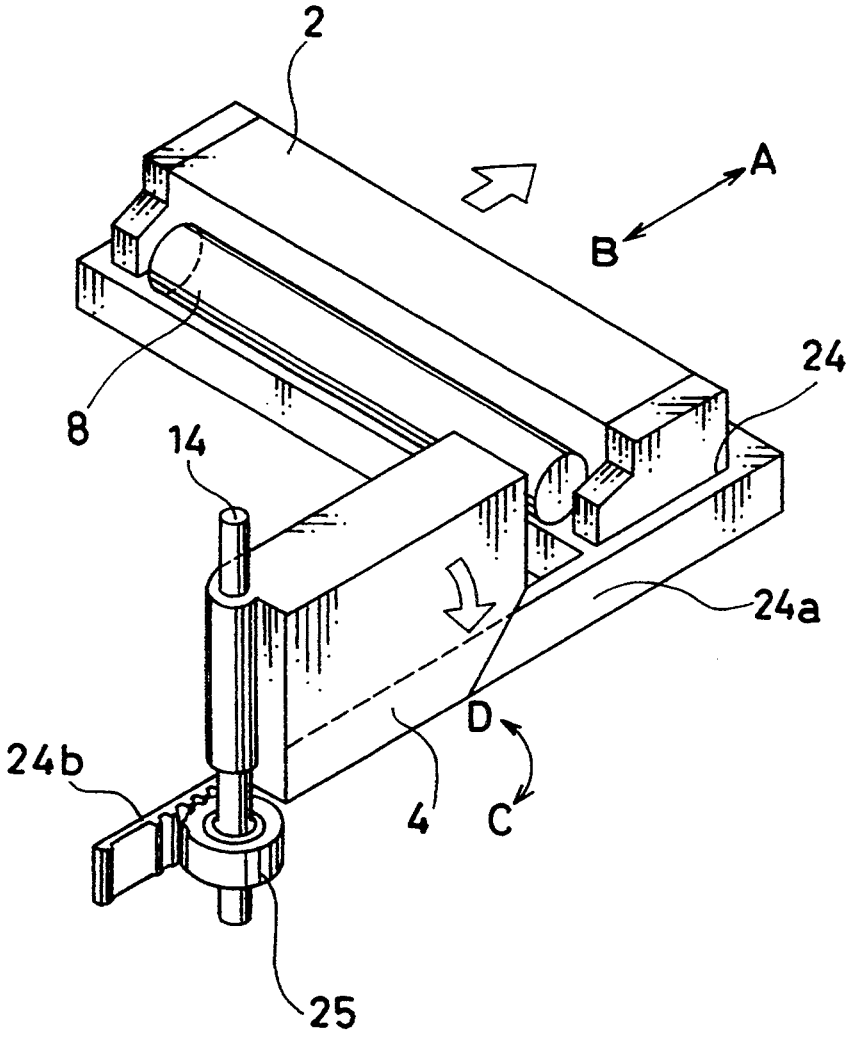
FIG. 8 is a perspective view showing a waste-toner transport unit and a developing cartridge in accordance with another embodiment of the present invention.

For example, as illustrated in FIG. 8, the shifting mechanism is constituted of a gear 25, which is fixed coaxially with the support shaft 14 of the waste-toner transport unit 4, and a mounting base 24 which is provided with a rack 24*a* to be engaged by the gear 25. The developing cartridge 2 is placed on the mounting base 24. The developing cartridge 2 is shifted to approach or depart to or from the drum cartridge 1 as an integral part of the mounting base 24 through the engagement between the gear 25 and the rack 24*a*.

Upon shifting the mounting base 24, the gear 25 and the rack 24*a* allow the waste-toner transport unit 4 to pivot in the same manner as the first embodiment 1. The direction in which the waste-toner transport unit 4 starts pivoting to depart from the drum cartridge 1 is the same as the direction in which the drum cartridge 1, the developing cartridge 2 and the toner cartridge 3 are drawn from the machine main body, which is the same as the first embodiment.

Figure 9:
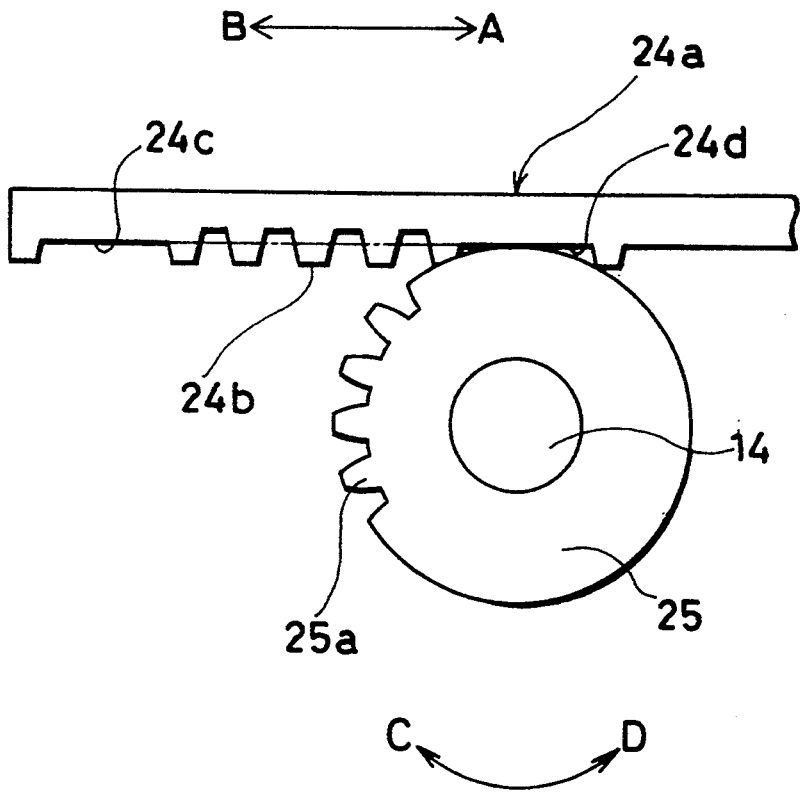
FIG. 9 is an explanatory drawing that shows a relationship between a gear for shifting the developing cartridge of FIG. 8 and a rack that is meshed with the gear when the cartridges are attached to the apparatus.

As illustrated in FIG. 9, a first teeth section 24*b* and a second teeth section 25*a* are respectively provided in the rack 24*a* and the gear 25 in a partial manner in accordance with the moving distance of the mounting base 24. In the rack 24*a*, the first teeth section 24*b* is sandwiched between a first teethless section 24*d* and a second teethless section 24*c*, both having no teeth thereon.

Figure 10:
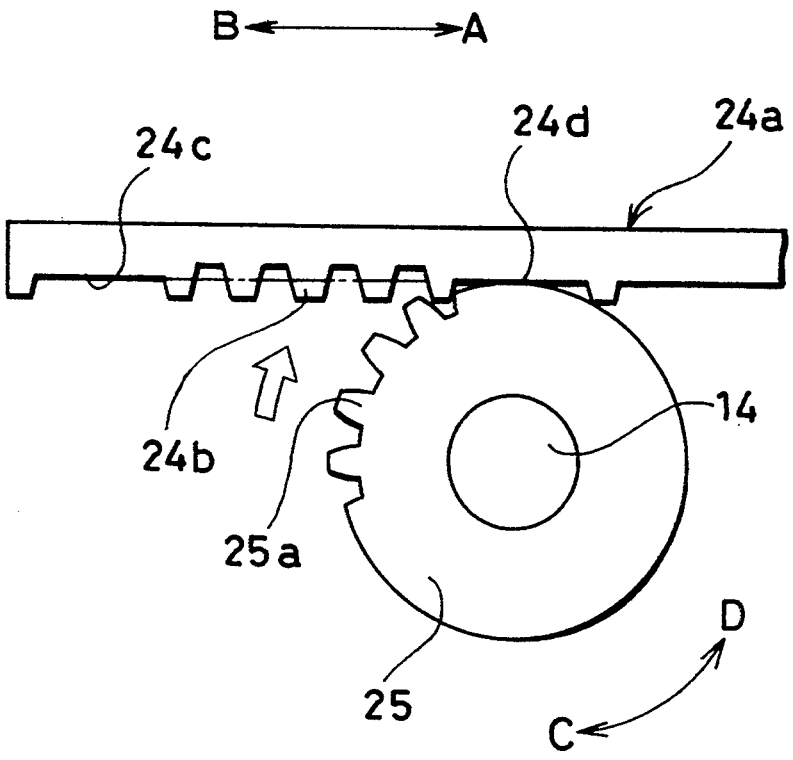
FIG. 10 is an explanatory drawing that shows a relationship between the gear for shifting the developing cartridge and the rack that is meshed with the gear when the waste-toner transport unit of FIG. 8 starts pivoting.
Figure 11:
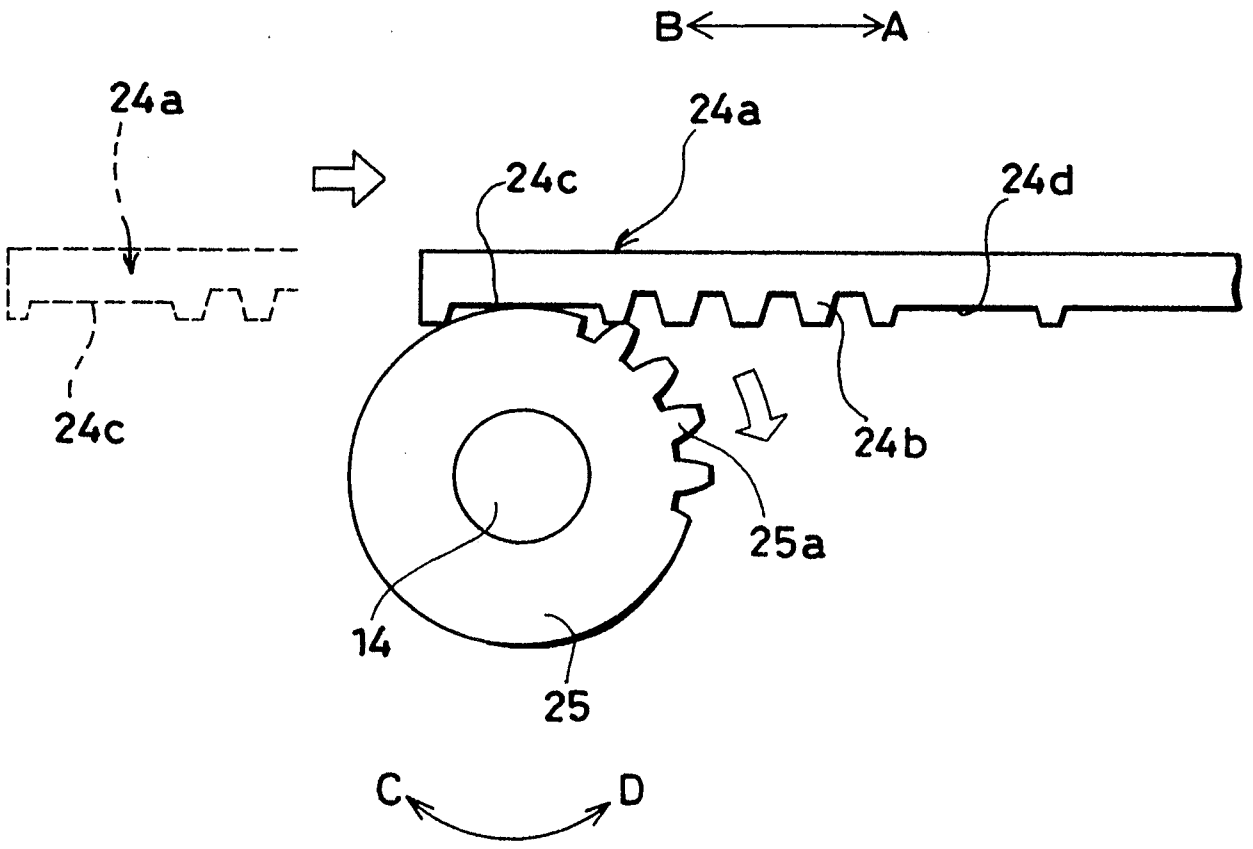
FIG. 11 is an explanatory drawing that shows a relationship between the gear for shifting the developing cartridge and the rack that is meshed with the gear when the waste-toner transport unit of FIG. 8 has finished pivoting.

Referring to FIGS. 1 through 3 as well as FIGS. 9 through 11, the following description will discuss an engaging mechanism that is made by the gear 25 and the rack 24*a*.

FIG. 9 shows a state of engagement between the gear 25 and the rack 24*a* in the case where the waste-toner transport unit 4 is placed at the predetermined station, that is, where the cartridges are attached to the predetermined stations inside the machine as illustrated in FIG. 1. Here, the teethless section of the gear 25 is in contact with the teethless section of the first teethless section 24*d* of the rack 24*a*. In this case, the rack 24*a* is not shifted.

FIG. 10 shows a state of engagement between the gear 25 and the rack 24*a* in the case where the waste-toner transport unit 4 is pivoting in the C-direction (that is, in the case shown in FIG. 2). Here, the teethless section of the gear 25 still remains in contact with the first teethless section 24*d* of the rack 24*a*; therefore, the rack 24*a* is not shifted. However, as the gear 25 pivots in the C-direction, the waste-toner transport unit 4 also pivots in the C-direction.

FIG. 11 shows a state of engagement between the gear 25 and the rack 24*a* in the case where the waste-toner transport unit 4 has further pivoted in the C-direction and the developing cartridge 2 is separated from the drum cartridge 1 (that is, in the case shown in FIG. 3). As the first teeth section 24*b* of the rack 24*a* is engaged by the second teeth section 25*a* of the gear 25, the rack 24*a* shifts in the A-direction, thereby allowing the mounting base 24 to also shift in the A-direction. Thereafter, by the time when the teethless section of the gear 25 and the second teethless section 24*c* of the rack 24*a* come into contact with each other, the waste-toner transport unit 4 has completed its pivotal movement in the C-direction, and is located at a position where it allows the drum cartridge 1 and other cartridges to be easily removed from the machine main body. At this time, the rack 24*a* has also completed its movement.

The drum cartridge 1 and the developing cartridge 2 are set in the machine main body with a predetermined force applied thereto so that the photoreceptor drum 5 and the magnet roller 8 are located close to each other. For this reason, upon removing any of the cartridges from the machine, an accidental contact might occur between the photoreceptor drum 5 and the magnet roller 8, and cause damages on the respective surfaces. Therefore, it is necessary to take out the cartridge after the developing cartridge 2 has been separated from the drum cartridge 1.

In the present embodiment, the shifting means is designed to shift the developing cartridge 2 so as to separate it from the drum cartridge 1 simultaneously with the pivotal movement of the waste-toner transport unit 4. With this arrangement, upon replacing cartridges such as the drum cartridge 1, it is possible to shift the developing cartridge 2 so as to be separated from the drum cartridge 1 easily as well as reliably by merely pivoting the waste-toner transport unit 4 from its predetermined station. Therefore, this arrangement reduces the possibility of accidental contacts between the developing cartridge 2 and the other parts such as the drum cartridge 1 and the resulting damages, which might occur upon manually pulling out the developing cartridge 2.

Further, since the pivotal movement of the waste-toner transport unit 4 and the shift of the developing cartridge 2 are simultaneously made upon replacing any of those cartridges, the maintenance, which was conventionally performed by specialized engineers, may be also performed by the user easily as well as safely. This makes it possible to further reduce the cost of maintenance.

Additionally, in the present embodiment, a gear having a teethless section and a rack having a teethless section are employed as the shifting means; yet, the present invention is not intended to be limited to this arrangement. Any mechanism may be adopted as long as it shifts simultaneously with the pivotal movement of the waste-toner transport unit, as described above.

[EMBODIMENT 3]

Referring to FIGS. 13 through 18, the following description will discuss still another embodiment of the present invention.

Figure 17:
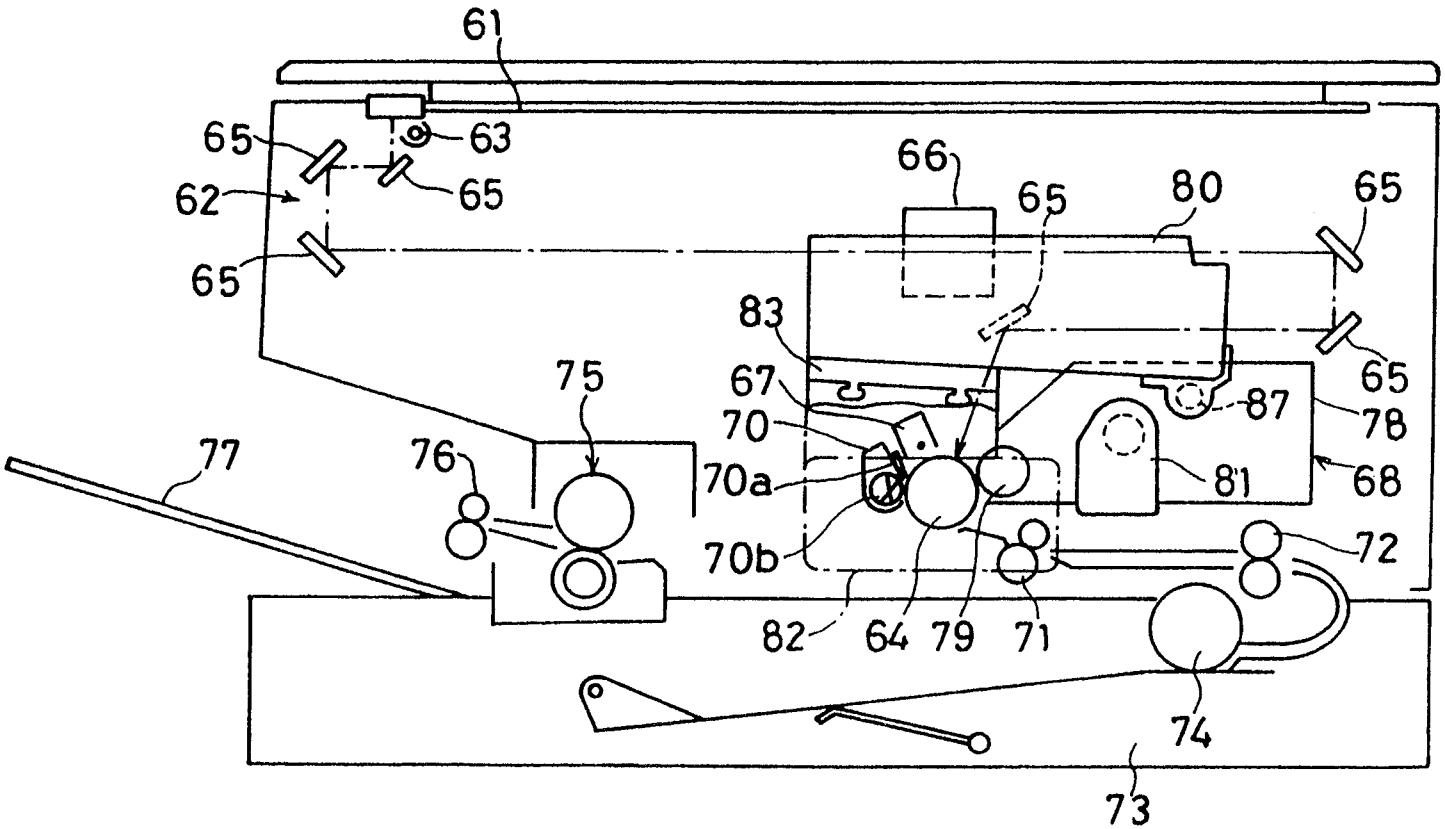
FIG. 17 is an explanatory drawing that schematically shows the entire structure of the copying machine to which the containers illustrated in FIG. 13 are attached.

As illustrated in FIG. 17, a copying machine, which is an electrophotographic apparatus to which the present invention is applied, is provided with a document platen 61 installed on the upper portion thereof and an exposure-use optical system 62 that is installed under the document platen 61. The optical system 62 is constituted of a light-source lamp 63 for scanning an original (not shown) placed on the document platen 61 while projecting light thereon, a plurality of reflective mirrors 65 for directing the light reflected from the original to the photoreceptor 64, and a lens unit 66 that is disposed in the light path of the reflected light.

On the periphery of the photoreceptor 64, are disposed a main charger 67 for charging the surface thereof to a predetermined electric potential, an erasing device for erasing spaces between images (not shown), a developing device 68 for developing an electrostatic latent image formed on the surface of the photoreceptor 64, a cleaning device 70 for collecting residual toner from the surface of the photoreceptor 64, and other devices. Further, on the paper-feeding side of the photoreceptor 64, are disposed a timing roller 71 for supplying sheets of paper with predetermined intervals, a transport roller 72, a paper-feed cassette 73 and a paper-feed roller 74. On the paper-discharge side of the photoreceptor 64, are disposed a fixing device 75 for fixing a toner image that has been transferred onto a sheet of paper, a discharge roller 76 for discharging the sheet of paper out of the machine, and a tray 77 for receiving the discharged sheet of paper.

Figure 13:
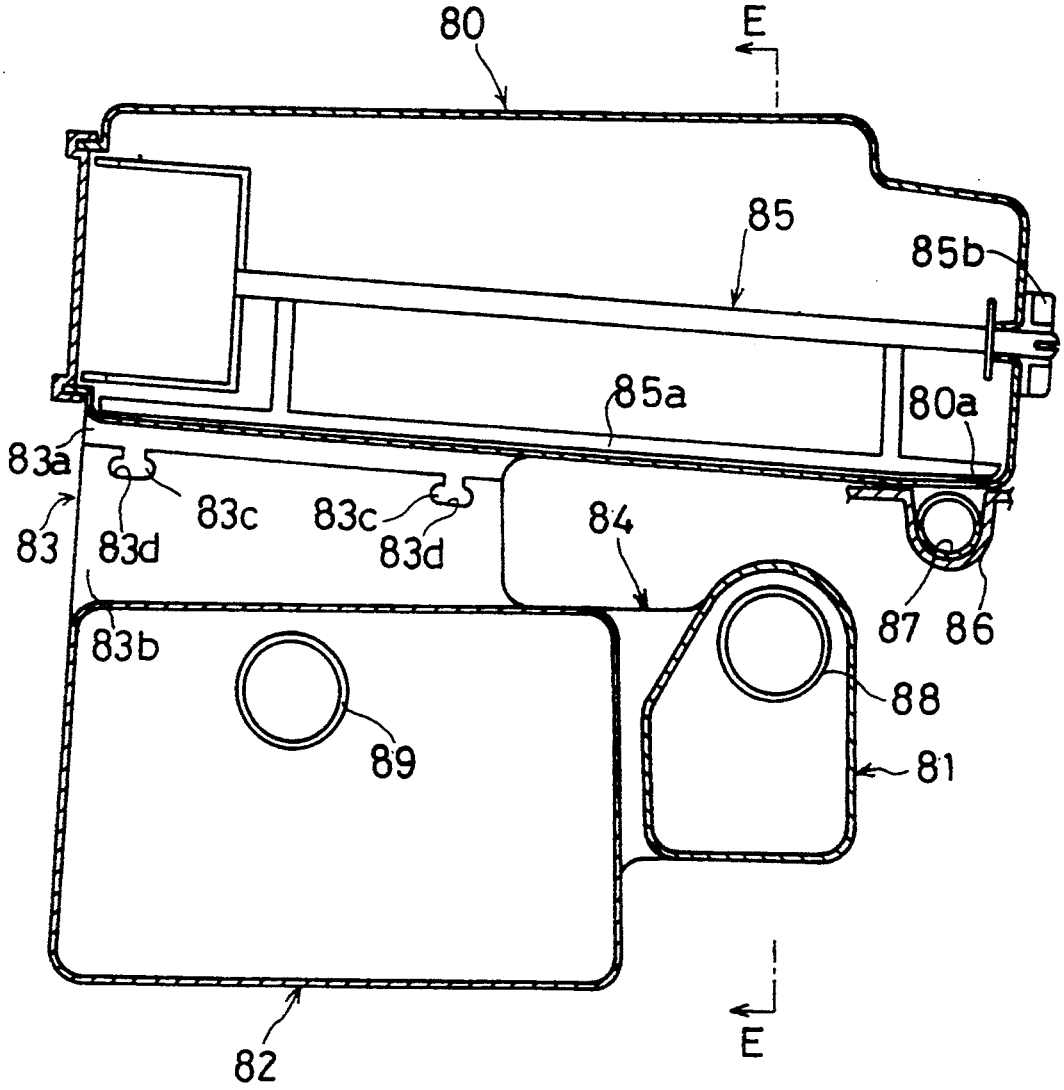
FIG. 13 is a vertical cross-sectional view showing a developer-supplying container, a waste-toner container and a waste-developer container in accordance with still another embodiment of the present invention.
Figure 14:
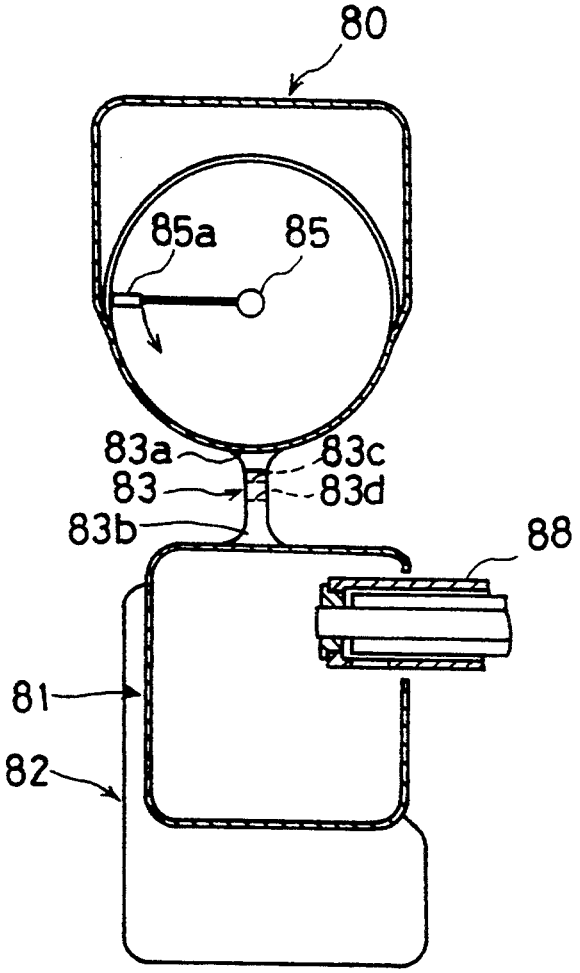
FIG. 14 is a vertical cross-sectional view that is taken along the line E—E of FIG. 13.

The present copying machine is also provided with a developer-supplying container 80, a waste-developer container 81 and a waste-toner container 82. These containers 80, 81 and 82 are integrally formed into one unit as is illustrated in FIG. 13, FIG. 14 that shows a vertical sectional view taken along the line E—E of FIG. 13, and FIG. 15. More specifically, the developer-supplying container 80 and the waste-toner container 82 are connected to each other through a connecting section 83 that has a plate shape, and the waste-toner container 82 and the waste-developer container 81 are connected to each other through a connecting section 84 that also has a plate shape. The containers 80, 81 and 82, thus integrally formed into one unit, can be taken out in the axial direction of the photoreceptor 64.

Further, in the present embodiment, the connecting section 83 is divided into a developer-supplying-container-side connecting section 83*a* and a waste-toner-container-side connecting section 83*b*. Raised fitting sections 83*c* are formed in the developer-supplying-container-side connecting section 83*a*, and recessed fitting sections 83*d* are formed on the waste-toner-container-side connecting section 83*b* so as to be fitted with the raised fitting sections 83*c*.

These raised fitting sections 83*c* and recessed fitting sections 83*d* are separably fitted with each other, for example, by shifting the developer-supplying container 80 in a right and left direction as illustrated in FIG. 14. Thus, the developer-supplying container 80 and the waste-toner container 82 are freely fitted with and separated from each other. In contrast, the connecting section 84 is not provided with such a separably fitting structure, and the waste-toner container 82 and the waste-developer container 81 are not allowed to separate from each other.

Figure 15:
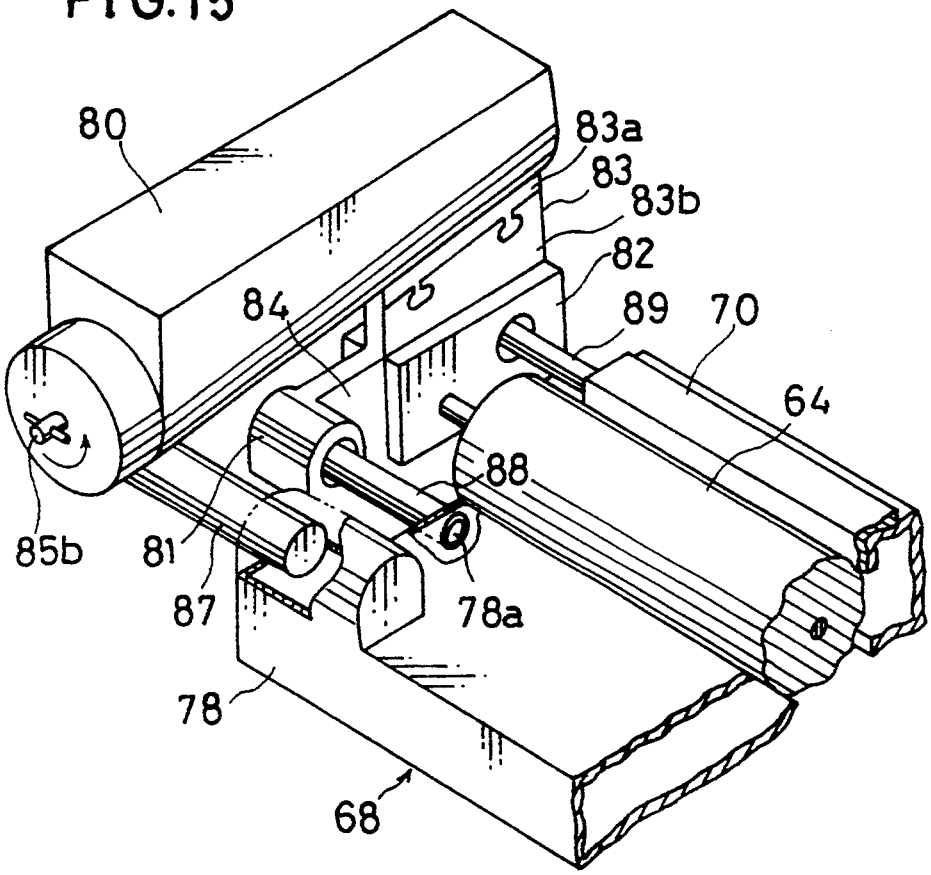
FIG. 15 is a perspective view showing the positional relationship among the containers illustrated in FIG. 13.
Figure 16:
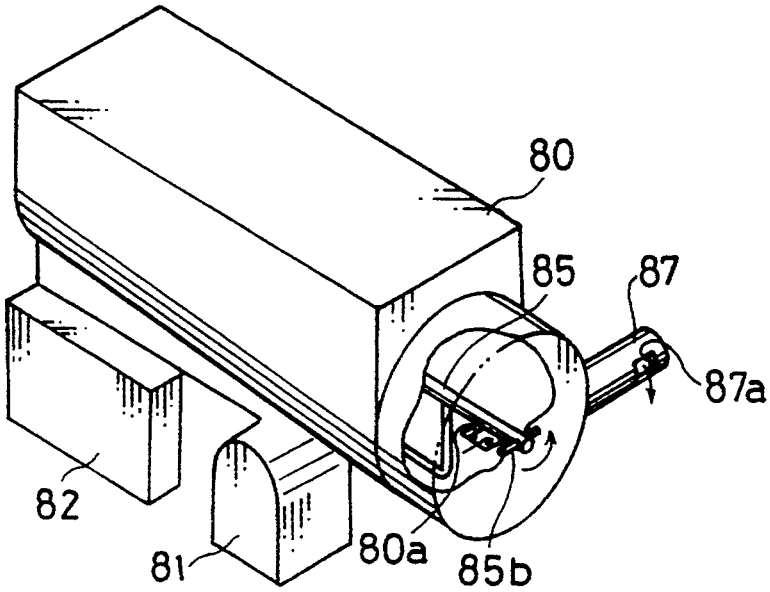
FIG. 16 is another perspective view showing the positional relationship among the containers illustrated in FIG. 13.

As illustrated in FIG. 15, the developer-supplying container 80 extends in a direction that is orthogonal to the axial direction of the photoreceptor 64. A stirrer 85 is provided inside the developer-supplying container 80, and the stirrer 85 stirs developer by rotating its stirring blade 85*a*. One end of the stirrer 85 extends outside the developer-supplying container 80, and it forms a connecting section 85*b* which is connected to a motor, not shown. As illustrated in FIG. 16, a developer-supplying inlet 80*a* is formed in the bottom wall of the developer-supplying container 80 in the proximity of the connecting section 85*b*. One end of a developer-supplying duct 87 is connected to the developer-supplying inlet 80*a* through a connecting-section support member 86 (see FIG. 18). As illustrated in FIG. 15, the developer-supplying duct 87 extends from the developer-supplying container 80 to the developing device 68, and the other end thereof is inserted into the developing device 68. As illustrated in FIG. 16, a developer drop outlet 87*a* is formed at the under surface of the other end of the developer-supplying duct 87.

Developer, which is a mixture made by mixing toner and carrier in a predetermined ratio, is stored inside the developer-supplying container 80. Therefore, the developer is sent from the developer-supplying inlet 80*a* into the developer-supplying duct 87 by the rotation of the stirrer 85, and then supplied into the developing device 68 through the developer drop outlet 87*a*.

The developing device 68 is provided with the developer tank 78, and a developing roller 79 (see FIG. 17), which is a magnet roller, is installed in the developer tank 78. The developer stored inside the developer tank 78 is made up of carrier and toner. Each particle of the carrier, which is made of a magnetic material, has a resin-coat layer on the surface thereof so as to restrict adhesion of toner thereto. When the carrier and the toner is stirred by a stirring roller, not shown, the toner is charged through friction. The developing roller 79 pulls up some carrier by magnetic force, and transports the carrier while forming magnetic brush. Some of the toner that adheres to the carrier through Coulomb's force is supplied to the photoreceptor 64, and is attracted by an electrostatic latent image formed on the photoreceptor 64. Thus, the electrostatic latent image on the photoreceptor 64 is developed.

As illustrated in FIG. 15, a developer-discharging aperture 78*a* is attached to the developing tank 78 at its side face facing the waste-developer container 81. This developer-discharging aperture 78*a* is designed to discharge excessive deteriorated developer that is overflown from the developer tank 78 by new developer supplied from the developer-supplying container 80. One end of a developer-discharging duct 88 is connected to the developer-discharging aperture 78*a*, and the other end thereof is inserted into the waste-developer container 81. Therefore, the developer that has been discharged through the developer-discharging aperture 78*a* is collected in the waste-developer container 81 through the developer-discharging duct 88.

Moreover, the cleaning device 70 is provided with a cleaning blade 70*a* and a transport screw 70*b*, as illustrated in FIG. 17. The cleaning blade 70*a* removes residual toner from the surface of the photoreceptor 64, and the transport screw 70*b* carries the toner thus removed therefrom toward the waste-toner container 82. As illustrated in FIG. 15, one end of a toner-discharging duct 89 is connected to the cleaning device 70, and the other end thereof is inserted into the waste-toner container 82. Therefore, the residual toner that has been removed from the surface of the photoreceptor 64 by the cleaning device 70 is collected and stored in the waste-toner container 82 through the toner-discharging duct 89.

Here, respective volumes of the above-mentioned containers 80, 81 and 82 are determined so that the waste-toner container 82 and the waste-developer container 81 are filled with the respective contents when the developer stored inside the developer-supplying container 80 has been used up. Therefore, the respective volumes of the containers 80, 81 and 82 are set in a decreasing order of the developer-supplying container 80, the waste-toner container 82, and the waste-developer 81. The reason for this is described as follows:

In a normal electrophotographic process, it is considered that the rate of toner transfer from a toner image formed on the photoreceptor 64 to a copy sheet is not less than 30%. Therefore, the rate of residual toner on the surface of the photoreceptor 64 is in the order of 70% at maximum, and this portion forms waste toner. In other words, 70% of supplied toner at maximum turns to be waste toner. As to the quantity of new carrier supply into the developer tank 78, the more the carrier supply the better the average deterioration of carrier in the developer tank 78 is improved. However, taking account of cost, it is considered that the optimum carrier supply is in the order of 20% of the quantity of toner supply. Therefore, the quantity of waste developer to be collected into the waste-toner developer container 81 is considered to be in the order of 20% of the quantity of toner supply. According to the above consideration, it is possible to determine the volumes of the three containers 80, 81 and 82.

In the present copying machine which has the above-mentioned arrangement, when the power switch (not shown) is turned on, the warm-up process is first carried out. After completion of this process, when the copy-start switch (not shown) is turned on, the light-source lamp 63 in the exposure-use optical system 62 scans an original placed on the document platen 61. At this time, the reflected light from the original is projected onto the photoreceptor 64 through the reflective mirrors 65 and the lens unit 66, thereby forming an electrostatic latent image on the surface of the photoreceptor 64, which has been charged to a predetermined electric potential by the main charger 67. Then, the electrostatic latent image is developed by toner that is supplied from the developing device 68. Thereafter, the toner image formed on the surface of the photoreceptor 64 is transferred onto a copy sheet that is supplied by the paper cassette 73, and is fused onto the copy sheet by the fixing device 75. Thus, a copied image corresponding to the original image is formed on the copy sheet. Then, the copy sheet is discharged onto the tray 77 by the discharge roller 76.

As the above-mentioned copying operations are repeated, toner contained in the developer, which is stored inside the developer tank 78 of the developing device 68, is gradually consumed, and the rate of toner with respect to carrier, that is, the toner density, is gradually lowered. The change in toner density is detected by a toner-density sensor, not shown, that is installed in the developer tank 78. When the toner-density sensor detects the fact that the toner density has been lowered to a lower limit value within an appropriate range for providing necessary toner density in developing, the stirrer 85 is rotated. As the stirrer 85 rotates, developer, which is stored inside the developer-supplying container 80, that is, toner and carrier, is supplied into the developer tank 78 through the developer-supplying inlet 80*a*, the developer-supplying duct 87 and the developer drop outlet 87*a*. When the toner-density sensor detects the fact that the toner density has been raised to an upper limit value within the appropriate range inside the developer tank 78, the stirrer 85 is stopped.

In contrast, the carrier contained in the developer inside the developer tank 78 is not consumed, but is gradually deteriorated due to agitation inside the developer tank 78 and contact against the photoreceptor 64. As the carrier deteriorates in this manner, it becomes difficult to impart a predetermined charge to the toner, thereby causing adverse effects on the copied image quality. Therefore, supply of developer is made by the developer-supplying container 80 so as to supply new toner contained therein, and new carrier is also supplied. When the new carrier is supplied thereto in this manner, the quantity of developer inside the developer tank 78 increases, and excessive developer overflows to be discharged from the developer-discharging aperture 78*a*. Thus, deteriorated carrier inside the developer tank 78 is gradually replaced with new carrier. The developer that has been discharged from the developer-discharging aperture 78*a* is collected into the waste-developer container 81 through the developer-discharging duct 88.

As described above, the developer is supplied to the developer tank 78 from the developer-supplying container 80, the deteriorated developer inside the developer tank 78 is collected into the waste-developer container 81, and the residual toner on the surface of the photoreceptor 64 is collected into the waste-toner container 82. Thereafter, when the developer inside the developer-supplying container 80 has been used up, the developer-supplying container 80, the waste-developer container 81 and the waste-toner container 82, all integrally formed into one unit, are taken out of the copying machine main body.

Next, since the connecting section 83 is provided with the fitting-in structure having the raised fitting sections 83*c* and the recessed fitting sections 83*d*, those containers 80, 81 and 82 are divided into two parts, that is, one part consisting of the developer-supplying container 80 and the other part consisting of the waste-developer container 81 and the waste-toner container 82, both integrally formed into one unit. Here, the waste-developer container 81 and the waste-toner container 82, provided as one unit, are disposed as waste. In contrast, the developer-supplying container 80 is filled with new developer. The developer-supplying container 80, filled with the new developer, is fitted into one unit with a new waste-developer container 81 and a new waste-toner container 82 through the fitting-in structure. In this state, those three containers 80, 81 and 82 are attached to the copying machine main body.

As described above, in the present copying machine, the developer-supplying container 80, the waste-developer container 81 and the waste-toner container 82 are integrally formed into one unit; therefore, when the developer-supplying container 80 is replaced due to lack of developer therein, it is inevitable to replace the waste-developer container 81 and the waste-toner container 82 at the same time. With this arrangement, the replacement of the three containers 80, 81 and 82 is carried out more easily in comparison with the case where the three containers 80, 81 and 82 are individually attached separately or only any two of the containers are integrally formed into one unit.

Further, this arrangement makes it possible to reduce members such as used for individually supporting the containers 80, 81 and 82 and for guiding those containers upon replacement, thereby reducing the production cost of copying machines.

Moreover, in this arrangement wherein the three containers 80, 81 and 82 are replaced at the same time as described above, the volumes of the waste-developer container 81 and the waste-toner container 82 are determined in relation to the volume of the developer-supplying container 80. Therefore, it is not necessary to make the waste-developer container 81 and the waste-developer container 82 bulky for the purpose of storing large quantities of waste developer and waste toner. This makes it possible to miniaturize the waste-developer container 81 and the waste-toner container 82, thereby making the copying machine compact. Furthermore, it is not necessary to install a means for detecting the filled-up state of toner, for example, in the waste-toner container 82; this results in a low cost in structure.

Moreover, as to the respective volumes of the developer-supplying container 80, the waste-toner container 82 and the waste-developer container 81, setting may be made so that the term, by which all the developer inside the developer-supplying container 80 is used up, virtually coincides with the terms by which the waste-toner container 82 and the waste-developer container 81 are filled up with the respective contents. Therefore, the volumes of the waste-developer container 81 and the waste-toner container 82 are set to minimum values in relation to the volume of the developer-supplying container 80. Thus, it becomes possible to make the space occupied by the three containers 80, 81 and 82 in the copying machine as small as possible, thereby further miniaturizing the copying machine.

Furthermore, the containers 80, 81 and 82, which are integrally combined into one unit, are divided into separated parts, and the developer-supplying container 80 is reused after filling it with developer; this achieves the effective use of resources.

In addition, since it is possible to provide a metal mold for forming the developer-supplying container 80 separately from a metal mold for integrally forming the waste-developer container 81 and the waste-toner container 82 into one unit, the structures of the metal molds can be simplified. This makes it possible to reduce the cost of metal molds. Moreover, in comparison with the case where the three containers 80, 81 and 82 are integrally formed into one unit, the above arrangement increases the degree of freedom in design, for example, upon designing metal molds for use in injection molding; therefore, the cost of materials can be reduced by minimizing the amount of materials that are used for manufacturing the containers 80, 81 and 82.

Figure 18:
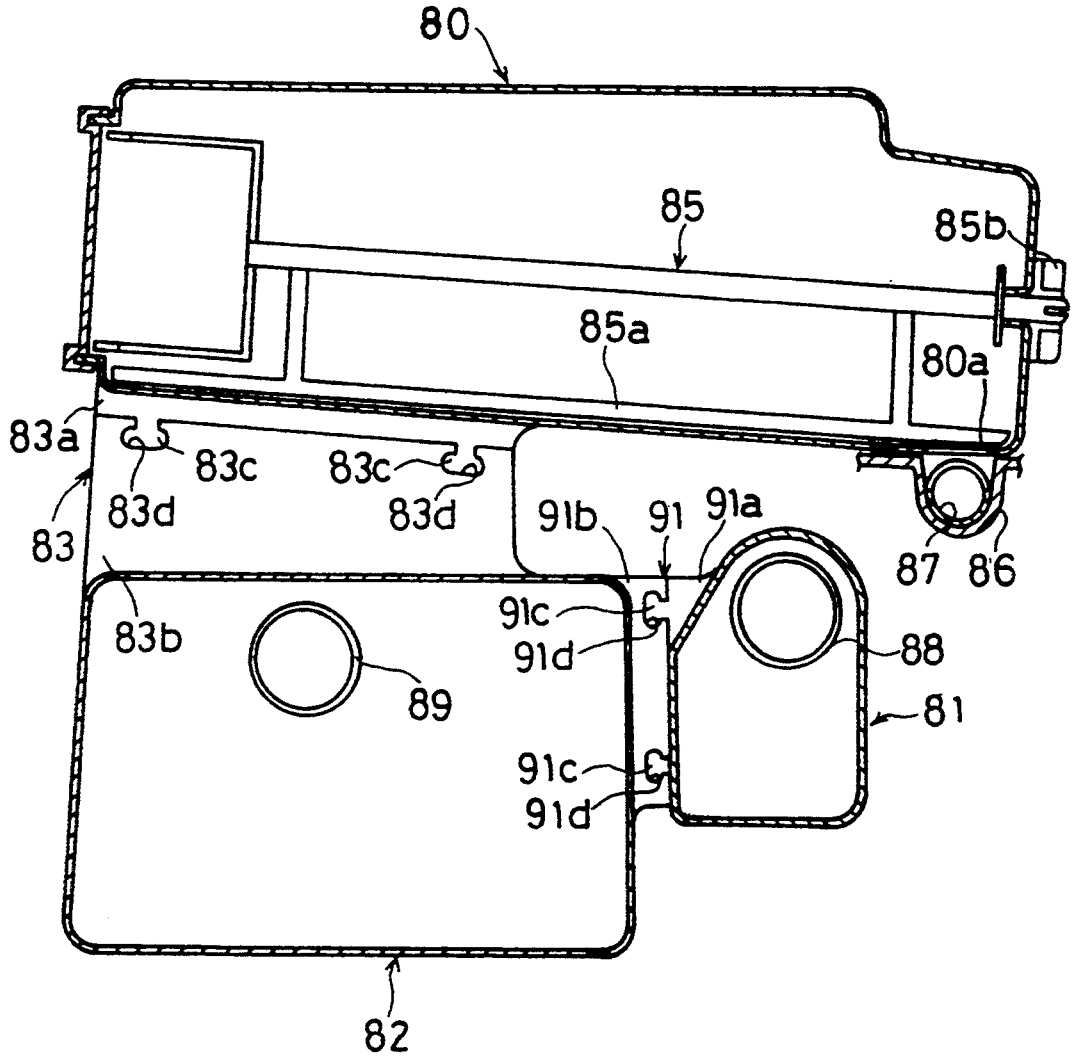
FIG. 18 is a vertical cross-sectional view showing a fit-in structure provided between the developer-supplying container and the waste-toner container as well as a fit-in structure provided between the waste-toner container and the waste-developer container.

Additionally, in the above embodiment, the developer-supplying container 80 is removably fitted with the waste-developer container 81 and the waste-toner container 82, both integrally formed into one unit, by the fitting-in structure of the connecting section 83. However, as illustrated in FIG. 18, the waste-developer container 81 may be removably fitted with the waste-toner container 82. In order to achieve this arrangement, in FIG. 18, the connecting section 91 between the waste-developer container 81 and the waste-toner container 82 is divided into a waste-developer-container-side connecting section 91*a* and a waste-toner-container-side connecting section 91*b*. Further, raised fitting sections 91*c* are formed on the waste-developer-container-side connecting section 91*a*, and recessed fitting sections 91*d* are formed in the waste-toner-container-side connecting section 91*b*, which are fitted with the raised fitting sections 91*c*.

This arrangement makes it possible to combine the developer-supplying container 80, the waste-developer container 81 and the waste-toner container 82 integrally into one unit, as well as to divide the unit into the individual containers 80, 81 and 82. Therefore, when the three containers are taken out of the copying machine main body due to lack of developer in the developer-supplying container 80, the developer-supplying container 80 is reused after filling it up with developer, in the same manner as described earlier. Here, the toner and the developer containing carrier and toner need to be differently treated as individual industrial wastes. Therefore, this arrangement satisfies the different treatments by dividing the waste-developer container 81 and the waste-toner container 82 and disposing them as different wastes.

[EMBODIMENT 4]

Figure 19:
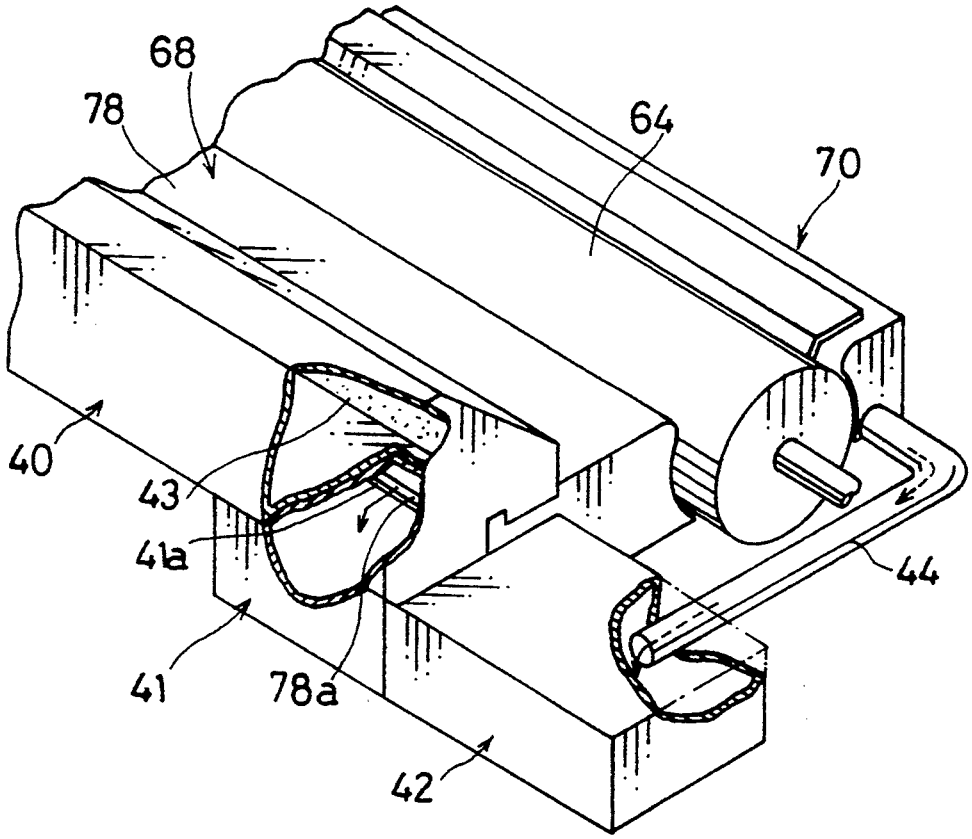
FIG. 19 is a perspective view showing the positional relationship among a developer-supplying container, a waste-toner container and a waste-developer container in accordance with still another embodiment of the present invention.

Referring to FIG. 19, the following description will discuss still another embodiment of the present invention. Here, for convenience of explanation, those members that have the same functions and that are illustrated in the drawings of the third embodiment are indicated by the same reference numerals and the description thereof is omitted.

In the copying machine of the present embodiment, a developer-supplying container 40, a waste-developer container 41, and a waste-toner container 42, which are illustrated in FIG. 19, are provided in place of the aforementioned developer-supplying container 80, waste-developer container 81 and waste-toner container 82. The developer-supplying container 40 stores developer consisting of toner and carrier. The developer-supplying container 40 is attached to the developer tank 78 along its upper edge on the side opposite to the photoreceptor 64, in parallel with the developer tank 78. One portion of the bottom surface of the developer-supplying container 40 is overlapped with the developer tank 78. In this overlapped portion, the developer-supplying inlet, not shown, of the developer-supplying container 40 and the developer inlet, not shown, of the developer tank 78 are connected to each other. Thus, developer, which is stored in the developer-supplying container 40, is supplied to the developer tank 78 through the rotation of a sponge roller 43 that is installed at the developer-supplying inlet.

The waste-developer container 41 is located right under one end of the developer-supplying container 40 with its one side contacting the rear wall of the developer tank 78. In this contact portion between the two containers, a developer-discharging aperture 78*a* is provided to the developer tank 78, and a developer collecting inlet 41*a*, which is mutually connected to the developer-discharging aperture 78*a*, is provided to the waste-developer container 41.

The waste-toner container 42 and the waste-developer container 41 are disposed side by side in parallel with the axial direction of the photoreceptor 64. Waste toner, which is collected by the cleaning device 70, is transported into the waste-toner container 42 through a toner-discharging duct 44.

The developer-supplying container 40, the waste-developer container 41 and the waste-toner container 42 are integrally combined into one unit. As to the setting of the volumes of these containers, it is made in the same manner as the aforementioned embodiment 3.

In this arrangement, the containers 40, 41 and 42 are concentrated on predetermined stations, and brought into a connected state with their faces connected to one another; therefore, further compactness is achieved. Additionally, in order to removably fit the containers 40, 41 and 42 with one another, those containers 40, 41 and 42 are independently provided with their predetermined faces contacting one another, and fit-in structures of, for example, a sliding type, may be provided between the contact faces.

Moreover, in the above-mentioned embodiments, the developer-supplying containers 80 and 40 are used as containers for supplying developer consisting of toner and carrier; yet, instead of this usage, the developer-supplying containers 80 and 40 may store, for example, only toner or only carrier. Here, in the case where the developer-supplying containers 80 and 40 store only toner, the relationship between the volumes of the three containers 80, 81 and 82 as well as 40, 41 and 42 is determined in the same manner as described earlier. In contrast, in the case where the developer-supplying containers 80 and 40 store only carrier, the relationship is determined in a different manner.

[EMBODIMENT 5]

Referring to FIGS. 20 through FIGS. 39(*a*) and 39(*b*), the following description will discuss still another embodiment of the present invention.

Figure 25:
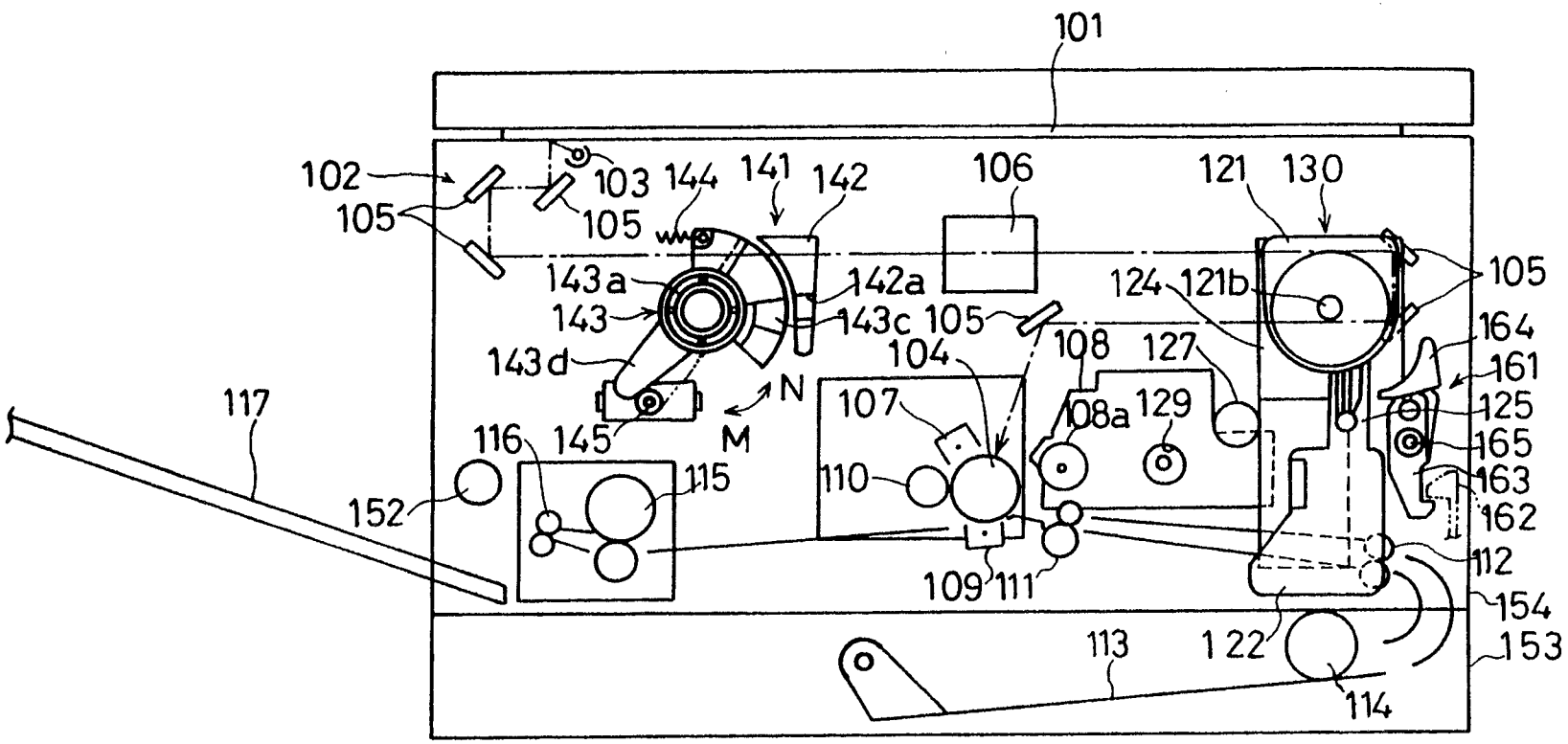
FIG. 25 is a schematic front view showing the copying machine in the state where the container unit is positioned at the first station.

In a copying machine, which is exemplified as an electrophotographic apparatus to which the present invention is applied, color copying is available by exchanging developing units 130, which will be described later. The color copying is performed by using a plurality of mono-colors. As illustrated in FIG. 25, the copying machine is provided with a document platen 101 installed on the upper portion thereof and an exposure-use optical system 102 that is installed under the document platen 101. The optical system 102 is constituted of a light-source lamp 103 for scanning an original (not shown) placed on the document platen 101 while projecting light thereon, a plurality of reflective mirrors 105 for directing the light reflected from the original to the photoreceptor drum 104, and a lens unit 106 that is disposed in the light path of the reflected light.

On the periphery of the photoreceptor drum 104, are disposed a main charger 107 for charging the surface thereof to a predetermined electric potential, an erasing device for erasing spaces between images (not shown), a developer tank 108 for developing an electrostatic latent image formed on the surface of the photoreceptor drum 104, a transferring charger 109 for transferring a toner image, which has been formed on the photoreceptor drum 104 through the developing process, onto a copy sheet, a cleaning device 110 for collecting residual toner from the surface of the photoreceptor drum 104, and other devices. Further, on the paper-feeding side of the photoreceptor drum 104, are disposed a timing roller 111 for supplying sheets of paper with predetermined intervals, a transport roller 112, a paper-feed cassette 113 and a paper-feed roller 114. On the paper-discharge side of the photoreceptor drum 104, are disposed a fixing device 115 for fixing a toner image that has been transferred onto a sheet of paper, a discharge roller 116 for discharging the sheet of paper out of the machine, and a tray 117 for receiving the discharged sheet of paper.

Figure 20:
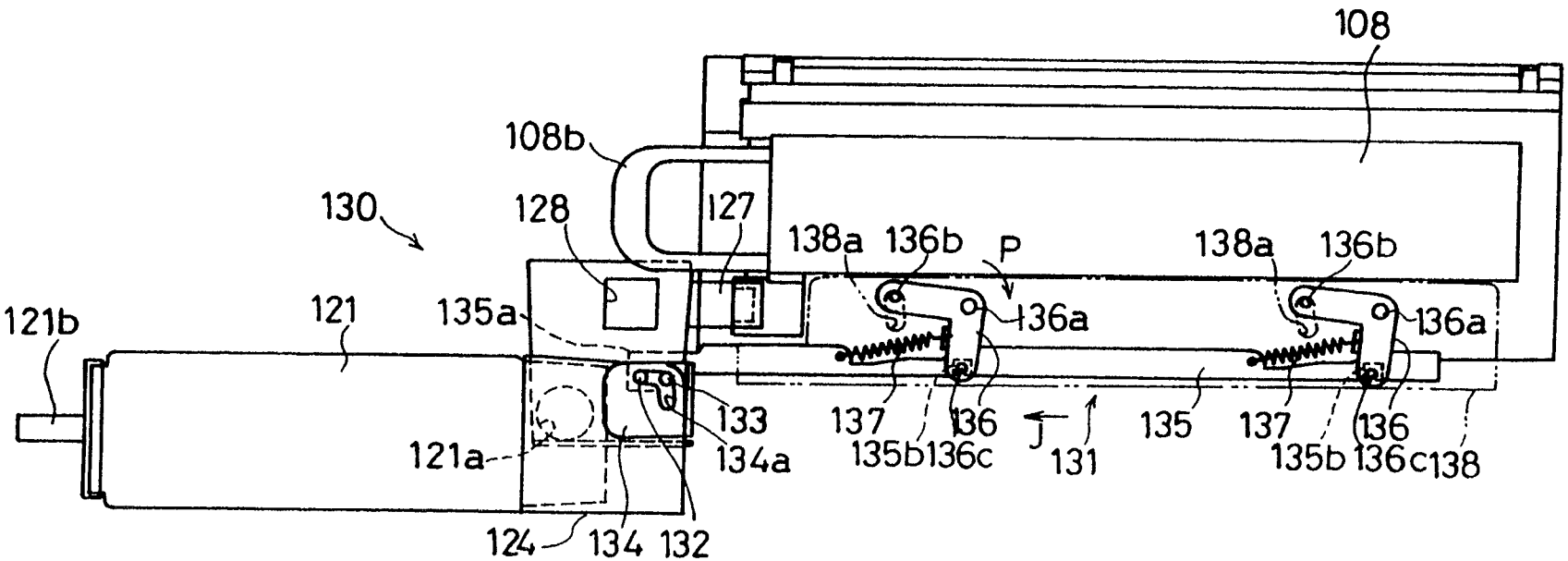
FIG. 20, which shows still another embodiment of the present invention, is a plan view showing a state where a container unit, which consists of a developer-supplying container, a waste-toner container and a waste-developer container, is positioned at a first station with respect to the developer tank.

A developing roller 108*a*, which is a magnet roller, is installed inside the developer tank 108. The developer tank 108 stores developer consisting of carrier and toner, and the developing roller 108*a* supplies some of the toner onto the photoreceptor drum 104 while forming magnetic brush thereon. Further, as illustrated in FIG. 20, the developer tank 108 is provided with a handle 108*b*, which is used upon attaching and removing the developer tank 108 to and from the copying machine main body.

Figure 27:
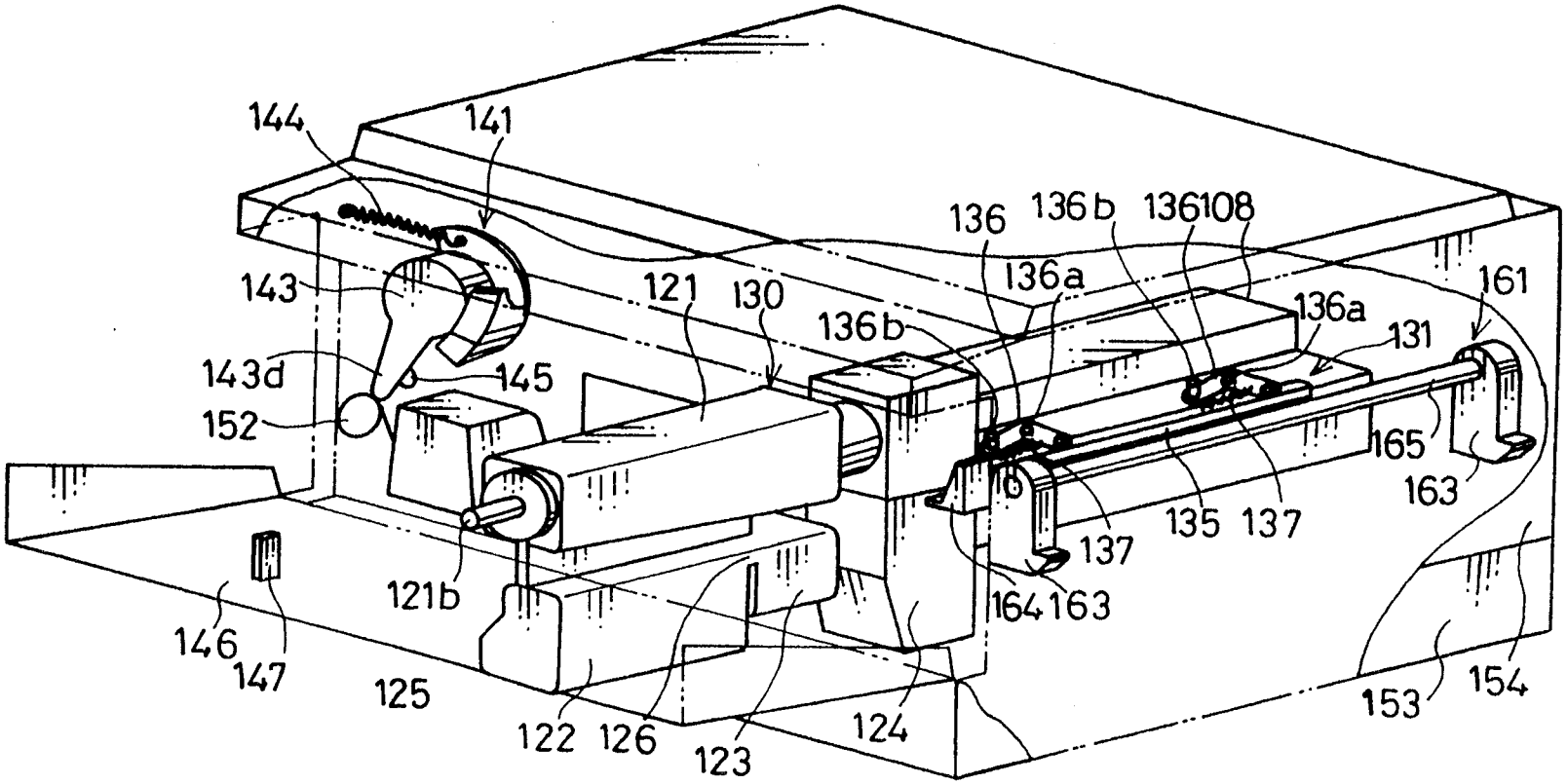
FIG. 27 is a schematic perspective view showing the copying machine in the state as illustrated in FIG. 25.
Figure 28:
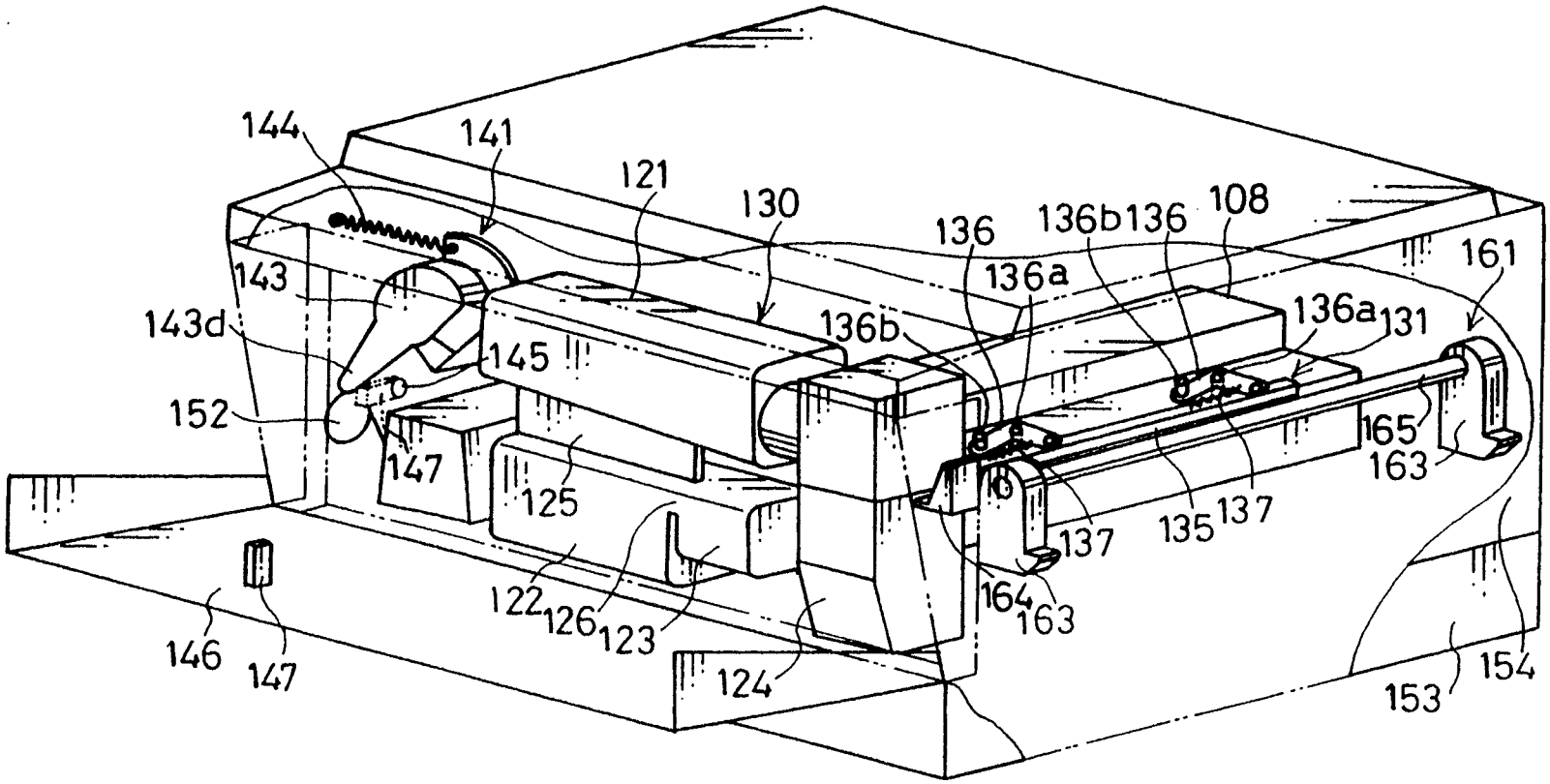
FIG. 28 is a schematic perspective view showing the copying machine in the state as illustrated in FIG. 26.
Figure 29:
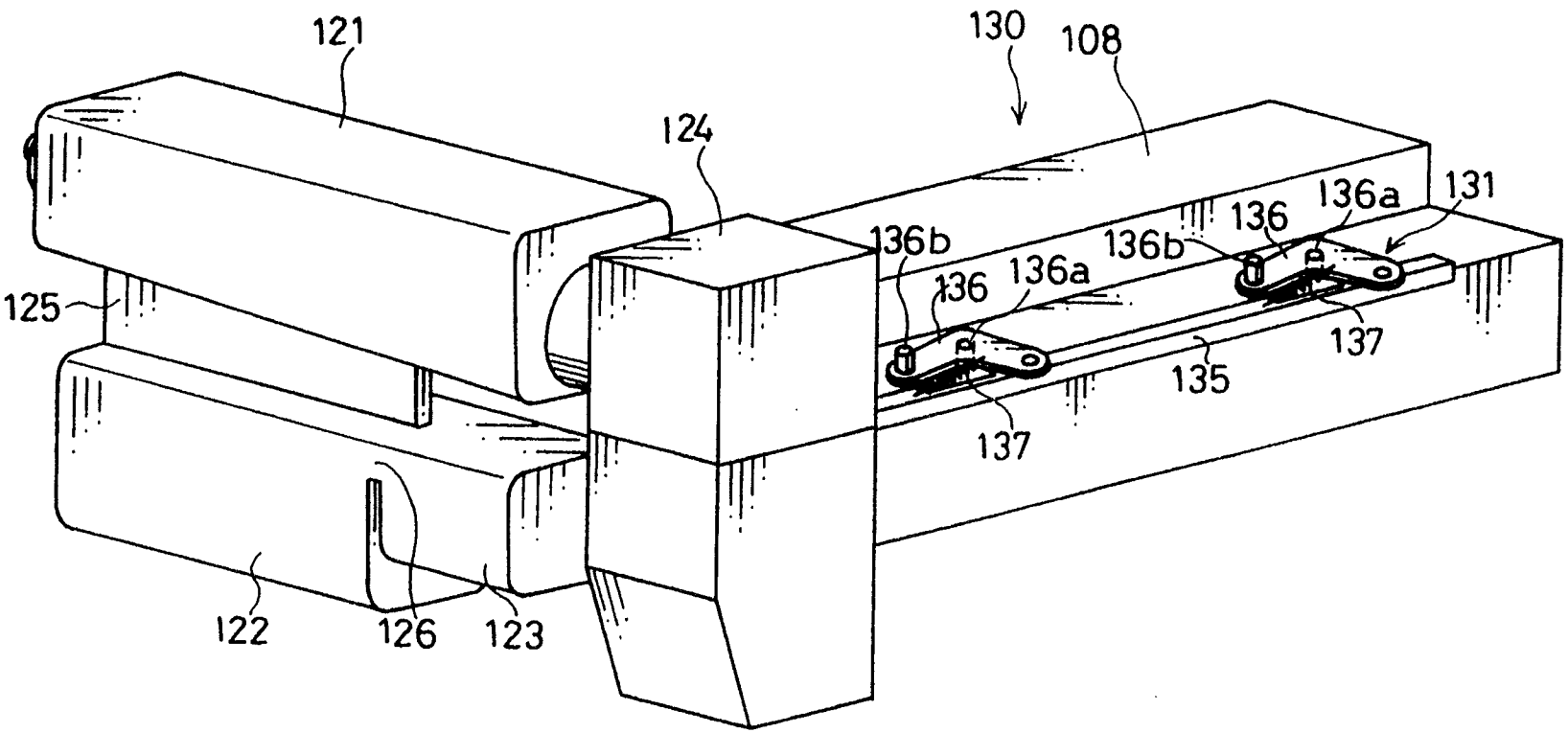
FIG. 29 is a perspective view showing the developer unit in the state as illustrated in FIG. 21.

As also illustrated in FIGS. 27 through 29, a developer-supplying container 121, a waste-toner container 122 for storing toner that has been collected by the cleaning device 110, and a waste-developer container 123 are integrally attached to the developer tank 108 as one unit. More specifically, the developer-supplying container 121 is integrally combined with the developer tank 108 through a rotative mechanism 124; the waste-toner container 122 is integrally combined with the developer-supplying container 121 through a connecting section 125; and the waste-developer container 123 is integrally combined with the waste-toner container 122 through a connecting section 126.

Here, the developer-supplying container 121, the waste-toner container 122 and the waste-developer container 123, which are integrally combined into one unit (hereinafter, referred to as container unit), is separable from the developer tank 108 by the rotative mechanism 124. Further, the container unit is supported by the rotative mechanism 124 so as to rotate horizontally. More specifically, the container unit is allowed to freely pivot between a first station where, as illustrated in FIG. 27, it is linearly aligned in parallel with the developer tank 108 that has been inserted into the copying machine main body in the axial direction of the photoreceptor drum 104 and a second station where, as illustrated in FIG. 28, it has been rotated by virtual 90 degrees from the first station toward the copying machine main body. Here, the second station is a position at which the container unit is attached to the copying machine main body.

A developing unit 130, which is made by integrally combining the developer tank 108, the developer-supplying container 121, the waste-toner container 122 and the waste-developer container 123 into one unit, is removably attached to the copying machine main body when the container unit is located at the first station. This removably attaching movement is guided by an attaching guide section, not shown.

Figure 21:
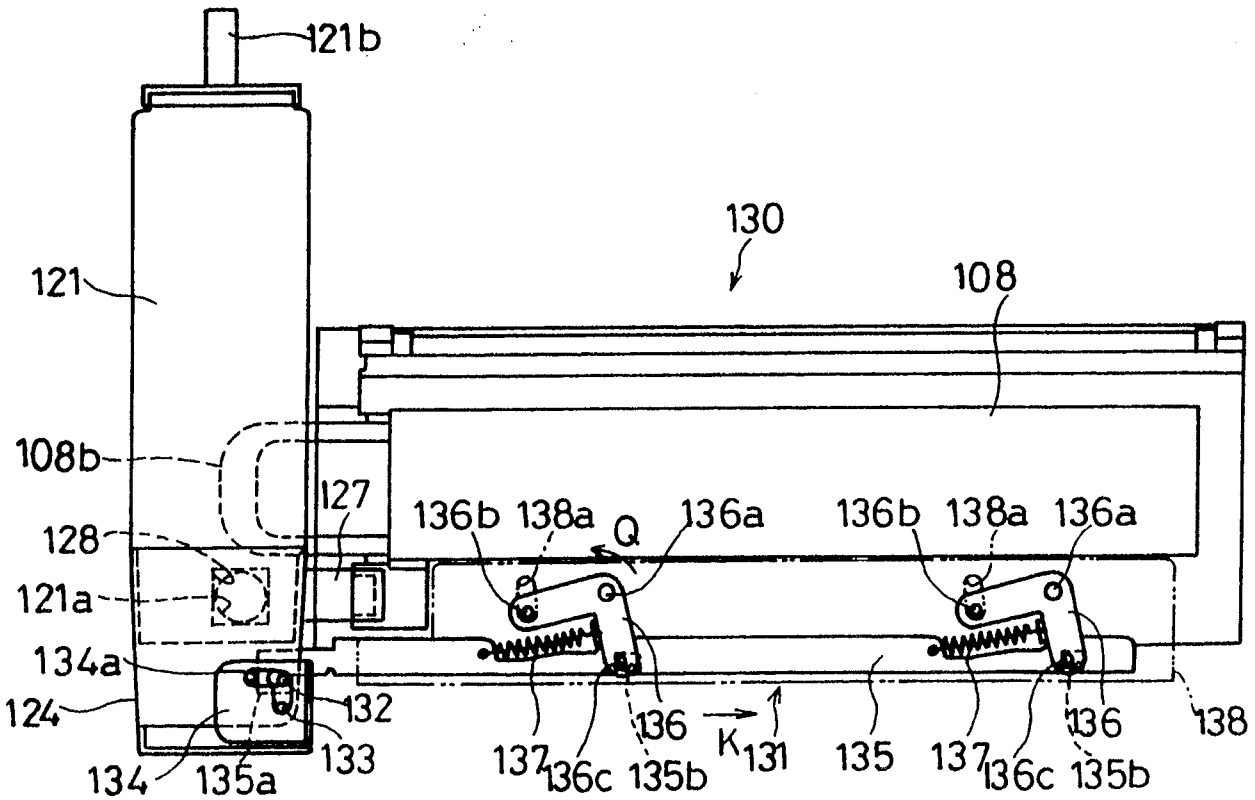
FIG. 21 is a plan view showing a state where the container unit is positioned at a second station.

The developer-supplying container 121 stores developer made of a mixture consisting of toner and carrier that are mixed at a predetermined ratio. A developer-supplying inlet 121*a* is provided to the developer-supplying container 121 at its end in the proximity of the rotative mechanism 124, as illustrated in the plan view of FIG. 20. A developer-supplying duct 127 is connected to the developer tank 108, and the other end of the developer-supplying duct 127 is connected to the developer-feeding inlet 128, formed in the rotative mechanism 124. The developer-supplying inlet 121*a* is closed when the developer-supplying container 121 is located at the first station as shown in FIG. 20, while it is connected to the developer-feeding inlet 128 when the developer-supplying container 121 is located at the second station as shown in FIG. 21. With this arrangement, developer is supplied to the developer tank 108 from the developer-supplying container 121.

Figure 26:
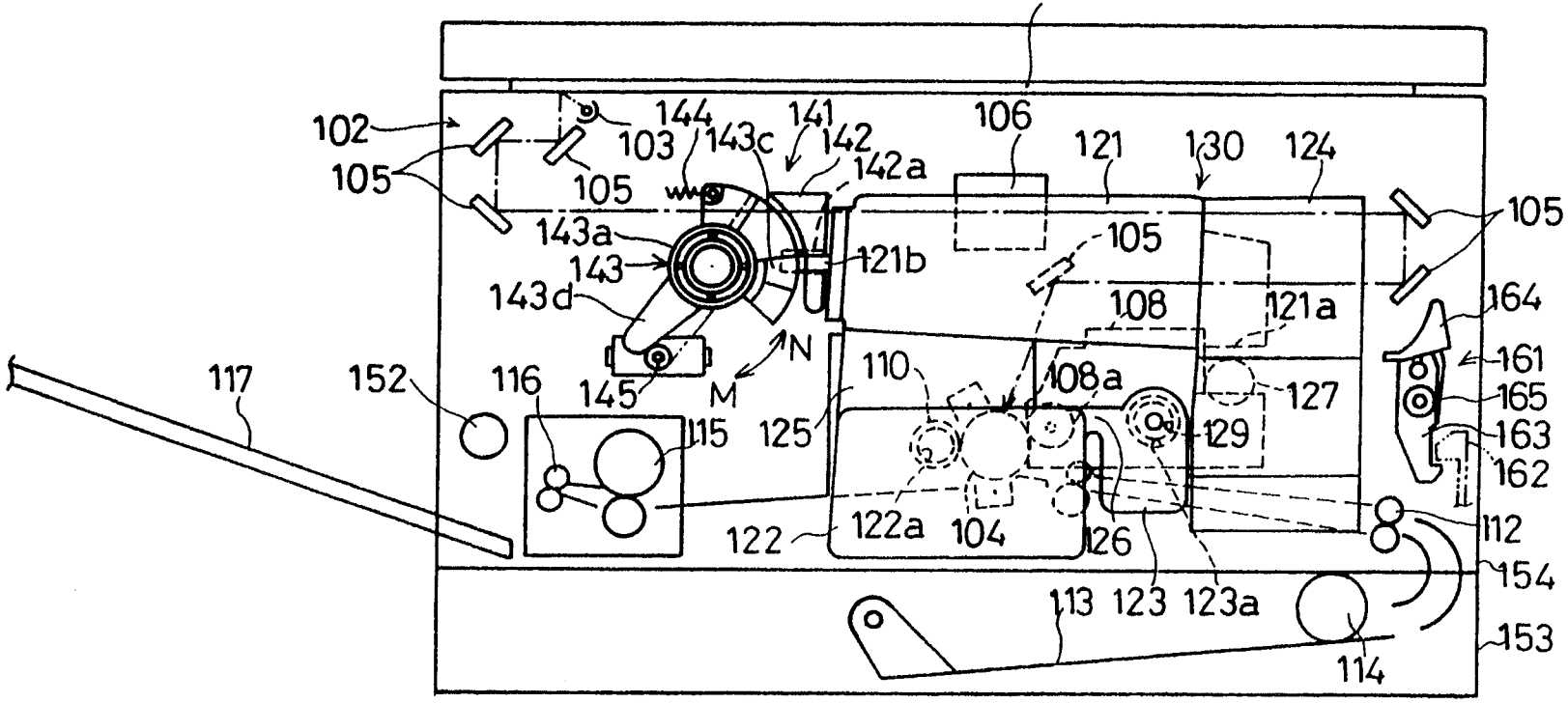
FIG. 26 is a schematic front view showing the copying machine in the state where the container unit is positioned at the second station.

A waste-toner uptake opening 122*a*, shown in FIG. 26, is provided to the waste-toner container 122. The waste-toner uptake opening 122*a* is fitted with the cleaning device 110 when the waste-toner container 122 is located at the second station, as is also shown in FIG. 28. Thus, waste toner, which has been collected by the cleaning device 110, is stored in the waste-toner container 122.

Moreover, a waste-developer uptake opening 123*a*, shown in FIG. 26, is provided to the waste-developer container 123. The waste-developer uptake opening 123*a* is fitted with a developer-discharging duct 129 that is connected to the developer tank 108 when the waste-developer container 123 is located at the second station. Excessive developer, which has overflown from the developer tank 108, is discharged through the developer-discharging duct 129. Thus, the developer discharged from the developer tank 108 is stored in the waste-developer container 123.

When the developer tank 108 is attached to the copying machine main body face to face with the photoreceptor drum 104, it is pressed toward the photoreceptor drum 104 side so that the developing roller 108*a* always maintains a predetermined positional relationship with respect to the photoreceptor drum 104. This pressing action is performed by a pressing device 131, shown in FIGS. 20, 21 and 22, which is provided as a pressing means.

Figure 24:
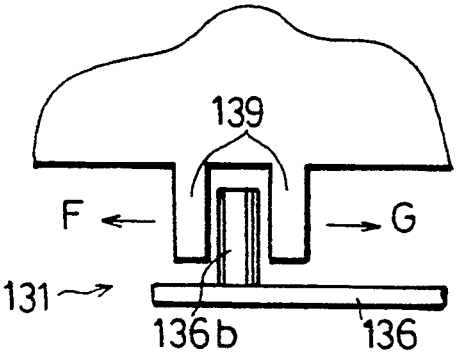
FIG. 24 is an explanatory drawing that shows the shifting direction of the developer tank in which the pressing device, illustrated in FIGS. 22 and 23, shifts the developer tank.

As illustrated in FIGS. 20 and 21, the pressing device 131 is consisted of: two shafts 132 and 133; a shaft-guiding plate 134; a direct-acting arm 135 that functions as a shifting member; two pressing plates 136 that function as pressing members; tension springs 137 that function as elastic members provided between the pressing plates 136 and the direct-acting arm 135; and a rotation-restricting plate 138 for pressing plates; as well as a guide rail 139 shown in FIG. 24.

The shafts 132 and 133, fixed to the rotative mechanism 124, are aligned side by side in the lengthwise direction of the developer-supplying container 121 so that they are rotated with the developer-supplying container 121. The shaft-guiding plate 134, also provided in the rotative mechanism 124, is integrally fixed to the developer tank 108, and is provided with a biaxial guiding hole 134*a* having an L-shape, which guides the shafts 132 and 133. The direct-acting arm 135 is allowed to slide in the lengthwise direction of the developer tank 108, that is, in the axial direction of the photoreceptor drum 104. A hook section 135*a*, which is formed at one end of the direct-acting arm 135, is engaged with the shaft 132.

Figure 22:
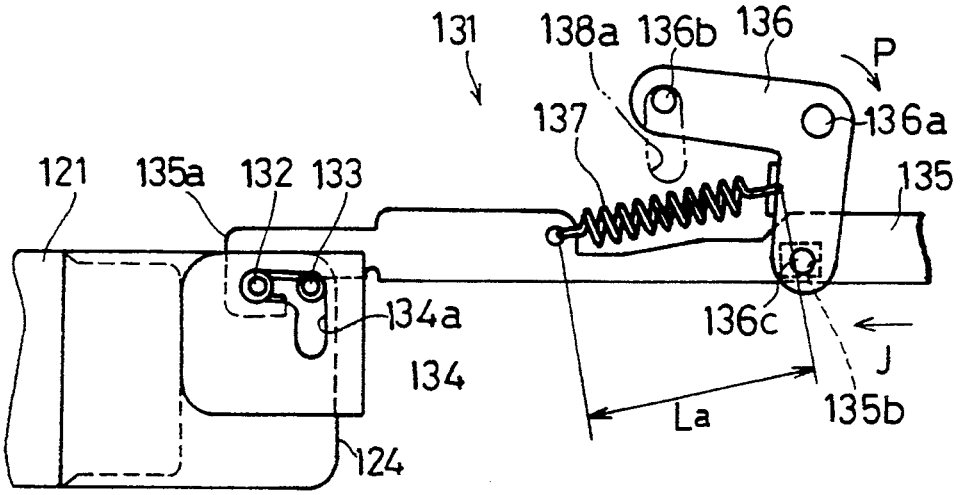
FIG. 22 is a plan view showing an essential part of an pressing device in the state as illustrated in FIG. 20.

Each pressing plate 136 having an L-shape is rotatably supported at its center by a shaft 136*a* on the upper-surface side of the developer container 108. Further, a guide shaft 136*b*, which is fixed to one end of the pressing plate 136 in an upward protruding manner, is inserted into a rotation-restricting hole 138*a* that is formed in the rotation-restricting plate 138 for pressing plates. Moreover, an engaging shaft 136*c*, which is fixed to the other end of the pressing plate 136, is engaged by an engaging hole 135*b* that is formed in the direct-acting arm 135. With this arrangement, the sliding movement of the direct-acting arm 135 is transmitted to the pressing plates 136, and the pressing plates 136 are allowed to rotate. Here, as illustrated in FIG. 22, the engaging hole 135*b* is slightly larger than the diameter of the engaging shaft 136*c*.

One end of each tension spring 137 is fixed to the direct-acting arm 135 in the proximity of the guide shaft 136*b*, and the other end of each tension spring 137 is fixed to each pressing plate 136 between the shaft 136*a* and the engaging shaft 136*c*. As will be described later with reference to FIG. 23, even in a state where the pulling action of the shaft 132 and 133, which is exerted on the direct-acting arm 135, is released, the tension springs 137 pull the pressing plates 136 and the direct-acting arm 135 together.

As illustrated in FIG. 20, the rotation-restricting plate 138 for pressing plates, which is provided over the direct-acting arm 135 and the pressing plates 136 in the shape of a hood, is integrally fixed to the developer tank 108, and the rotation-restricting hole 138*a* is provided thereto. The rotation-restricting hole 138*a* restricts the movable distance of the developer tank 108 by limiting the rotation of the guide shafts 136*b* and the pressing plates 136 in the P-direction that is made so to position the container unit at the first station. As illustrated in FIG. 24, the guide rails 139 are fixed to the copying machine main body at positions corresponding to the guide shafts 136*b* of the pressing plates 136. When the developer tank 108 is attached to the copying machine main body, the guide shafts 136*b* are inserted between the guide rails 139 so that they may freely slide therein. Here, the guide rails 139 extend in the axial direction of the photoreceptor drum 104.

Moreover, the developer-supplying container 121 is provided with a positioning cap 121*b* at its end opposite to the rotative mechanism 124. The positioning cap 121*b*, which has a cylinder shape at its end, is clamped by a clamping device 141 when the container unit has been placed at the second station, as illustrated in FIGS. 26 and 28. As illustrated in FIGS. 25 and 26, the clamping device 141 is constituted of a positioning member 142, a clamping lever 143 that functions as a clamping member, and a tension spring 144 that functions as an elastic member.

Figure 30:
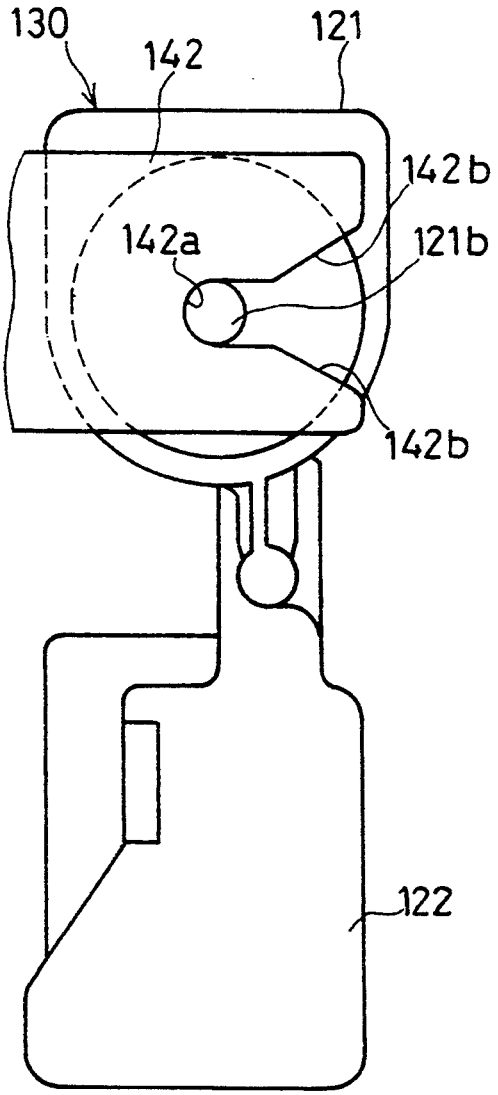
FIG. 30 is an explanatory drawing that shows the behavior of a positioning member in the state where the container unit is positioned at the second station.
Figure 31:
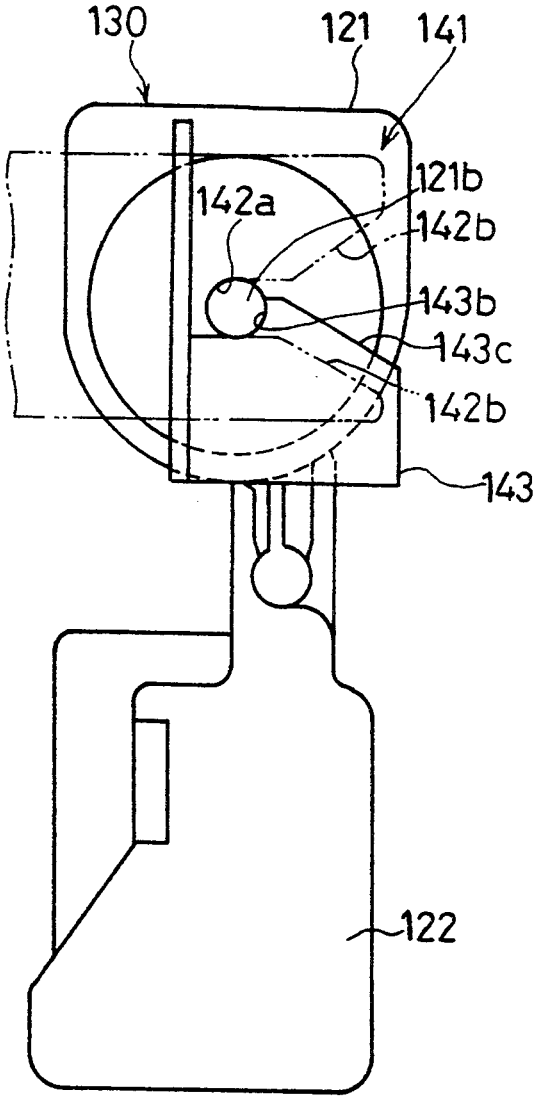
FIG. 31 is an explanatory drawing that shows the behavior of a clamping device in the state where the container unit is positioned at the second station.

As is also illustrated in FIGS. 30 and 31, when the container unit is located at the second station, the positioning member 142 positions the developer-supplying container 121 by allowing the positioning cap 121*b* of the developer-supplying container 121 to be received by a cap-holding section 142*a* having a U-shape. The positioning member 142 has guiding slopes 142*b* that reach the cap-holding section 142*a*. With these guiding slopes 142*b*, the cap-holding section 142*a* is formed into a shape that gradually widens upward as well as downward. The positioning member 142 also positions the developer-supplying container 121 in an up and down direction. Thus, when the container unit is placed at the second station, it is possible to prevent the waste-toner container 122 that is integrally combined with the developer-supplying container 121 from being lowered past an appropriate level. In other words, the waste-toner uptake opening 122*a* (see FIG. 26) of the waste-toner container 122 is securely fitted with the cleaning device 110.

As illustrated in FIG. 26, a central cylinder section 143*a* on the clamping lever 143 is rotatably fixed to the copying machine main body, and the clamping lever 143 is urged by the tension spring 144 so as to rotate in the N-direction (counterclockwise).

Figure 32:
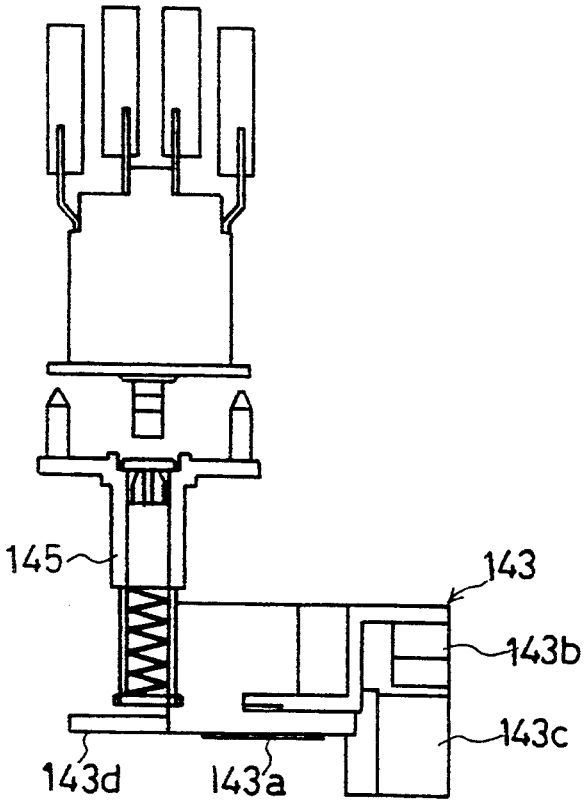
FIG. 32(*a*) is a plan view showing a clamping lever and an interlock switch in the clamping device.
Figure 32:
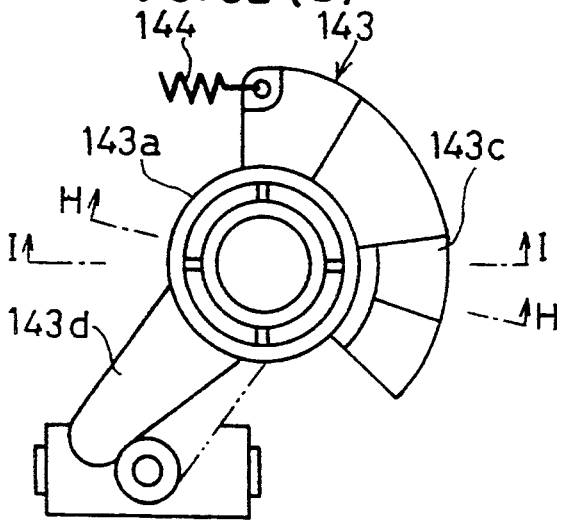
Figure 32:
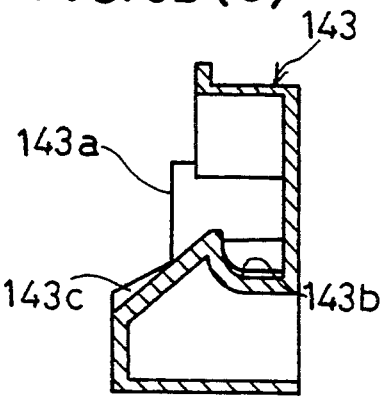

Referring to FIGS. 32(*a*), 32(*b*) and 32(*c*), the following description will discuss the structure of the clamping lever 143 in detail. Here, FIG. 32(*a*) is a plan view showing the clamping lever 143, and FIG. 32(*c*) is a side view showing the clamping lever 143. The guiding slope 143*c* is formed in one portion of the circumference of the cylinder section 143*a*, and a cap-clamping section 143*b*, which functions as a clamping section, is formed behind the guiding slope 143*c*. Further, as illustrated in FIG. 25, the rotation of the clamping lever 143 in the N-direction is restricted by a stopper, not shown, so that the position of the guiding slope 143*c* coincides with the position of the cap-holding section 142*a*. The guiding slope 143*c* is designed to contact the positioning cap 121*b* appropriately and allow the positioning cap 121*b* to be guided to the cap-clamping section 143*b* smoothly.

Figure 33:
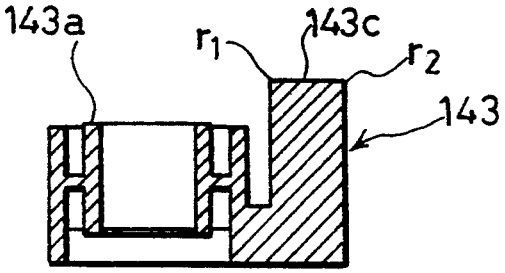
FIG. 33(*a*) is a cross-sectional view that is taken along the line H—H of FIG. 32(*b*)
Figure 33:
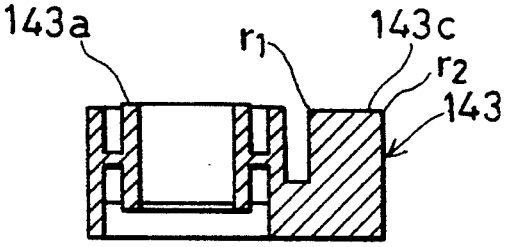

Here, the following description will discuss the shape of the guiding slope 143*c*. The guiding slope 143*c* is subjected to a downward force that is exerted by the positioning cap 121*b* when the positioning cap 121*b* is guided to the cap-clamping section 143*b*. As a result, the guiding slope 143*c* rotates in the M-direction (see FIG. 26), or clockwise, with its center coinciding with that of the cylinder section 143*a*. In order to guide the positioning cap 121*b* smoothly, it is necessary to allow the guiding slope 143*c* to make not point contact, but line contact with the positioning cap 121*b*, during its rotation in the M-direction. Therefore, when seen in a cross-sectional view taken along a plane that is in parallel with the axial direction of the cylinder section 143*a* and that passes through the cylinder section 143*a*, the cross section of the guiding slope 143*c* is designed as follows: FIGS. 33(*a*) and 33(*b*) are cross-sectional views that are respectively taken along the line H—H and the line I—I of FIG. 32(*b*). FIGS. 33(*a*) and 33(*b*) show that lines connecting an inner edge point $r_1$ and a circumferential point $r_2$ on arbitrary cross sections of the guiding slope 143*c* are orthogonal to the axial direction of the cylinder section 143*a*. The guiding slope 143*c* is formed into a three-dimensional geometric shape that satisfies the above-mentioned requirement.

As illustrated in FIG. 31, when the positioning cap 121*b* is clamped by the clamping device 141, the positioning cap 121*b* is allowed to move in its axial direction. The axial direction of the positioning cap 121*b* is parallel to the direction in which the developer tank 108 is pressed toward the photoreceptor drum 104.

Moreover, a switch-covering portion 143*d*, which is used as a covering member, extends from a circumference portion of the cylinder section 143*a*. The switch-covering portion 143*d* is formed on the opposite side to the cap-clamping section 143*b*. When the developer-supplying container 121 is not clamped by the clamping device 141, the clamping lever 143 is restricted by the stopper in its rotation in the D-direction. At this time, as illustrated in FIG. 27, the switch-covering portion 143*d* covers the operation section of an interlock switch 145 that is attached to the copying machine main body. In contrast, when the developer-supplying container 121 is clamped by the clamping device 141, the clamping lever 143 clamps the positioning cap 121*b*, and is located at a slightly rotated position in the C-direction. In this case, as illustrated in FIG. 28, the switch- covering portion 143*d* uncovers the operation section of the interlock switch 145.

The interlock switch 145 is used to inform the fact that the copying machine has returned to the operable state of copying: It turns on when the operation section is depressed, and otherwise remains off. Moreover, the interlock switch 145, when turned on, shows that the developer unit 130 is clamped by the clamping device 141. As illustrated in FIGS. 27 and 28, a protruding member 147 for switching operation is attached to the inner surface of the front panel 146, which is a lid of the copying machine main body. Thus, the on/off operation of the interlock switch 145 is carried out by the protruding member 147 for switching operation.

Figure 34:
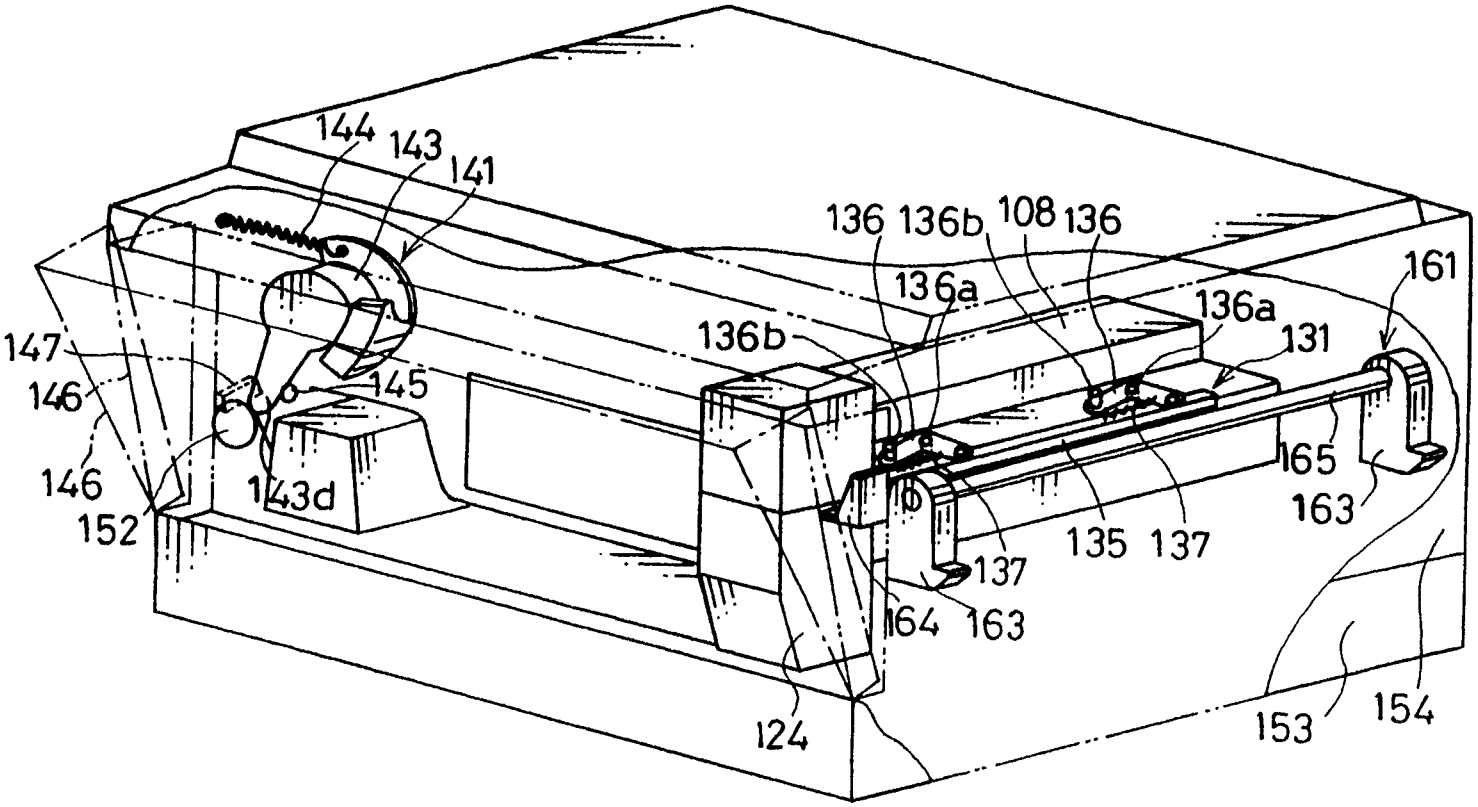
FIG. 34 is a perspective view showing a state where the front cover is closed in the case where the container unit is not attached to the copying machine main body.

Therefore, as illustrated in FIG. 34, if the developing unit 130 is not clamped by the clamping device 141, the protruding member 147 for switching operation comes into contact with the switch-covering portion 143*d* of the clamping lever 143, and prevents the front panel 146 from being closed. As a result, the interlock switch 145 remains off, and shows that the developing unit 130 has not been appropriately attached. In this state, the copying machine is not allowed to carry out its copying operation.

Figure 35:
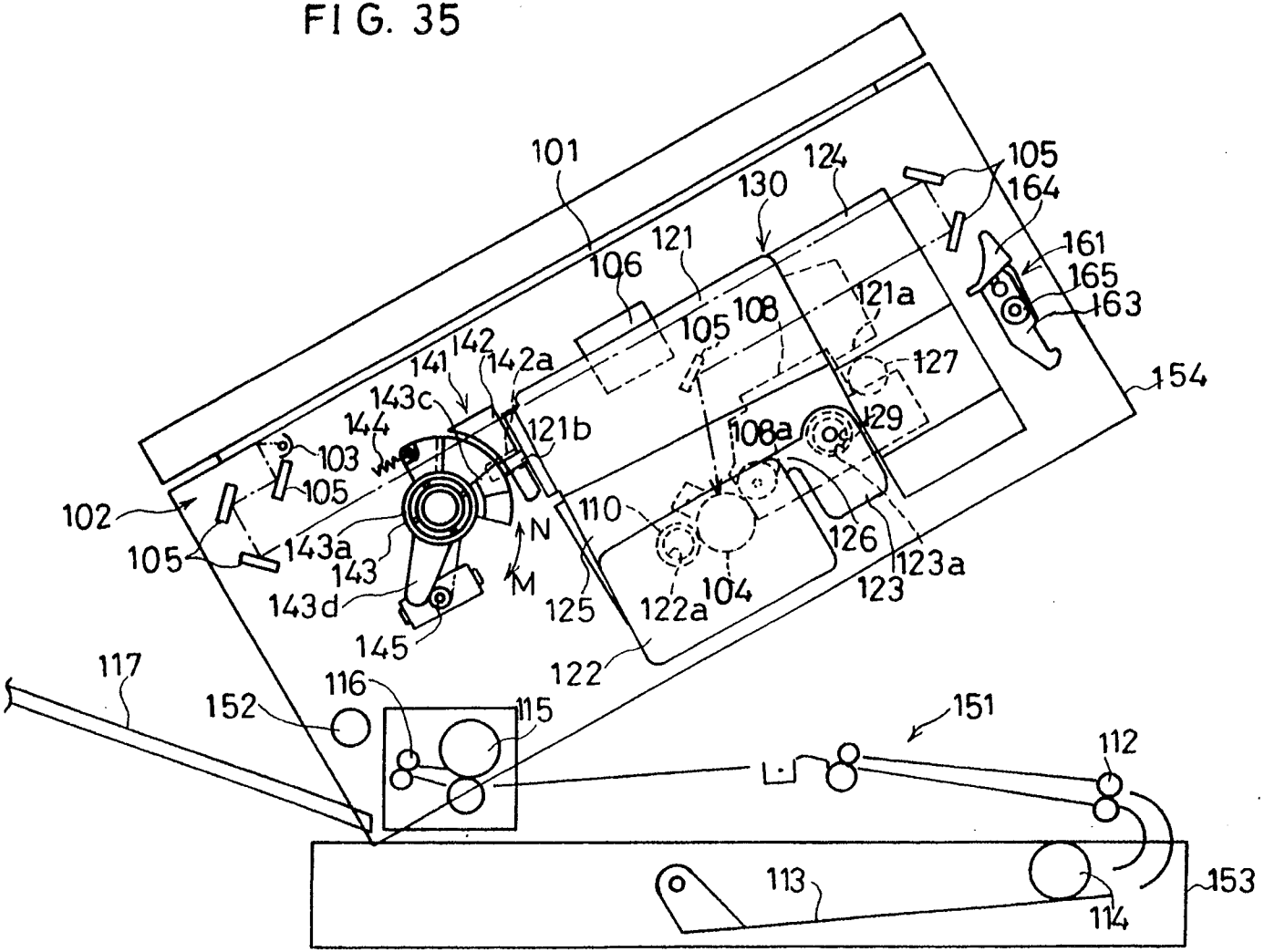
FIG. 35 is a schematic front view showing a state where the upper part of the copying machine is exposed in the above-mentioned copying machine.

Moreover, as illustrated in FIG. 35, in the present copying machine, the so-called clam-shell type is adopted. In other words, the present copying machine is divided into a copying machine lower section 153, which is the lower portion of an electrophotographic apparatus, and a copying machine upper section 154, which is the upper portion of the electrophotographic apparatus, with a paper-transport path 151 located in between. When the necessity arises so as to correct a jam such as a paper jam, the copying machine upper section 154 is lifted up so that the copying machine lower section 153 is exposed. For this reason, the copying machine upper section 154 is allowed to pivot around a shaft 152 that is fixed on the paper-discharging side. The locked state of the copying machine upper section 154 is maintained with respect to the copying machine lower section 153 by a locking device 161 that functions as a locking means. When the locked state made by the locking device 161 is released, the copying machine upper section 154, which is urged by a tension spring, not shown, is allowed to pivot upward.

As illustrated in FIG. 27, the locking device 161 is constituted of: a pair of hooks attached to the front side and the rear side of the copying machine upper section 154; a connecting shaft 165 for connecting the hooks 163; engaging members 162 (see FIG. 25) that are installed in the copying machine lower section 153 so as to be engaged by the hooks 163; and a lock-releasing lever 164 for releasing the locked state between the hooks 163 and the engaging members 162 by rotating the hooks 163.

Figure 36:
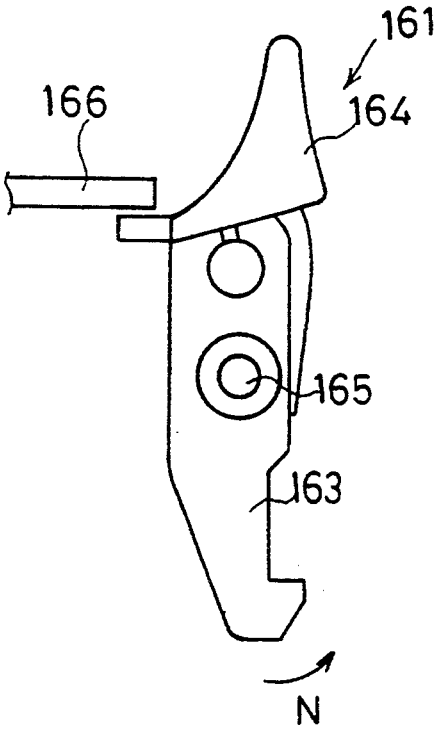
FIG. 36(*a*) is a front view showing a state where a lock-releasing operation is prevented by a lock-release restricting plate in the locking device illustrated in FIG. 25.
Figure 36:
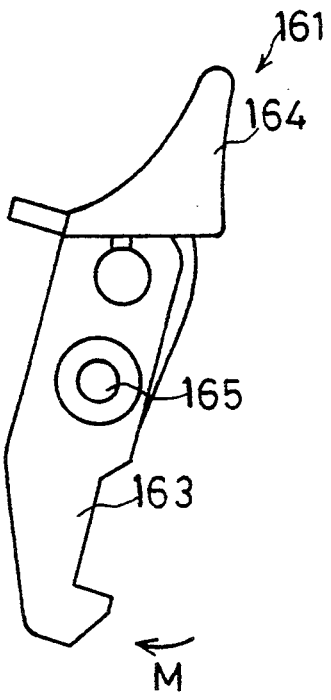

Here, the hooks 163 are provided on the opposite side to the shaft 152. Further, the hooks 163 are allowed to rotate, centered on the connecting shaft 165, and urged by a tension spring, not shown, so as to engage the engaging members 162. Therefore, the hooks 163 are rotated in the N-direction when locked, as is illustrated in FIG. 36(*a*), and rotated in the M-direction when released, as is illustrated in FIG. 36(*b*).

Figure 37:
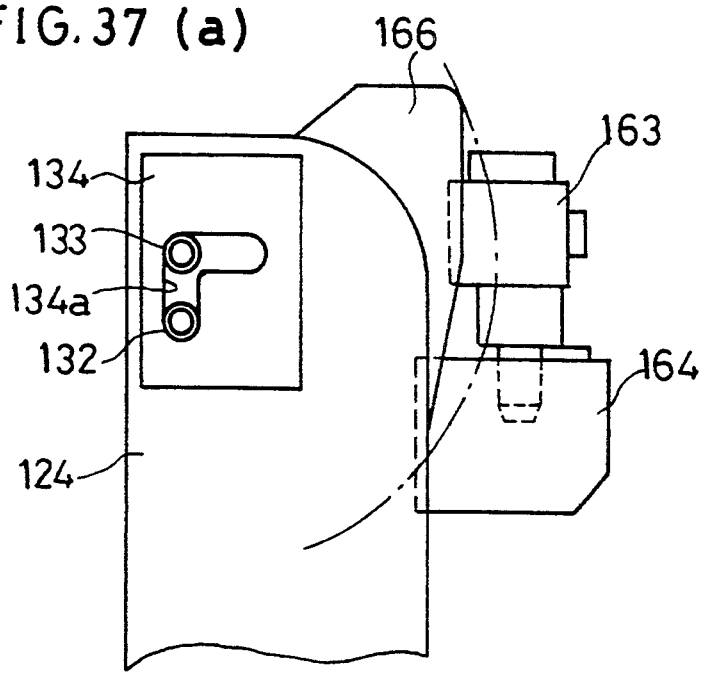
FIG. 37(*a*) is a plan view showing a state where the lock-release restricting plate is located at a position for preventing the lock releasing with respect to the locking device.
Figure 37:
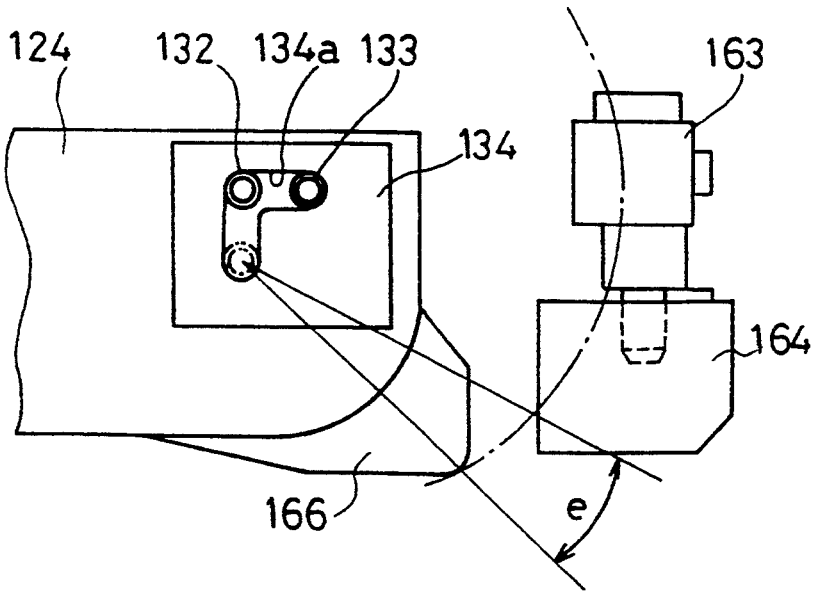

Moreover, in the present copying machine, in order to prevent the copying machine upper section 154 from being opened when the container unit is placed at the first station to be linearly aligned with the developer tank 108 that is attached to the copying machine main body, a lock-release stopping plate 166, which is a releasing-action stopping means, is fixed to the rotative mechanism 124, as illustrated in FIGS. 37(*a*) and 37(*b*). As illustrated in FIGS. 36(*a*) and 37(*a*), the lock-release stopping plate 166 is located above the lock-releasing lever 164 when the container unit is placed at the first station. This arrangement prevents the lock-releasing lever 164 and the hooks 163 from rotating in the M-direction. In contrast, when the container unit is placed at the second station, the lock-release stopping plate 166 is withdrawn from above the lock-releasing lever 164, as shown in FIG. 37(*b*), thereby allowing the rock-releasing lever 164 and the hooks 163 to rotate in the M-direction.

Additionally, within a releasing angle e shown in FIG. 37(*b*), the lock-release stopping plate 166 does not interfere with the lock-releasing action of the hooks 163. The objective of this arrangement is to prevent the clamping action of the clamping device 141 from taking place simultaneously with the lock-release stopping action of the lock-release stopping plate 166. The releasing angle e is desirably set by adjusting the shape, etc. of the lock-release stopping plate 166.

In the above-mentioned arrangement, when a copying operation is carried out in the copying machine shown in FIG. 26, the light-source lamp 103 in the exposure-use optical system 102 scans an original placed on the document platen 101. The reflected light from the original is projected onto the photoreceptor 104 through the reflective mirrors 105 and the lens unit 106, thereby forming an electrostatic latent image on the surface of the photoreceptor 104, which has been charged to a predetermined electric potential by the main charger 107. Then, the electrostatic latent image is developed by toner that is supplied from the developing device 108. Thereafter, the toner image formed on the surface of the photoreceptor 104 is transferred onto a copy sheet that is supplied by the paper cassette 113, and is fused onto the copy sheet by the fixing device 115. Then, the copy sheet is discharged onto the tray 117 by the discharge roller 116.

As the above-mentioned copying operations are repeated, the toner density inside the developer tank 108 is gradually lowered. As the toner density is lowered, developer is supplied from the developer-supplying container 121 through the developer-supplying inlet 121*a* according to the necessity. As illustrated in FIG. 21, the developer is supplied to the developer tank 108 from the developer-feeding inlet 128 through the developer-supplying duct 127. On the other hand, carrier, which is stored inside the developer tank 108, is not consumed through the developing processes; therefore, the quantity of the developer inside the developer tank 108 increases because of the developer supply. However, for example, the excessive developer overflows, and is discharged into the waste-developer container 123 through the developer-discharging duct 129 (see FIG. 26). Moreover, the waste toner, which has been removed by the cleaning device 110 during the copying operations, is collected into the waste-toner container 122 through the waste-toner uptake opening 122*a*.

As illustrated in FIG. 20, upon attaching the developing unit 130 to the copying machine main body, the container unit, which consists of the developer-supplying container 121, the waste-toner container 122 and the waste-developer container 123, is aligned linearly with respect to the developer tank 108, and as illustrated in FIGS. 25 and 27, the developer tank 108 is first inserted into the copying machine main body.

When the container unit is placed at the first station, the pressing plate 136 is rotated in the P-direction because, as shown in FIG. 22, the direct-acting arm 135 is pulled in the J-direction by the shaft 132. However, the guide shaft 136*b* is maintained at the same position by the guide rail 139. As a result, a force in the G-direction, which is exerted as a reaction force shown in FIG. 24, is applied to the guide shaft 136*b* from the guide rail 139. Here, the G-direction is the departing direction of the developer tank 108 from the photoreceptor drum 104. This allows the shaft 136*a* of the pressing plate 136 to move in the G-direction, and the developer tank 108 is thus moved in the G-direction. Therefore, the developer tank 108 is separated from the photoreceptor drum 104. Here, the rotation of the pressing plate 136 is restricted by a mechanism wherein the guide shaft 136*b* of the pressing plate 136 comes into contact with the short-side portion of the rotation-restricting hole 138*a* of the rotation-restricting plate 138 for pressing plate.

Moreover, in the state as described above where only the developer tank 108 is inserted into the copying machine main body, the lock-release stopping plate 166 is located on the lock-releasing lever 164, as illustrated in FIG. 37(*a*). Therefore, in this state, it is not possible to open the copying machine upper section 154 by operating the lock-releasing lever 164.

Furthermore, as illustrated in FIG. 27, the switch-covering portion 143*d* of the clamping lever 143 is located at the station for covering the operation section of the interlock switch 145. Therefore, in the state where the container unit has been removed, the front panel 146 is not closed, if tried, because the protruding member 147 for switching operation, attached to the front panel 146, comes into contact with the switch-covering portion 143*d*. Thus, the interlock switch 145 remains off. This prevents the copying operation, thereby eliminating the possibility of faulty operation. Here, the above-mentioned operation is available in the same manner also in the case when the developing unit 130 has not been attached to the copying machine main body.

Next, after having inserted the developer tank 108 as described above, the container unit is placed at the second station by rotating it by virtual 90 degrees toward the copying machine main body, as is shown in FIG. 21. In this case, as illustrated in FIG. 26, the positioning cap 121*b* of the developer-supplying container 121 is maintained by the cap-holding section 142*a* of the positioning member 142 in a state where it is not allowed to move in an up and down direction. Further, when the positioning cap 121*b* is pressed against the guiding slope 143*c* of the clamping lever 143, the guiding slope 143 is pushed by the positioning cap 121*b*. This makes the clamping lever 143 rotate in the M-direction at first. Then, when the positioning cap 121*b* is fitted with the cap-clamping section 143*b*, the clamping lever 143 reversely rotates in the N-direction, thereby clamping the positioning cap 121*b*. Thus, the clamping device 141 clamps not only the container unit, but also the developing unit 130.

Figure 23:
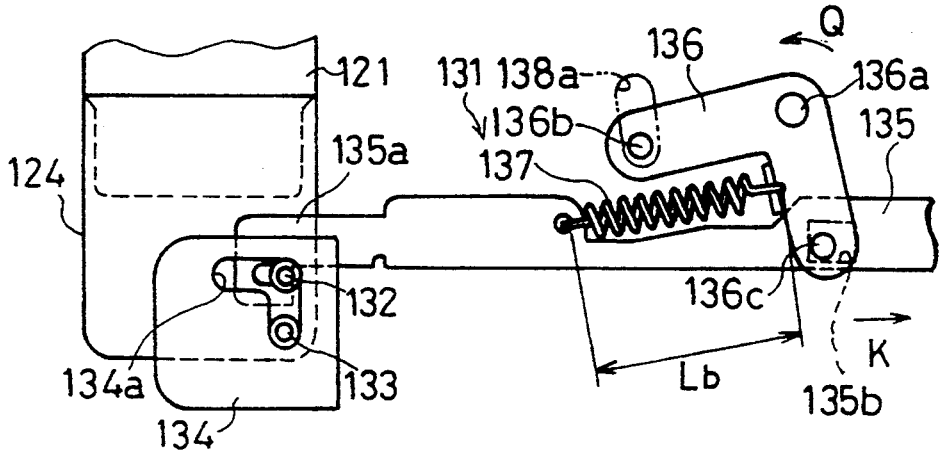
FIG. 23 is a plan view showing the essential part of the pressing device in the state as illustrated in FIG. 21.

In the above-mentioned state, as illustrated in FIG. 23, since the pulling action of the shaft 132, which has been exerted on the direct-acting arm 135, is released, the direct-acting arm 135 is moved in the K-direction and the pressing plate 136 rotates in the Q-direction. At this time, the engaging shaft 136*c* of the pressing plate 136 comes into contact with the side edge of the hook section 135*a* of the engaging hole 135*b* in the direct-acting arm 135. Thus, the direct-acting arm 135 and the pressing plate 136 are maintained at respective predetermined positions. This is due to the fact that, even in the state shown in FIG. 23, a pulling force of the tension spring 137 is exerted between the direct-acting arm 135 and the pressing plate 136.

More specifically, assuming that the length of the tension spring 137 is La in the case where the direct-acting arm 135 has been shifted in the J-direction as illustrated in FIG. 22, that the length of the tension spring 137 is Lb in the case where the direct-acting arm 135 has been shifted in the K-direction as illustrated in FIG. 23, and that the original length of the tension spring 137 is Lc, a relationship, $La > Lb > Lc$, holds. In other words, also in the case when the length of the tension spring 137 is Lb, the tension spring 137 is expanded more than its original length. As a result, a pulling force of the tension spring 137 is always exerted between the direct-acting arm 135 and the pressing plate 136.

As described above, when the pressing plate 136 rotates in the Q-direction, a force in the F-direction, which is a reaction force, is applied to the pressing plate 136 by the guide rail 139, as illustrated in FIG. 24, because the guide shaft 136*b* is maintained at the same position by the guide rail 139. Here, the F-direction is the direction in which the developer tank 108 is pressed toward the photoreceptor drum 104. As a result, since the shaft 136*a* moves in the F-direction, the developer tank 108 is shifted in the F-direction. Therefore, the developer tank 108 is pressed toward the photoreceptor drum 104.

As illustrated in FIG. 21, in this state, the developer-supplying inlet 121*a* of the developer-supplying container 121 is fitted with the developer-feeding inlet 128. As illustrated in FIG. 26, the waste-toner uptake opening 122*a* of the waste-toner container 122 is fitted with the cleaning device 110, and the waste-developer uptake opening 123*a* of the waste-developer container 123 is fitted with the developer-discharging duct 129.

Further, in this attached state of the developing unit 130, as illustrated in FIG. 37(*b*), since the lock-release stopping plate 166 is withdrawn from above the lock-releasing lever 164, it is possible to open the copying machine upper section 154 by operating the lock-releasing lever 164.

Moreover, as illustrated in FIG. 28, the switch-covering portion 143*d* of the clamping lever 143 has been located at such a position as not to cover the operation section of the interlock switch 145. Therefore, when the front panel 146 is closed, the interlock switch 145 is turned on by the protruding member 147 for switching operation. This indicates that the developing unit 130 has been attached, thereby allowing the copying operation.

Upon removing the developing unit 130 from the copying machine main body, the clamping lever 143 is first rotated in the M-direction so that the positioning cap 121*b* of the developer-supplying container 121 is removed from the cap-clamping section 143*b* of the clamping lever 143. Then, the developer-supplying container 121 is rotated forward with respect to the copying machine main body so as to place the container unit at the first station.

After these processes, the pressing action of the pressing device 131 is released, and the developer tank 108 is separated from the photoreceptor drum 104, and allowed to be drawn out of the copying machine main body. Thus, the developing unit 130 is drawn from the copying machine main body. In this case, if, for example, the developer-supplying container 121 is replaced due to lack of developer stored therein, the container unit is removed from the rotative mechanism 124, and disposed as waste so as to replace it with a new one.

As described above, in the present copying machine, firstly, the developer-supplying container 121, the waste-toner container 122 and the waste-developer container 123 are integrally attached to the developer tank 108, thereby forming the developing unit 130. Secondly, the container unit, which integrally includes the developer-supplying container 121, the waste-toner container 122 and the waste-developer container 123, is allowed to pivot by 90 degrees with respect to the developer tank 108 that is inserted into the copying machine main body. Thirdly, the pressing device 131 is operated in such a manner that the developer tank 108 is pressed toward the photoreceptor drum 104 by attaching the container unit to the copying machine main body. With this arrangement, the developer tank 108 is maintained at the predetermined position with respect to the photoreceptor drum 104.

Moreover, it is possible to draw the developing unit 130 out of the copying machine main body by rotating the container unit reversely. Therefore, since this arrangement eliminates the necessity of operations that are independently carried out for positioning and clamping the developer tank, it is possible to reduce the number of operations that are required upon attaching and replacing the containers and like parts to and from the copying machine main body. With this arrangement, replacing jobs of the developer tank 108 and the photoreceptor drum 104 can be easily performed. Further, it is possible to prevent misoperations such as caused by negligence of duty in pressing the developer tank 108 toward the photoreceptor drum 104.

Figure 38:
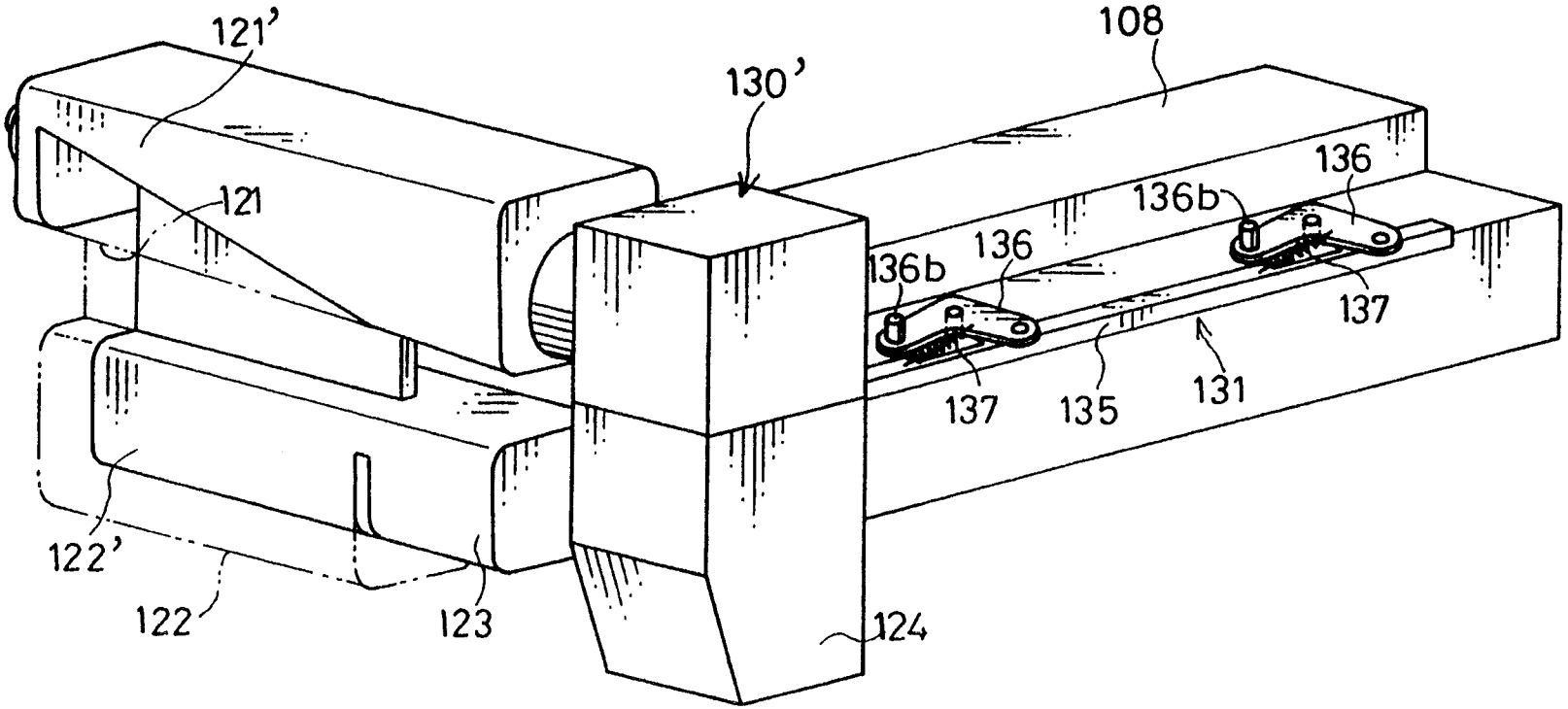
FIG. 38 is a perspective view showing another example of the developing unit illustrated in FIG. 29.

Furthermore, the arrangement of the pressing device 131 is readily applied to a developing unit 130' wherein the developer-supplying container 121 has a different volume. More specifically, in a copying machine which is capable of color copying by the use of mono-colors of a plurality of kinds, the black-color is most frequently used as copying color in most cases. Therefore, as illustrated in FIG. 38, concerning developing units 130' for use in colors except the black color, it is possible to make the machine compact by using a developer-supplying container 121' and a waste-toner container 122' that have smaller volumes in comparison with those of the developer-supplying container 121 and the waste-toner container 122 for black-color use.

Moreover, there are some cases wherein no developer-supplying container 121 is needed. Such changes in volume on the side of the developer-supplying container 121, that is, changes in weight, cause changes in gravity on the developing unit 130 itself. Therefore, even in the case where developer tanks 108 of the developing units 130 for respective colors are pressed toward the photoreceptor drum 104 under the same pressing conditions, for example, by the same pressing force at the same position, it is difficult to provide desirable pressing conditions with respect to the axial direction of the photoreceptor drum 104. For this reason, it is necessary to change the setting of pressing conditions on the developer tank 108 toward the photoreceptor drum 104 depending on the developer units 130 for the respective colors.

The above-mentioned pressing device 131 is able to satisfy this requirement easily by changing: the positions of the pressing plates 136; the loads of the tension springs 137; the loads of the tension springs 137 into loads that are respectively different from each other; or the attaching positions of the tension springs 137 with respect to the pressing plates 136 or the direct-acting arm 135.

Further, with the arrangement of the present apparatus having the interlock switch 145, the switch-covering portion 143*d* of the clamping lever 143, and the protruding member 147 for switching operation that is attached to the front panel 146, upon closing the front panel 146, it is possible to readily determine whether or not the developer-supplying container 121 or the waste-toner container 122 of the developing unit 130 is appropriately attached to the copying machine main body. This makes it possible to readily take the necessary measures by detecting the fact that the waste-toner container 122 has not been attached, in an early stage of operations.

In other words, if a copying operation is carried out without attaching the waste-toner container 122, waste toner will overflow from the cleaning device 110 because no place is prepared for receiving the waste toner that has been collected by the cleaning device 110; this results in faulty operation in the copying machine. Therefore, this copying machine needs a detecting means, such as for example a detection switch, in order to detect whether or not the waste-toner container 122 has been attached. For this purpose, if the detection switch is provided so that it turns on, for example, after completion of attaching the waste-toner container 122, it is necessary to confirm the on-state of the detection switch on the panel display, that is, the attached state of the waste-toner container 122, after having closed the front panel 146 following the completion of the replacing job. At this time, if the waste-toner container 122 has not been attached yet, it is necessary to open the front panel 146 again, and to start the attaching job of the waste-toner container 122 over again.

In contrast, in the copying machine of the present invention, if the container unit including the waste-toner container 122 has not been attached to the copying machine main body, the front panel 146 can not be closed. This is because, upon trying to close the front panel 146, the protruding member 147 for switching operation comes into contact with the switch-covering portion 143*d* of the clamping lever 143. Therefore, at this time, it becomes possible to confirm the attached state of the waste-toner container 122. Further, the interlock switch 145 of the present copying machine confirms the operable state of the copying machine as well as the attached state of the waste-toner container 122; this eliminates the necessity of installing a switch that is exclusively used for confirming the attached state of the waste-toner container 122.

Figure 39:
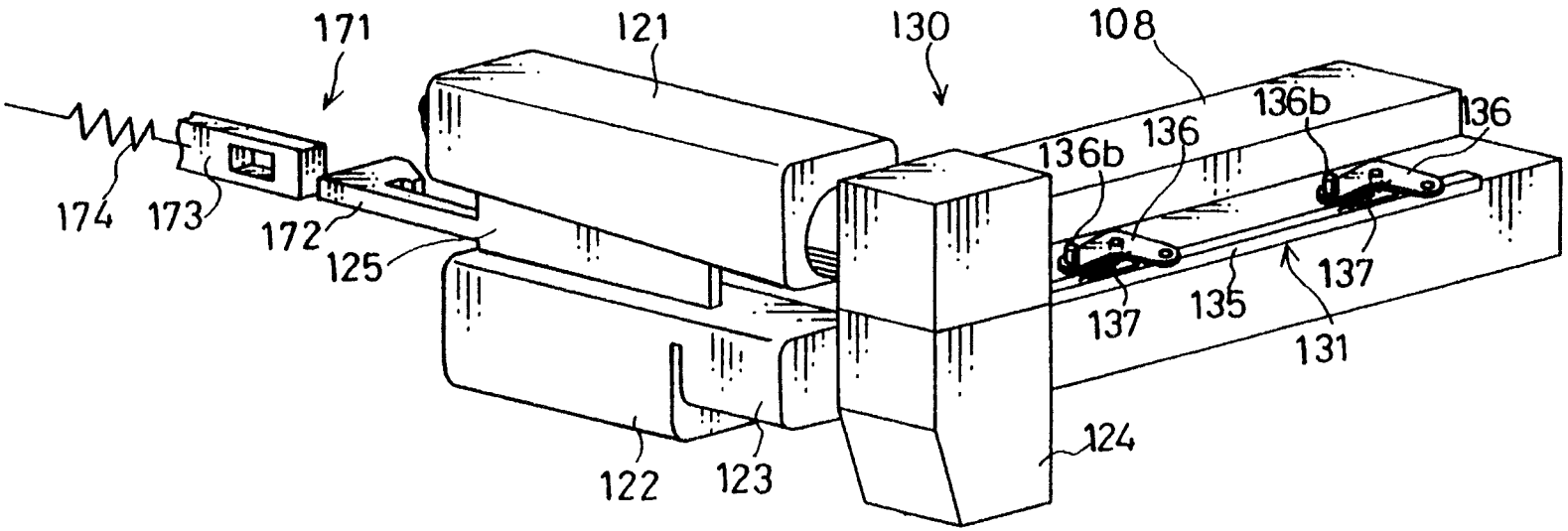
FIG. 39(*a*) is a perspective view showing a state prior to a clamping operation that is carried out by a conventional clamping device, which had been used before the clamping device illustrated in FIG. 25 was developed.
Figure 39:
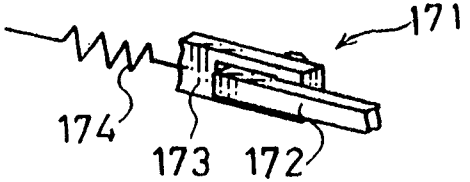
Figure 40:
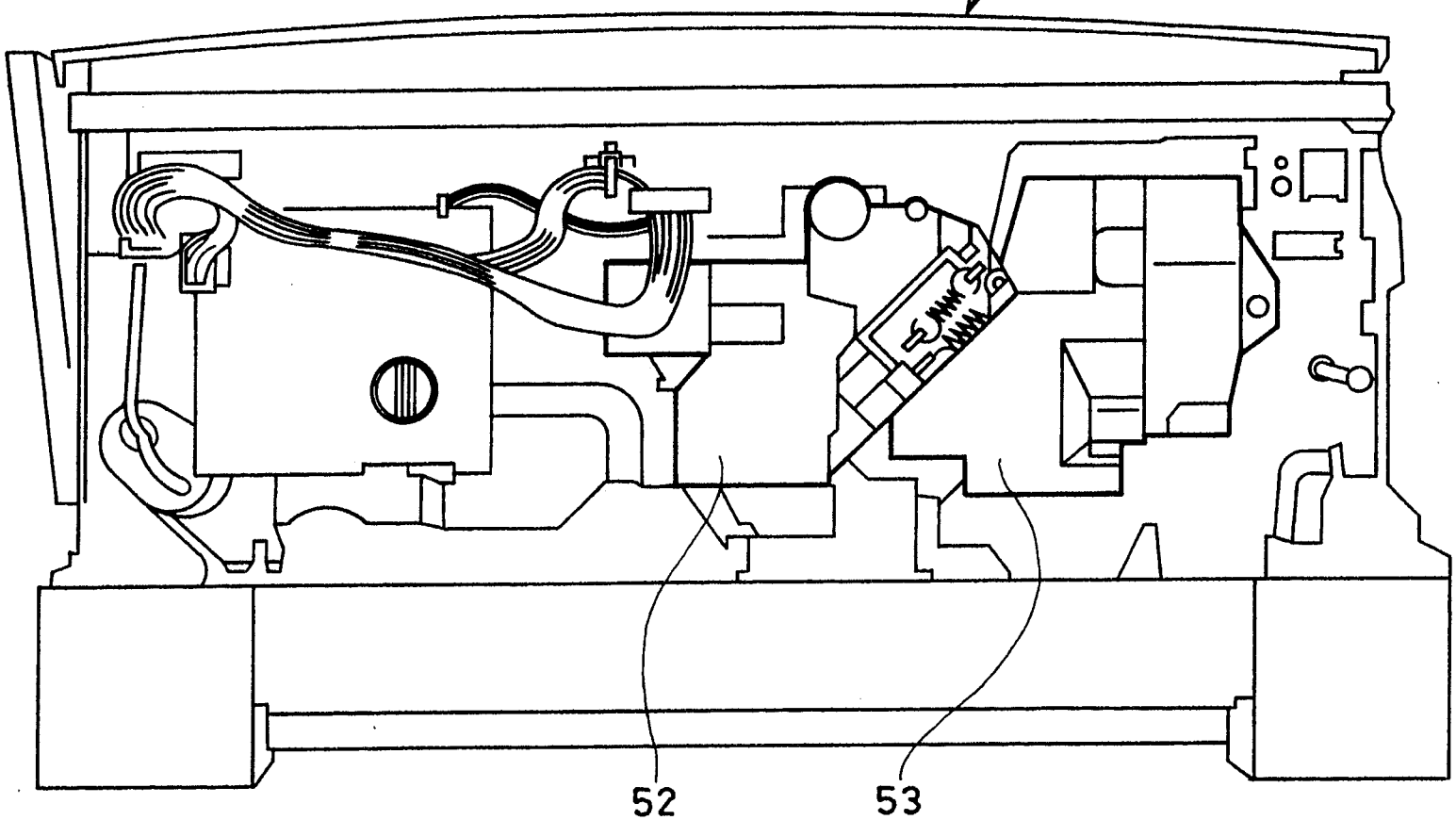
FIG. 40 is an explanatory drawing that schematically shows the structure of a copying machine wherein a conventional image forming apparatus is installed.
Figure 41:
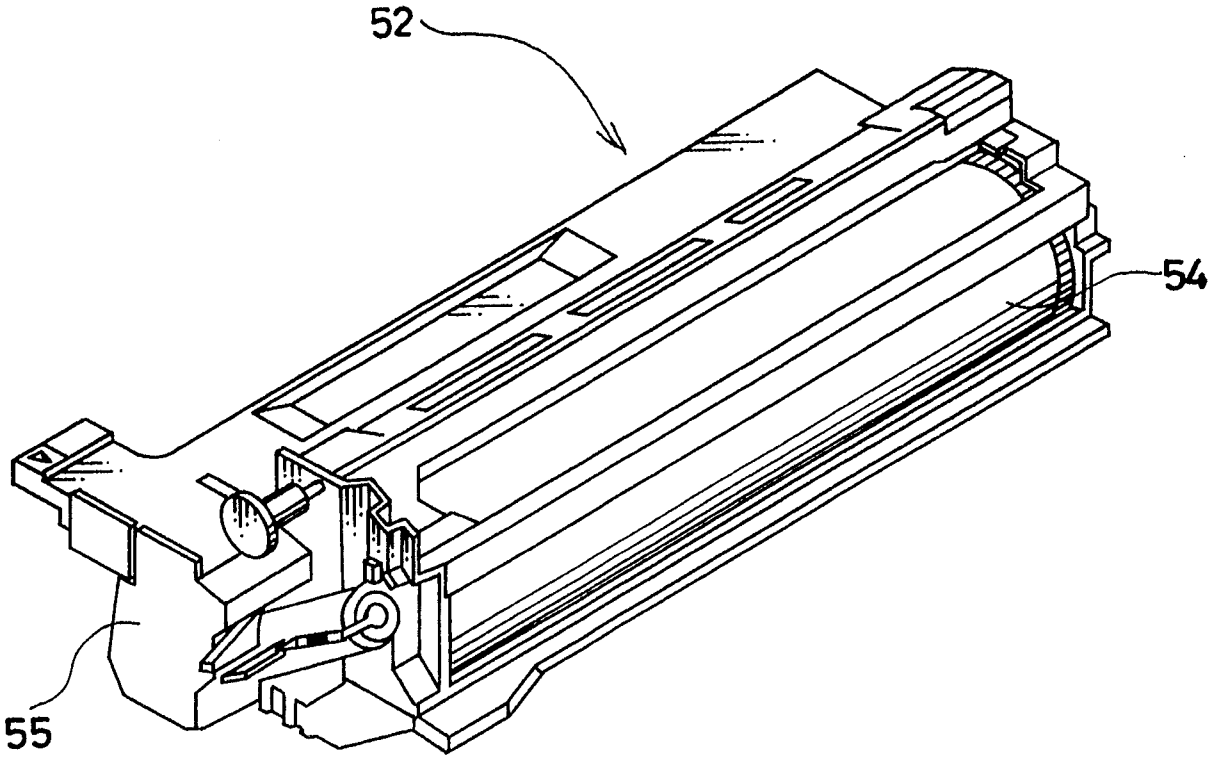
FIG. 41 is a perspective view showing a drum cartridge that is attached to the copying machine of FIG. 40.
Figure 42:
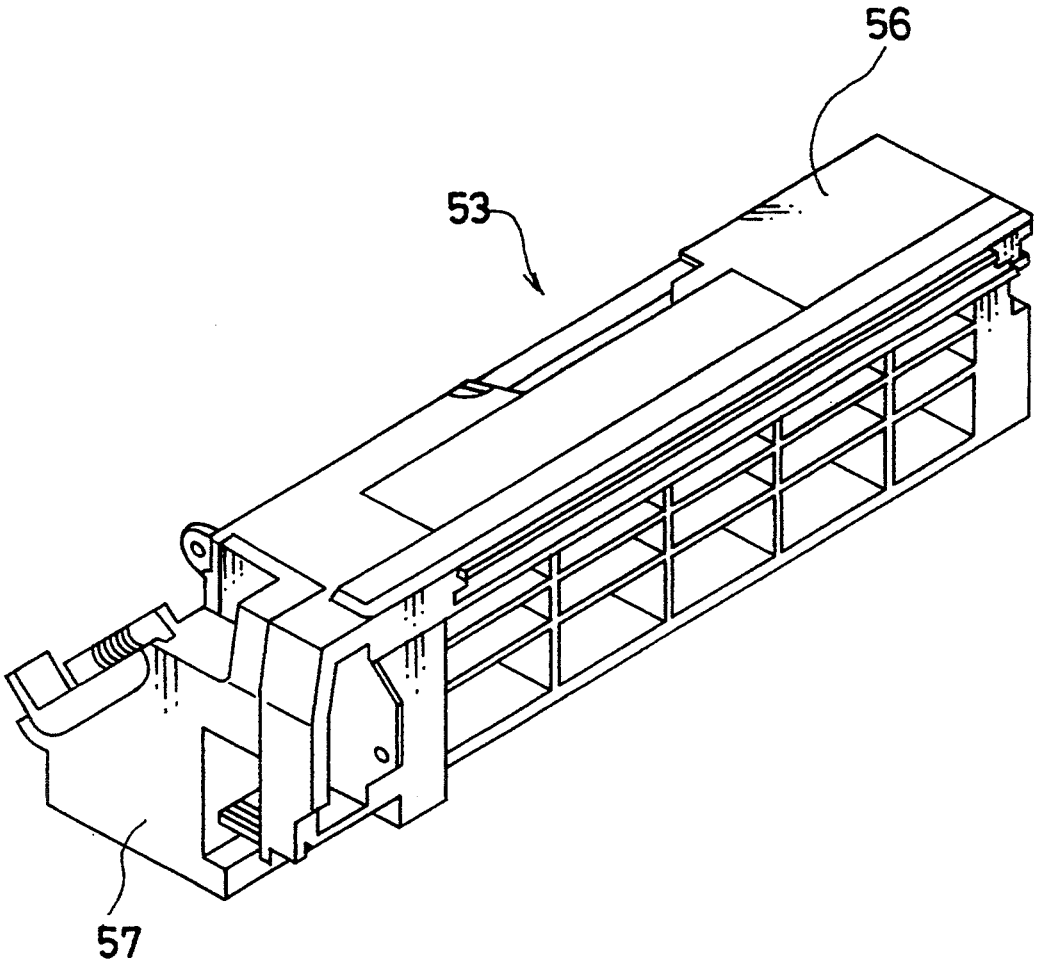
FIG. 42 is a perspective view showing a developing cartridge that is attached to the copying machine of FIG. 40.

Further, the clamping device 141 is arranged so as not to give any adverse effects on the pressing conditions of the developer tank 108 toward the photoreceptor drum 104. Here, the following description will discuss the features of the clamping device 141 by comparing it with another clamping device 171 shown in FIG. 39(*a*). The clamping device 171 is provided with: a clamping hook 172 that is attached to the connecting section 125 between the developer-supplying container 121 and the waste-toner container 122; a hook-receiving section 173 that is engaged by the clamping hook 172; and a tension spring 174 for urging the hook-receiving section 173 in the pressing direction of the developer tank 108. As illustrated in FIG. 39(*b*), the clamping hook 172 rotates toward the copying machine main body together with the developer-supplying container 121, and comes to engage the hook-receiving section 173. In the clamping device 171 of this type, the developer tank 108, in its clamped state, is pulled by the tension spring 174 in the pressing direction toward the photoreceptor drum 104. In other words, in addition to the pressing force of the pressing device 131, the urging force of the tension spring 174 is exerted on the developer tank 108; this results in unstable pressing conditions of the developer tank 108 toward the photoreceptor drum 104. The same problem arises when the developer tank 108 is urged by the tension spring 174 in the departing direction from the photoreceptor drum 104.

In contrast, the present clamping device 141 properly positions the developer-supplying container 121 with respect to the up and down direction by the use of the positioning member 142, and clamps it with respect to the front and rear direction by the use of the clamping lever 143. In other words, no restriction is imposed on the developer-supplying container 121 in its movement in the pressing direction of the developer tank 108 toward the photoreceptor drum 104. Therefore, it is possible to prevent the pressing device 131 from giving adverse effects on the pressure balance of the developer tank 108 with respect to the photoreceptor drum 104.

Moreover, as described earlier, the guiding slope 143*c* of the clamping lever 143 is formed into the three-dimensional geometric shape, wherein supposing a hypothetical cross-section of the guiding slope 143*c* that is made by cutting it by a plane that passes through the center of the cylinder section 143*a*, namely, the rotation center of the guiding slope 143*c*, and that is parallel to the axial direction of the cylinder section 143*a*, lines connecting an inner edge point and a circumferential point on the cross section are orthogonal to the axial direction of the cylinder section 143*a*. Therefore, the clamping lever 143 rotates reliably when it comes into contact with the positioning cap 121*b*, and the developer-supplying container 121 is thus desirably guided to the cap-clamping section 143*b*.

Furthermore, in the present copying machine, in the state where only the developer tank 108 is inserted into the copying machine main body and the container unit is placed at the first station with respect to the developer tank 108, the lock-release stopping plate 166 is disposed over the lock-releasing lever 164 of the locking device 161; this arrangement prevents misoperation associated with the lock-releasing lever 164. That is, this arrangement makes it possible to prevent accidental opening of the copying machine upper section 154 when the container unit is placed at the first station, and the resulting spill of waste toner or waste developer over the inside of the copying machine from the waste-toner uptake opening 122*a* of the waste-toner container 122 or the waste-developer uptake opening 123*a* of the waste-developer container 123.

Additionally, in the present embodiment, the explanation has been given by exemplifying the copying machine of the so-called Trickle type wherein toner as well as carrier is supplied to the developer tank 108 and developer including deteriorated carrier is discharged into the waste-developer container 123; yet, the present invention is not intended to be limited to this arrangement. For example, the present invention may be applied to a copying machine of such a type as to supply only consumed portion of the toner without supplying carrier. In this case, no waste-developer container 123 is needed, and the developing unit 130 is therefore constituted of the developer tank 108, the developer-supplying container 121 and the waste-toner container 122, all of which are integrated into one unit.

Moreover, the pressing device 131 is arranged so that it pulls the direct-acting arm 135 upon placing the container unit at the first station, while it releases the pulling action upon placing the container unit at the second station; yet, another arrangement wherein the the direct-acting arm 135 functions in the reversed manner may be adopted. In this case, the clamping device 141 carries out the pressing operation in accordance with the rotation of the pressing plates 136 in the P-direction, and carries out the releasing operation in accordance with the rotation of the pressing plates 136 in the Q-direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a drum cartridge for housing a photoreceptor drum;

a waste-toner transport unit for transporting toner that has been scraped off the photoreceptor drum;

a developing cartridge for developing an electrostatic latent image that is formed on the photoreceptor drum; and a toner cartridge which is constituted of a waste-toner container for storing the toner that is transported by the waste-toner transport unit and a developer-supply container for supplying developer to the developing cartridge, both integrally formed into one part, wherein the drum cartridge, the developing cartridge and the toner cartridge are attached so as to be respectively removable in a first direction, and the waste-toner transport unit is pivotally attached independently from the drum cartridge in such a manner that it allows the drum cartridge to be shifted in the first direction and removed from the apparatus.

2. The image forming apparatus as defined in claim 1, further comprising:

shifting means for shifting the developing cartridge and the drum cartridge in a departing direction or in an approaching direction with each other by the pivotal movement of the waste-toner transport unit.

3. The image forming apparatus as defined in claim 1, further comprising:

a first inlet of waste toner that is attached to the waste-toner container;

a second inlet of waste toner that is attached to the waste-toner transport unit; and closing means that are respectively attached to the first and second inlets, the closing means being designed so that the first and second inlets become open when the waste-toner transport unit is set at predetermined station in the proximity of the drum cartridge, and that the first and second inlets are closed when the waste-toner transport unit is pivoted so as to be set apart from the drum cartridge.

4. The image forming apparatus as defined in claim 2, further comprising:

a first inlet of waste toner that is attached to the waste-toner container;

a second inlet of waste toner that is attached to the waste-toner transport unit; and closing means that are respectively attached to the first and second inlets, the closing means being designed so that the first and second inlets become open when the waste-toner transport unit is set at predetermined station in the proximity of the drum cartridge, and that the first and second inlets are closed when the waste-toner transport unit is pivoted so as to be set apart from the drum cartridge.

5. The image forming apparatus as defined in claim 1, further comprising:

stopping means for stopping the waste-toner transport unit, and for setting the waste-toner transport unit at a predetermined position in the proximity of the drum cartridge.

6. The image forming apparatus as defined in claim 2, further comprising:

stopping means for stopping the waste-toner transport unit, and for setting the waste-toner transport unit at a predetermined position in the proximity of the drum cartridge.

7. The image forming apparatus as defined in claim 3, further comprising:

stopping means for stopping the waste-toner transport unit, and for setting the waste-toner transport unit at a predetermined position in the proximity of the drum cartridge.

8. The image forming apparatus as defined in claim 1, wherein the drum cartridge includes a cleaning device for scraping the toner off the photoreceptor drum, the cleaning device being provided with a first transport means for transporting the toner to the waste-toner transport unit.

9. The image forming apparatus as defined in claim 8, wherein the waste-toner transport unit includes:

a second transport means for transporting the toner to the waste-toner container; and a coupling means for coupling the first transport means and the second transport means.

10. The image forming apparatus as defined in claim 2, wherein the shifting means includes:

conversion means for converting a pivotal movement of the waste-toner transport unit into a movement that is exerted on the developing cartridge in a departing direction or in an approaching direction with respect to the drum cartridge.

11. The image forming apparatus as defined in claim 10, wherein the waste-toner transport unit includes a rotative shaft and a gear that is formed around the shaft, and the developing cartridge includes a rack that is integrally formed therein, the gear and the rack being respectively provided with teeth, the numbers of which are determined in accordance with the shiftable range of the developing cartridge.

12. The image forming apparatus as defined in claim 3, wherein the waste-toner transport unit includes a toner-discharging section that reaches the first inlet of the waste-toner container, the toner-discharging section being arranged to push and open the closing means when the waste-toner transport unit is set at the predetermined position in the proximity of the drum cartridge.

13. The image forming apparatus as defined in claim 12, wherein the first inlet of the waste-toner container is formed in an upper face of the waste-toner container, and the closing means includes a first shutter for opening and closing the first inlet by sliding forward and backward in parallel with the first direction, and an elastic member for urging the first shutter in the first direction.

14. The image forming apparatus as defined in claim 12, wherein the toner-discharging section is a duct having a closed end, the duct being provided with a hole at one portion thereof through which toner is discharged, and a ring-shaped shutter on the periphery thereof for opening and closing the hole, the ring-shaped shutter being allowed to open when the waste-toner transport unit is set at the predetermined position in the proximity of the drum cartridge.

15. The image forming apparatus as defined in claim 14, wherein the ring-shaped shutter is provided with: a first protruding member for pushing and opening the closing means by contacting the closing means when the waste-toner transport unit is set at the predetermined position in the proximity of the drum cartridge; and a second protruding member for pushing and opening the ring-shaped shutter by contacting the waste-toner container when the waste-toner transport unit is set at the predetermined position in the proximity of the drum cartridge.

16. The image forming apparatus as defined in claim 5, wherein the stopping means includes a claw member attached to the waste-toner transport unit and an engaging section attached to the waste-toner container, the engaging section being engaged by a tip of the claw member.

17. The image forming apparatus as defined in claim 16, wherein the engaging section is a recessed section formed in an outer wall of the waste-toner container.

18. The image forming apparatus as defined in claim 16, wherein the engaging section is a hole formed in an outer wall that extends from the waste-toner container.

19. The image forming apparatus as defined in claim 1, wherein the developing cartridge includes a magnet roller for supplying toner to the photoreceptor drum, the developing cartridge being pressed against the drum cartridge so that a predetermined gap is maintained between the magnet roller and the photoreceptor drum.

20. An image forming apparatus comprising:

a photoreceptor;

a developer tank for storing developer that is used to develop an electrostatic latent image formed on the photoreceptor, the developer tank being arranged so that upon supply of the developer, excessive developer is allowed to overflow therefrom;

a developer-supplying container for storing at least one ingredient that is contained in the developer, and for supplying the ingredient to the developer tank;

a waste-toner container for storing waste toner that has been collected from the surface of the photoreceptor; and a waste-developer container for storing developer that has overflown from the developer tank, wherein the three parts, that is, the developer-supplying container, the waste-toner container and the waste-developer container, are integrated into one unit.

21. The image forming apparatus as defined in claim 20, wherein the developer-supplying container and an integrated unit consisting of the waste-toner container and the waste-developer container respectively include connecting means for separably connecting to each other.

22. The image forming apparatus as defined in claim 20, wherein the developer-supplying container, the waste-toner container and the waste-developer container respectively include connecting means for separably connecting one another.

23. The image forming apparatus as defined in claim 20, wherein the respective volumes of the developer-supplying container, the waste-toner container and the waste-developer container, are determined so that a term, by which all the developer inside the developer-supplying container is used up, virtually coincides with terms by which the waste-toner container and the waste-developer container are filled up with the respective contents.

24. The image forming apparatus as defined in claim 20, wherein the volumes of the developer-supplying container, the waste-toner container and the waste-developer container are set so as to be successively decreased in the following order: the developer-supplying container, the waste-toner container, and the waste-developer container.

25. The image forming apparatus as defined in claim 20, wherein the developer includes toner and carrier.

26. The image forming apparatus as defined in claim 21, wherein the connecting means includes: a recessed section that is formed in one of the developer-supplying container and the integrated unit of the waste-toner container and the waste-developer container; and a protruding portion that is attached to the other thereof so as to fit to the recessed section.

27. The image forming apparatus as defined in claim 26, wherein the developer-supplying container, the waste-toner container and the waste-developer container are integrally removed from the apparatus in a first direction, and the protruding portion is disengaged from the recessed section when the protruding portion is moved vertically in the first direction with respect to the recessed section.

28. The image forming apparatus as defined in claim 22, wherein the connecting means includes: a first recessed section that is formed in one of the developer-supplying container and the waste-toner container; a first protruding portion that is attached to the other thereof so as to fit to the first recessed section; a second recessed section that is formed in one of the waste-toner container and the waste-developer container; and a second protruding portion that is attached to the other thereof so as to fit to the second recessed section.

29. The image forming apparatus as defined in claim 28, wherein the developer-supplying container, the waste-toner container and the waste-developer container are integrally removable in a first direction; the first protruding portion is disengaged from the first recessed section when the first protruding portion is moved vertically in the first direction with respect to the first recessed section; and the second protruding portion is disengaged from the second recessed section when the second protruding portion is moved vertically in the first direction with respect to the second recessed section.

30. The image forming apparatus as defined in claim 20, wherein the waste-toner container and the waste-developer container are disposed side by side under the developer-supplying container that is attached to the image forming apparatus.

31. The image forming apparatus as defined in claim 20, further comprising:

cleaning means for collecting the waste-toner from the surface of the photoreceptor;

a first transport duct for transporting developer from the developer-supplying container to the developer tank;

a second transport duct for transporting developer that has overflown from the developer tank to the waste-developer container; and a third transport duct for transporting the waste toner from the cleaning means to the waste-toner container, the first, second and third transport ducts being installed by the side of one end of the photoreceptor.

32. The image forming apparatus as defined in claim 20, wherein the photoreceptor is formed into a cylindrical shape; the developer tank is installed in an extended manner in parallel with the axis of the photoreceptor; and the developer-supplying container is installed in an extended manner in parallel with the axis of the photoreceptor so as to overlap with the developer tank.

33. The image forming apparatus as defined in claim 20, wherein the developer-supplying container and the waste-toner container have a first face and a second face respectively, the first face confronting the second face, the first face being slide-fitted to the second face; and the waste-toner container and the waste-developer container have a third face and a fourth face respectively, the third face confronting the fourth face, the third face being slide-fitted to the fourth face.

34. The image forming apparatus as defined in claim 33, wherein the developer-supplying container and the developer tank have a fifth face and a sixth face respectively, the fifth face confronting the sixth face, the fifth face and the sixth face being respectively provided with openings through which the developer is sent from the developer-supplying container to the developer tank.

35. The image forming apparatus as defined in claim 33, wherein the waste-developer container and the developer tank have a seventh face and an eighth face respectively, the seventh face confronting the eighth face, the seventh face and the eighth face being respectively provided with openings through which developer that has overflown from the developer tank is sent from the developer tank to the waste-developer container.

36. The image forming apparatus comprising:

a photoreceptor;

a developer tank for storing developer that is used to develop an electrostatic latent image formed on the photoreceptor, the developer tank being arranged so that upon supply of the developer, excessive developer is allowed to overflow therefrom;

a developer-supplying container for storing at least one ingredient that is contained in the developer, and for supplying the ingredient to the developer tank;

a waste-toner container for storing waste toner that has been collected from the surface of the photoreceptor;

a waste-developer container for storing developer that has overflown from the developer tank; and pressing means for pressing the developer tank toward the photoreceptor, wherein the three parts, that is, the developer-supplying container, the waste-toner container and the waste-developer container, are integrated into one container unit, which is removable in a first direction with respect to the developer tank; the container unit is attached so as to freely move between a first station from which the container unit and the developer tank are removed and a second station providing a predetermined position at which the container unit and the developer tank are attached to the image forming apparatus; and the pressing means presses the developer tank toward the photoreceptor following the movement of the container unit toward the second station, as well as allows the developer tank to separate from the photoreceptor following the movement of the container unit toward the first station.

37. The image forming apparatus as defined in claim 36, wherein the pressing means comprises:

a shifting member that shifts in the second direction as well as in the third direction opposite to the second direction following the movement of the container unit;

a pressing member that shifts in a fourth direction and a fifth direction following the movement of the shifting member, the fourth direction being a direction in which the developer tank is pressed toward the photoreceptor drum, the fifth direction being a direction in which the developer tank is separated from the photoreceptor; and a driving member for driving the pressing member to move in the fourth direction when the shifting member moves in the second direction following the movement of the container unit toward the second station, and for driving the pressing member to move in the fifth direction when the shifting member moves in the third direction following the movement of the container unit toward the first station, the driving member being installed between the shifting member and the pressing member.

38. The image forming apparatus as defined in claim 36, further comprising:

an interlock switch for detecting an operable state of the image forming apparatus;

a covering member for covering the interlock switch when the container unit is not positioned at the second station, and for exposing the interlock switch by retreating when the container unit is positioned at the second station;

a lid for allowing access to the inside of the image forming apparatus; and a switch operation section, attached to the inner face of the lid, by which the interlock switch is operated upon closing the lid with the container unit being positioned at the second station.

39. The image forming apparatus as defined in claim 36, wherein a raised portion is formed on the container unit so as to clamp the container unit at the second station.

40. The image forming apparatus as defined in claim 39, further comprising:

clamping means for positioning the raised portion in the height direction of the image forming apparatus, as well as for preventing the raised portion from moving either in the direction orthogonal to the pressing direction of the developer tank toward the photoreceptor, or in the direction orthogonal to the height direction of the image forming apparatus.

41. The image forming apparatus as defined in claim 40, wherein the center of the raised portion extends in parallel with the pressing direction of the developer tank toward the photoreceptor; and the clamping means includes a clamping section which rotates centered on an axis that is orthogonal to the central axis of the raised portion with the container unit located at the second station, and to which the raised portion is fitted, as well as a clamping member which is provided with a guiding slope for guiding the raised portion to the clamping section, the clamping member being designed to allow the raised portion to slide on the guiding slope and to fit to the clamping section by rotating in a predetermined direction when the raised portion is pressed against the guiding slope, as well as to maintain the raised portion at the clamping section by rotating reversely when the raised portion is fitted to the clamping section.

42. The image forming apparatus as defined in claim 41, the guiding slope is formed into a three-dimensional geometric shape wherein a profile line of the guiding slope is always orthogonal to the axis that is orthogonal to the central axis, the profile line being made by arbitrarily slicing the guiding slope along a plane including the axis that is orthogonal to the central axis.

43. The image forming apparatus as defined in claim 36, further comprising:

an upper body to which the developer tank and the container unit are attached and which is opened upward so that the inside of the image forming apparatus is exposed;

a locking means for locking the upper body in the closed state thereof; and a release-restricting means for restricting the locking behavior of the locking means from being released when the container unit is positioned at the first station.

44. The image forming apparatus as defined in claim 36, further comprising:

a rotative mechanism for pivoting the container unit between the first station and the second station, the rotative mechanism being installed between the developer tank and the container unit.

45. The image forming apparatus as defined in claim 44, wherein the developer tank, the rotative mechanism and the container unit are formed into one unit that is removable in the first direction.

46. The image forming apparatus as defined in claim 45, wherein the second station is located at a position that is obtained by pivoting the container unit by 90 degrees from the first station.

47. The image forming apparatus as defined in claim 37, wherein the upper surface of the developer-supplying container and the shifting member are set at virtually the same level; and a first engaging shaft, by which the shifting member is engaged, is installed on the upper surface of the developer-supplying container in the proximity of the rotation center thereof, the shifting member being driven by the first engaging shaft in the second direction and in the third direction when the container unit is moved between the first station and the second station.

48. The image forming apparatus as defined in claim 47, wherein a second engaging shaft is installed adjacent to the first engaging shaft, the first engaging shaft and the second engaging shaft being aligned in the lengthwise direction of the developer-supplying container; a shaft-guiding member is installed in a protruding manner from the developer tank toward the proximity of the rotation center of the developer-supplying container; and a biaxial guiding hole having an L-shape is formed in the shaft-guiding member, the biaxial guiding hole being arranged to guide the first engaging shaft and the second engaging shaft when the container unit is moved between the first station and the second station.

49. The image forming apparatus as defined in claim 37, further comprising a main body that forms a frame of the image forming apparatus, wherein the pressing member includes a pressing plate having an L-shape, the pressing plate being pivotally attached to the developer tank so that the bent portion of the L-shape forms the rotation center, a first end of the pressing plate being engaged by the shifting member, a second end of the pressing plate being provided with a guiding shaft that sticks out therefrom; and the driving member includes a tension spring that is attached between the shifting member and the proximity of the first end of the pressing plate and an engaging section to which the guiding shaft is fitted, the engaging section being attached to the main body.

50. The image forming apparatus as defined in claim 49, wherein a rotation-restricting plate is provided in a protruding manner from the developer tank over the pressing plate like a hood, the rotation-restricting plate being provided with a rotation-restricting hole having a rectangular shape, the guiding shaft of the pressing plate being fitted to the rotation-restricting hole in such a manner that the movement of the developer tank is restricted in the fourth direction as well as in the fifth direction because the guiding shaft comes into contact with either of the short sides of the rotation-restricting hole.

51. The image forming apparatus as defined in claim 40, further comprising:

an interlock switch for detecting an operable state of the image forming apparatus; and a lid for allowing access to the inside of the image forming apparatus, wherein the clamping means includes a covering member for covering the interlock switch when the container unit is not positioned at the second station, and for exposing the interlock switch by retreating when the container unit is positioned at the second station; and a switch operation section, attached to the inner face of the lid, by which the interlock switch is operated upon closing the lid with the container unit being positioned at the second station.

52. The image forming apparatus as defined in claim 44, further comprising:

an upper body to which the developer tank and the container unit are attached and which is opened upward so that the inside of the image forming apparatus is exposed; and locking means for locking the upper body in the closed state thereof, wherein the rotative mechanism is provided with a release-restricting plate for restricting the locking means from being released by being located above the locking means when the container unit is positioned at the first station, and for allowing the locking means to be released by retreating from above the locking means when the container unit is positioned at the second station.

* * * * *